US007724146B2

(12) United States Patent
Nguyen et al.

(10) Patent No.: US 7,724,146 B2
(45) Date of Patent: May 25, 2010

(54) MAGNETICALLY RELEASABLE ELECTRONIC ARTICLE SURVEILLANCE TAG

(75) Inventors: Thang T. Nguyen, Boca Raton, FL (US); Franklin H. Valade, Jr., Lake Worth, FL (US); Dennis L. Hogan, Lighthouse Point, FL (US); Paul Griffiths, legal representative, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 204 days.

(21) Appl. No.: 11/467,487

(22) Filed: Aug. 25, 2006

(65) Prior Publication Data

US 2007/0067971 A1 Mar. 29, 2007

Related U.S. Application Data

(63) Continuation-in-part of application No. PCT/US2005/041813, filed on Nov. 16, 2005.

(60) Provisional application No. 60/628,730, filed on Nov. 17, 2004.

(51) Int. Cl.
*G08B 13/14* (2006.01)

(52) U.S. Cl. ..... 340/572.8; 340/572.9; 340/572.1; 340/551; 340/568.1; 340/5.61; 70/57.1; 70/391; 70/416; 70/453

(58) Field of Classification Search ..... 340/572.8, 340/572.9, 572.1, 551, 568.1, 825.54, 5.61, 340/825.44; 70/57.1, 391, 416, 453, 654
See application file for complete search history.

(56) References Cited

U.S. PATENT DOCUMENTS

| | | | | | |
|---|---|---|---|---|---|
| 4,502,717 | A * | 3/1985 | Close | 70/57.1 |
| 4,774,504 | A * | 9/1988 | Hartings | 340/572.5 |
| 4,987,754 | A * | 1/1991 | Minasy et al. | 70/57.1 |
| 5,031,287 | A * | 7/1991 | Charlot et al. | 24/704.1 |
| 5,069,047 | A * | 12/1991 | Lynch et al. | 70/57.1 |
| 5,077,872 | A * | 1/1992 | Guthammar | 24/704.1 |
| 5,347,262 | A * | 9/1994 | Thurmond et al. | 340/572.9 |
| 5,955,951 | A * | 9/1999 | Wischerop et al. | 340/572.8 |
| 6,449,991 | B1 * | 9/2002 | Hogan | 70/57.1 |
| 7,073,236 | B2 * | 7/2006 | Xue et al. | 24/704.1 |
| 7,190,272 | B2 * | 3/2007 | Yang et al. | 340/572.8 |

FOREIGN PATENT DOCUMENTS

| | | | |
|---|---|---|---|
| EP | 0142748 | A1 | 5/1985 |
| EP | 0947650 | A1 | 10/1999 |
| WO | 199731170 | A1 | 8/1997 |
| WO | 2006055774 | A1 | 5/2006 |
| WO | 2006063190 | A1 | 6/2006 |
| WO | 2006127674 | A1 | 11/2006 |

OTHER PUBLICATIONS

International Search Report and Written Opinion for Corresponding International Application PCT/US2007/018680 filed on Aug. 22, 2007, mailed Feb. 14, 2008.

* cited by examiner

*Primary Examiner*—Tai T Nguyen
(74) *Attorney, Agent, or Firm*—Kacvinsky LLC

(57) ABSTRACT

A system, apparatus and method are described for an electronic article surveillance security tag having a magnetically releasable tack retaining system, and a magnetic detaching device for use with the electronic article surveillance tag. Other embodiments are described and claimed.

66 Claims, 68 Drawing Sheets

PARTIAL CROSS SECTION OF A-A OF FIG. 9F
SHOWING SOME DIMENSIONS

MAGNETICALLY RELEASABLE ELECTRONIC ARTICLE SURVEILLANCE TAG

RELATED APPLICATIONS

This application is a continuation-in-part of PCT patent application number—PCT/US2005/041813 filed on Nov. 16, 2005, which claims benefit of earlier filed provisional patent application No. 60/628,730 filed on Nov. 17, 2004 titled "Magnetically Releasable Grooved Tack Clutch For Reusable And NonReusable Applications," the entireties of which are hereby incorporated by reference for all purposes.

BACKGROUND

An Electronic Article Surveillance (EAS) system is designed to prevent unauthorized removal of an item from a controlled area. A typical EAS system may comprise a monitoring system and one or more security tags. The monitoring system may create a surveillance zone at an access point for the controlled area. A security tag may be fastened to the monitored item, such as a garment or article of clothing. If the monitored item enters the surveillance zone, an alarm may be triggered indicating unauthorized removal of the monitored item from the controlled area.

Security tags are typically attached to the article of clothing using a metal tack having a large head. During attachment operations, the tack may be inserted through the clothing fabric and into a tack shank hole in the security tag where the tack shank is securely retained. During detachment operations, the tag may be released from the security tag and the garment at the point of sale.

Security tags may generally comprise one of two types. One type of security tag may be designed for reuse. For example, a security tag may be detached from the monitored item at the point of sale in a manner that does not substantially harm the integrity of the security tag, either externally or internally. Once detached, the reusable tag may be reattached to another item. Another type of security tag may be designed for single use. For example, a security tag may be detached from the monitored item at the point of sale in a manner that typically harms the integrity of the security tag. Once detached, a single-use security tag cannot be reattached again to another item.

Both types of security tags may be unsatisfactory for a number of reasons. For example, conventional reusable security tags may be relatively expensive since they are made to be durable enough to withstand the rigors of continuous attaching and detaching from monitored items. Single-use security tags, however, may not be economical, or secure enough to meet the design constraints for a given security system. Consequently, there may be a need for an improved EAS system to solve these and other problems.

DETAILED DESCRIPTION

Some embodiments may be directed to a security system. The security system may comprise, for example, an EAS system. The EAS system may include a security tag, a detaching device and monitoring system. In general operation, the security tag may include a sensor to emit a detectable signal when it is in the monitored surveillance zone. The security tag may be attached to an item to be monitored, such as a garment or article of clothing. The detaching device may remove the security tag from the item. The monitoring system may monitor a controlled area for the signal to ensure that the monitored item with the security tag is not removed from the controlled area.

Various embodiments may include a system that can address the use of reusable and single-use security tags. A system that may address the use of both types of tags may be desirable for modern hypermarket type retail stores. Inexpensive single use security tags make it economical to tag less expensive items, whereas more expensive items can still be tagged with the more expensive reusable type of security tag. Both types of security tags could be removed from the items with the same detaching device as described herein.

Figure 1A:
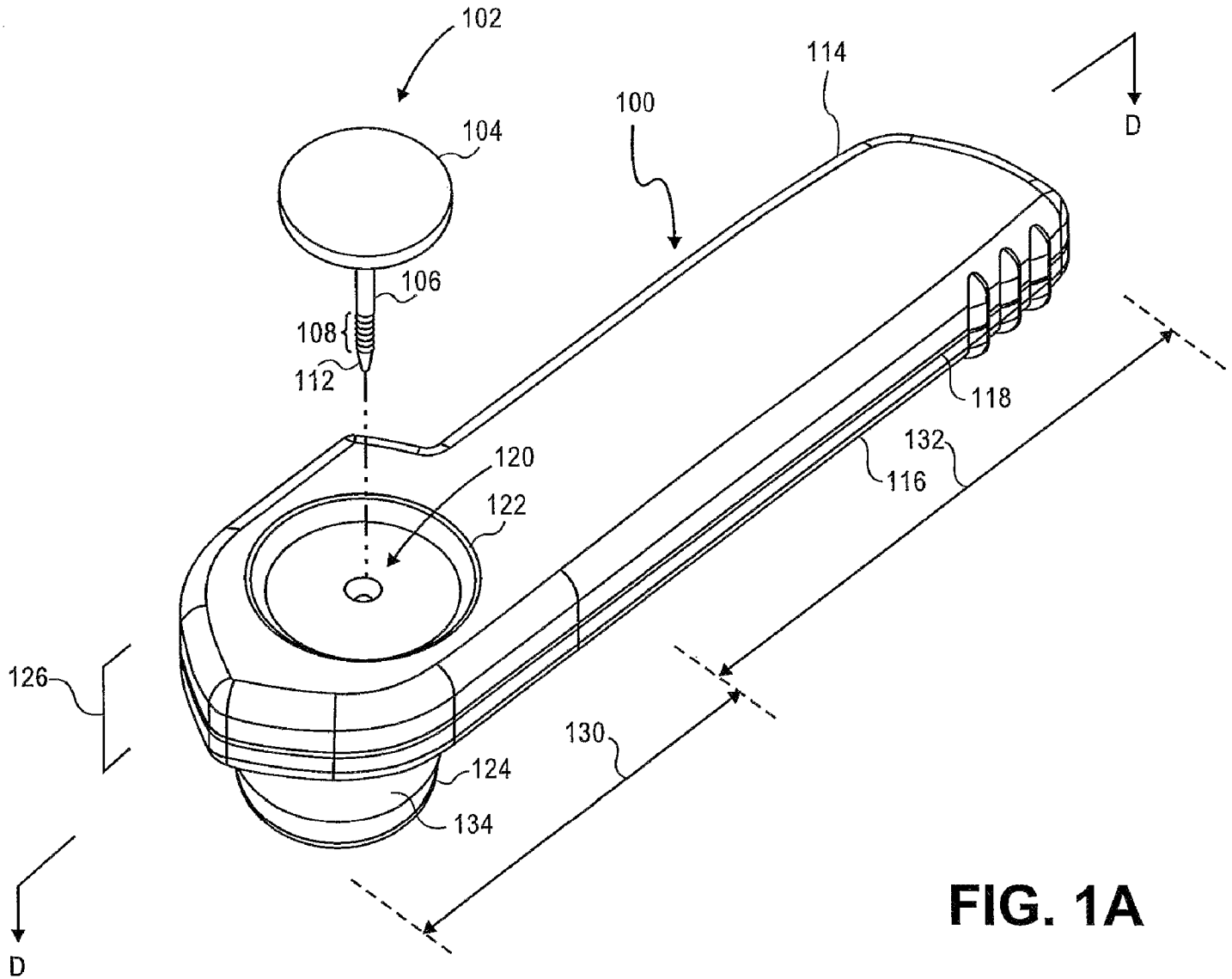
FIG. 1A illustrates a security tag and a tack assembly in accordance with one embodiment.

FIG. 1A illustrates a security tag and a tack assembly in accordance with one embodiment. FIG. 1A may illustrate a security tag 100 and a tack assembly 102. Security tag 100 may be implemented with a tack retaining system. A tack retaining system may refer to one or more elements arranged to retain tack assembly 102 when inserted into security tag 100. Security tag 100 may be implemented as a reusable security tag or a single-use security tag depending on the type of tack retaining system implemented for security tag 100. The embodiments are not limited in this context.

In one embodiment, for example, security tag 100 may be implemented using a reusable tack retaining system. A reusable security tag may be detached from a monitored item in a manner that does not substantially harm the integrity of the security tag, either externally or internally. Once a reusable security tag is detached, it may generally be reattached to another item. Detachment indicates the tag is the unlocked condition.

In one embodiment, for example, security tag 100 may be implemented using a single-use tack retaining system. A single-use security tag may be detached from the monitored item in a manner that typically harms the integrity of the security tag. Once a single-use security tag is detached, it generally cannot be reattached again to another item. Detachment indicates the tag is in the permanently unlocked condition.

In one embodiment, tack assembly 102 may comprise an enlarged tack head 104 and an elongated tack shank 106. Tack shank 106 may have one or more grooves 108 and a pointed end 112. In one embodiment, for example, tack head 104 may have a diameter of approximately 0.5 inches, and a thickness of approximately 0.05 inches. Tack shank 106 may be similar in shape to a small pointed nail. In one embodiment, for example, tack shank 106 may be 0.75 inches long, and 0.046 inches in diameter. The grooves 108 may have a diameter of 0.038 inches. The embodiments are not limited in this context.

Security tag 100 may be implemented using various materials, to include various types of metals and plastics. For example, tack head 104 may be formed using plastic and/or steel. Tack shank 106 is typically formed using steel. A design constraint for security tag 100 may include the amount of magnetic material that is used with security tag 100, since the range of some sensors may be reduced by such magnetism. Consequently, tack assembly 102 may be implemented using a plastic material for tack head 104 to reduce the overall amount of steel in tack assembly 102. Another potential option is to use non-magnetic stainless steel to manufacture tack assembly 102. The embodiments, however, are not limited to a particular material for tack assembly 102, as long as they are designed to operate compatibly with each other.

In one embodiment, tack assembly 102 may be used to attach security tag 100 to an item. The item may comprise any commercial good, such as a garment, article of clothing, packaging material, digital versatile disc (DVD) jewel case, compact disk (CD) jewel case, glasses, boxes, and so forth. When the item is a garment or article of clothing, pointed end 112 may be inserted through the garment and into security tag 100. The attachment operation may be discussed in more detail below.

In one embodiment, tack assembly 102 may also include additional features, such as a lanyard or security strap attached to tack head 104. The lanyard or security strap may allow security tag 100 to be used with items where penetration of the item is not desired or possible. For example, packaged items such as sports equipment, electronics and any other product may be secured with the lanyard through a stable portion of the packaging or product itself. The embodiments are not limited in this context.

In one embodiment, security tag 100 may be smaller in size than some conventional security tags. In one embodiment, for example, security tag 100 may be approximately 2.6 inches long, 0.8 inches wide, and 0.25 inches thick. With tack assembly 102 inserted into security tag 100, the thickness may increase to approximately 0.67 inches. The total weight may be approximately 6 grams. The embodiments, however, are not limited to these particular metrics.

In one embodiment, security tag 100 may comprise an upper housing 114 and a lower housing 116. Upper housing 114 and lower housing 116 may be joined at seam 118 to form the closed security tag 100. In one embodiment, housings 114 and 116 may be made of a semi-hard or rigid material. A usable rigid or semi-hard material may include a hard plastic such as an injection molded Acrylonitrate-Butadiene-Styrene (ABS) plastic, or a plastic such as polycarbonate. If a plastic material is used, the mating of housings 114 and 116 may be accomplished using an ultrasonic weld, snap fitting, or any other suitable joining mechanism desired for a given implementation. The embodiments are not limited in this context.

In one embodiment, security tag 100 may comprise a first end 130 and a second end 132. First end 130 and second end 132 may be partially hollow, with each end having a compartment. First end 130 may have a first compartment to hold a tack retaining system. In one embodiment, for example, the tack retaining system may include a steel wedge shaped member and a rubber bias spring to retain tack shank 106 of tack assembly 102. First end 130 may also be referred to herein as an "attachment end" or "tack retaining system end." Second end 132 may have a second compartment to hold a sensor to emit a signal detectable by the monitoring system. An example of a sensor suitable for use with security tag 100 may include the EAS Ultra-Max® narrow label sensor made by Sensormatic® Electronics Corporation ("UltraMax Sensor"). Second end 132 may also be referred to herein as a "detection end."

In one embodiment, first end 130 may comprise a tag head 126. Tag head 126 may further comprise an upper housing aperture 120 and a concentric rampart 122. First end 130 may be approximately 0.9 inches long and 0.825 inches wide. The shape may be similar to a half circle with a diameter of approximately 0.825 inches. The embodiments are not limited in this context.

In one embodiment, first end 130 may also comprise a detacher interface for use with a detaching device, such as magnetic detaching device 602 as described with reference to FIG. 6. For example, first end 130 may include a protrusion 124 having an outer wall 134. Protrusion 124 may comprise any desired shape, as long as the desired shape appropriately interfaces with the detaching device. In one embodiment, for example, protrusion 124 may have a cylindrical shape, as shown in FIG. 1A. The embodiments are not limited in this context.

In one embodiment, second end 132 may be approximately 1.8 inches long, 0.62 inches wide and 0.22 inches thick. The shape may be similar to a rectangle. The shape and dimensions of second end 132 may allow second end 132 to act as a handle to place the protrusion 124 into the magnetic detaching device described herein.

Figure 1B:
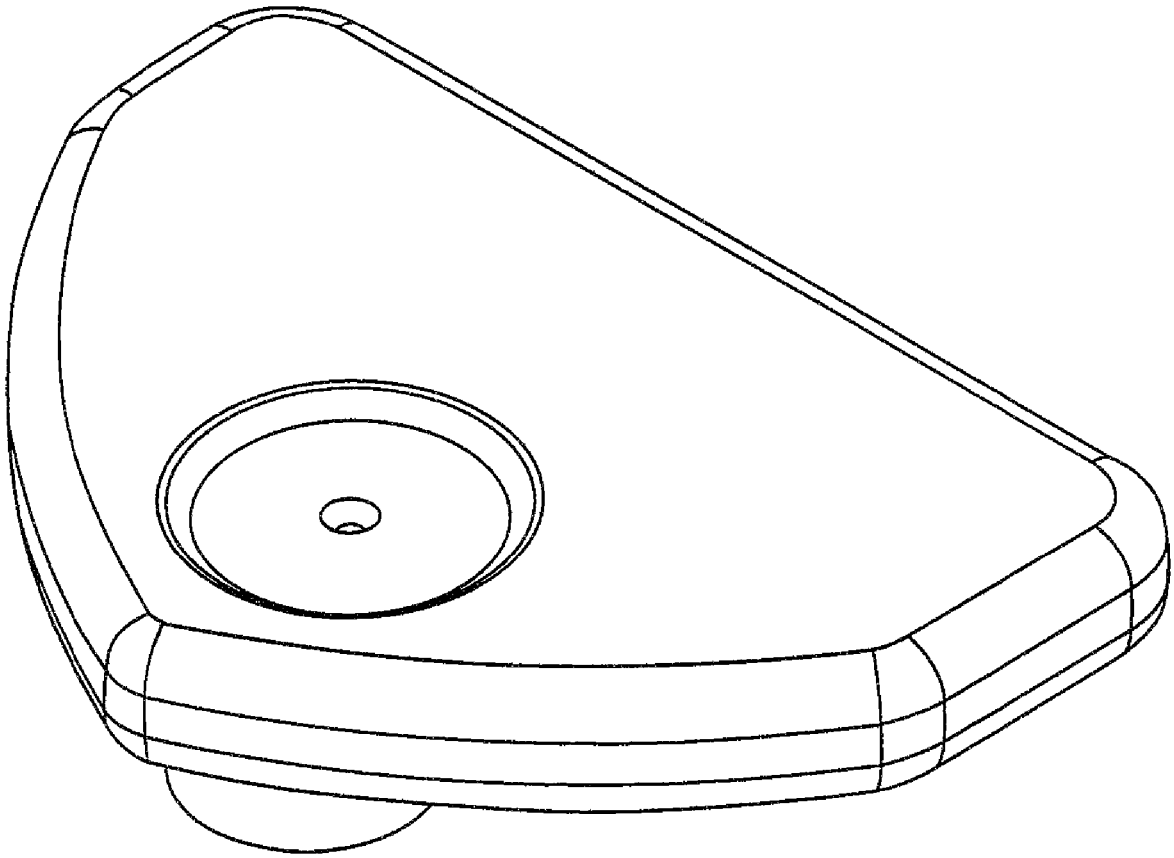
FIG. 1B illustrates a security tag assembly in accordance with one embodiment.

FIG. 1B illustrates a security tag assembly in accordance with one embodiment. FIG. 1B may illustrate another possible embodiment of security tag 100 that is similar to the embodiment described with reference to FIG. 1A. As shown in FIG. 1B, second end 132 may be formed 90° with respect to first end 130. The embodiments are not limited in this context.

As illustrated in FIGS. 1A and 1B, security tag 100 may be implemented using a number of different external shapes or configurations. It may be appreciated, however, that security tag 100 may be implemented using any number of external configurations for a given set of design constraints. The external configuration used for a particular implementation should be made in accordance with the design and configuration of the compatible magnetic detaching device used to detach security tag 100 from a monitored item. In one embodiment, for example, the external configuration shown for security tag 100 in general, and first end 130 in particular, have been designed to interface with the embodiments of a magnetic detaching device 602 as described with reference to FIG. 6. The embodiments are not limited in this context.

In one embodiment, upper housing aperture 120 of first end 130 may be used to receive tack shank 106 during the attachment operation. The diameter of upper housing aperture 120 may be a little larger than the diameter of tack shank 106 to accommodate the insertion of tack shank 106 during the attachment operation.

In one embodiment, concentric rampart 122 may be a rampart defining a space to receive tack head 104. The diameter of concentric rampart 122 may be a little larger than the diameter of tack head 104 to ensure tack head 104 may be properly seated during the attachment operation. In one embodiment, for example, the internal diameter of concentric rampart 122 may be approximately 0.66 inches. One purpose for concentric rampart 122 is to better secure the article between tack head 104 and security tag 100. As a result, this arrangement may better resist unauthorized attempts to pry tack assembly 102 away from security tag 100. The size and configuration of tack head 104, as well as the shape and size of the mating rampart 122 are not limited in this context.

Figure 2:
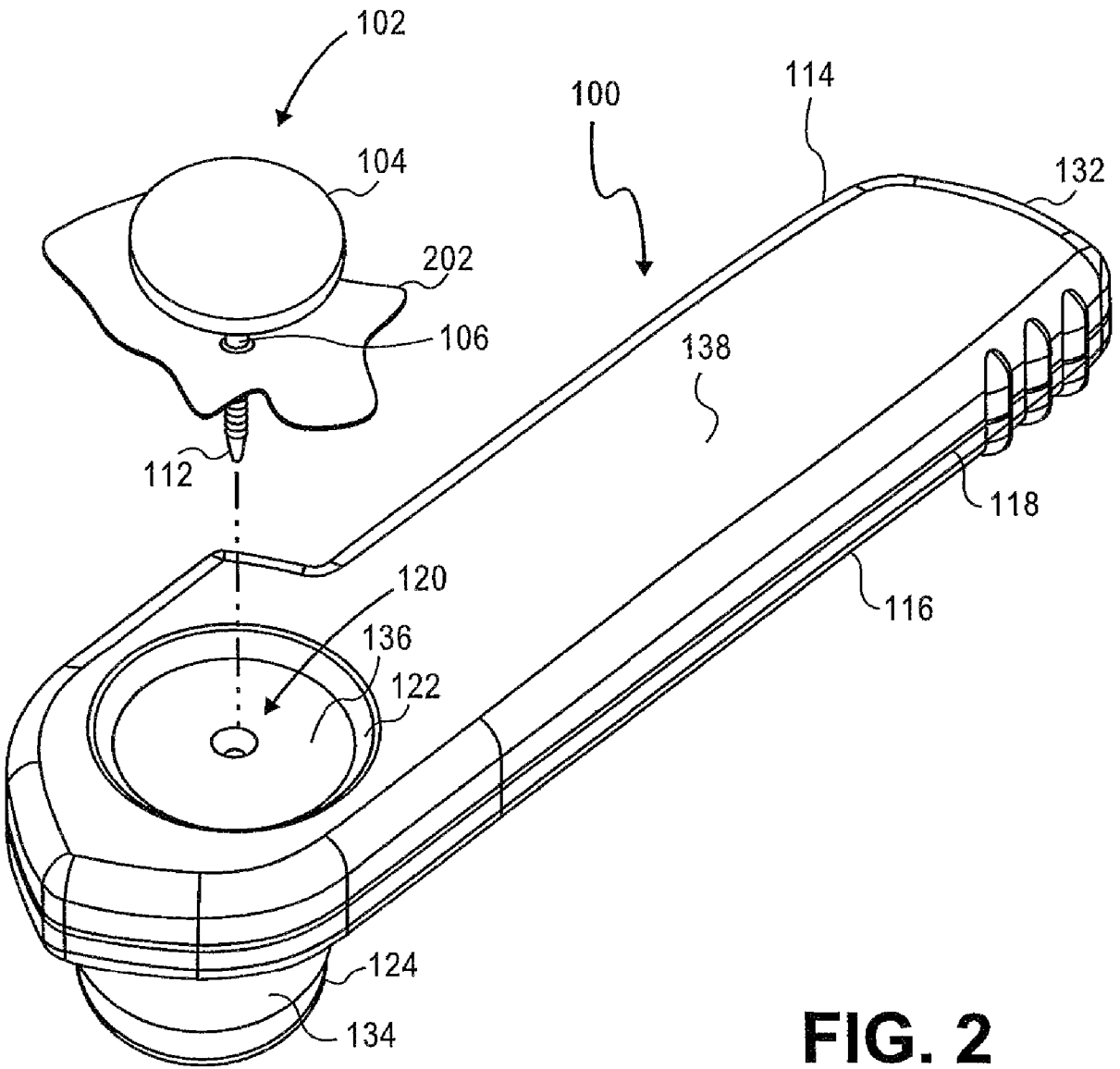
FIG. 2 illustrates a security tag, a tack assembly and an article in an unfastened position in accordance with one embodiment.

FIG. 2 illustrates a security tag, a tack assembly and an article in an unfastened position in accordance with one embodiment. FIG. 2 may illustrate the beginning of the attachment operations to fasten security tag 100 to an item, such as an article of clothing. During the attachment operation, pointed end 112 of tack body 106 may be inserted through an article 202. The size of tack head 104 helps to ensure that article 202 may not be removed from tack assembly 102 without damaging article 202.

Figure 3:
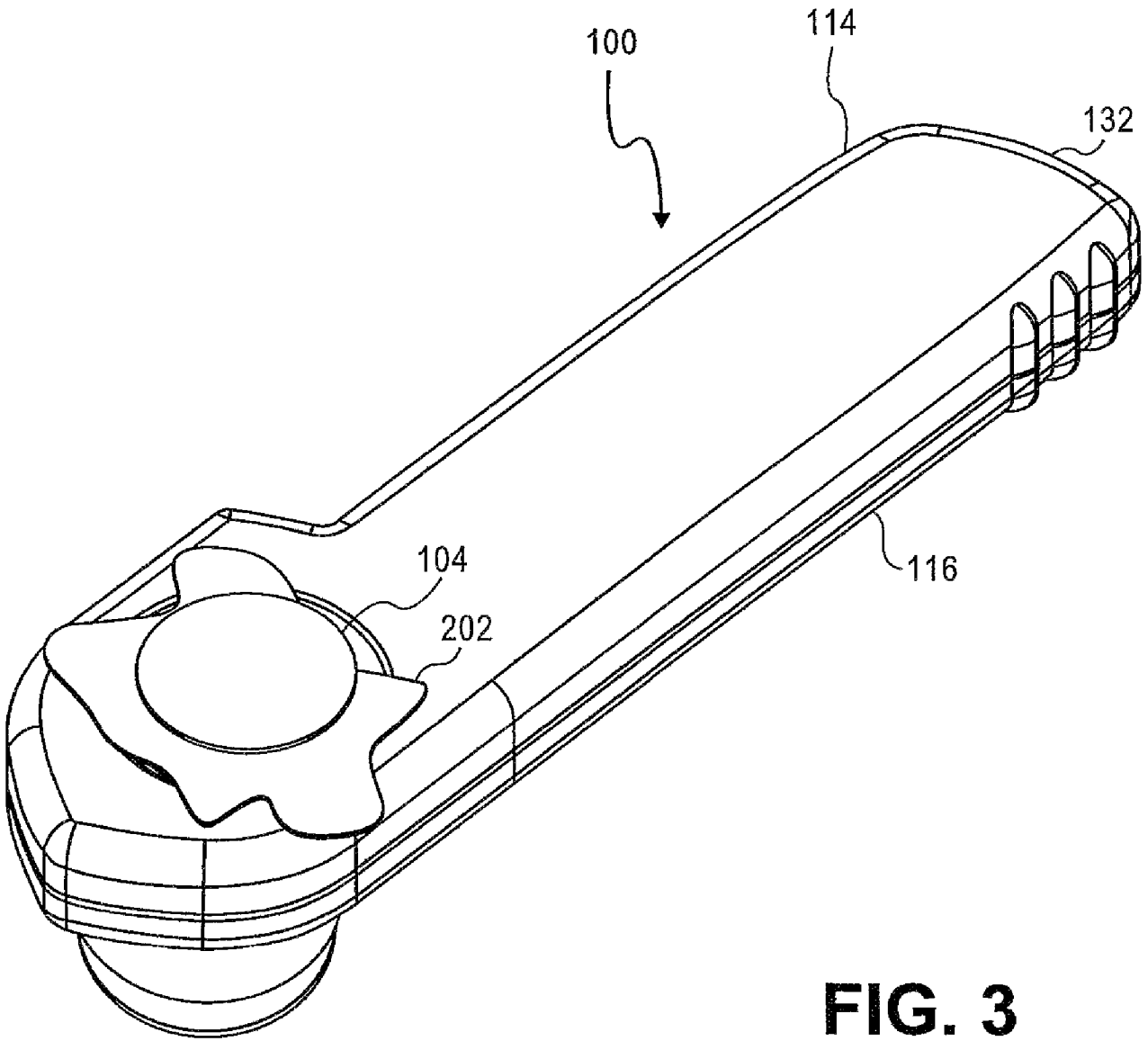
FIG. 3 illustrates a security tag, a tack assembly and an article in a fastened position in accordance with one embodiment.

FIG. 3 illustrates a security tag, a tack assembly and an article in a fastened position in accordance with one embodiment. FIG. 3 may illustrate the end of the attachment operation to fasten security tag 100 to an item, such as article 202. Once pointed end 112 of tack shank 106 is inserted through article 202, pointed end 112 may be inserted into upper housing aperture 120. Force may be applied to tack head 104 until tack head 104 is seated in concentric rampart 122. Tack assembly 102 may remain attached to security tag 100 by a tack retaining system. In one embodiment, for example, the tack retaining system may include a wedge biased by a rubber spring, as discussed in more detail below. Once seated, tack assembly 102 and security tag 100 may be securely attached to article 202. Once attachment operations have been properly performed, the detachment of security tag 100 from article 202 may be accomplished using magnetic detaching device 602.

Figure 4:
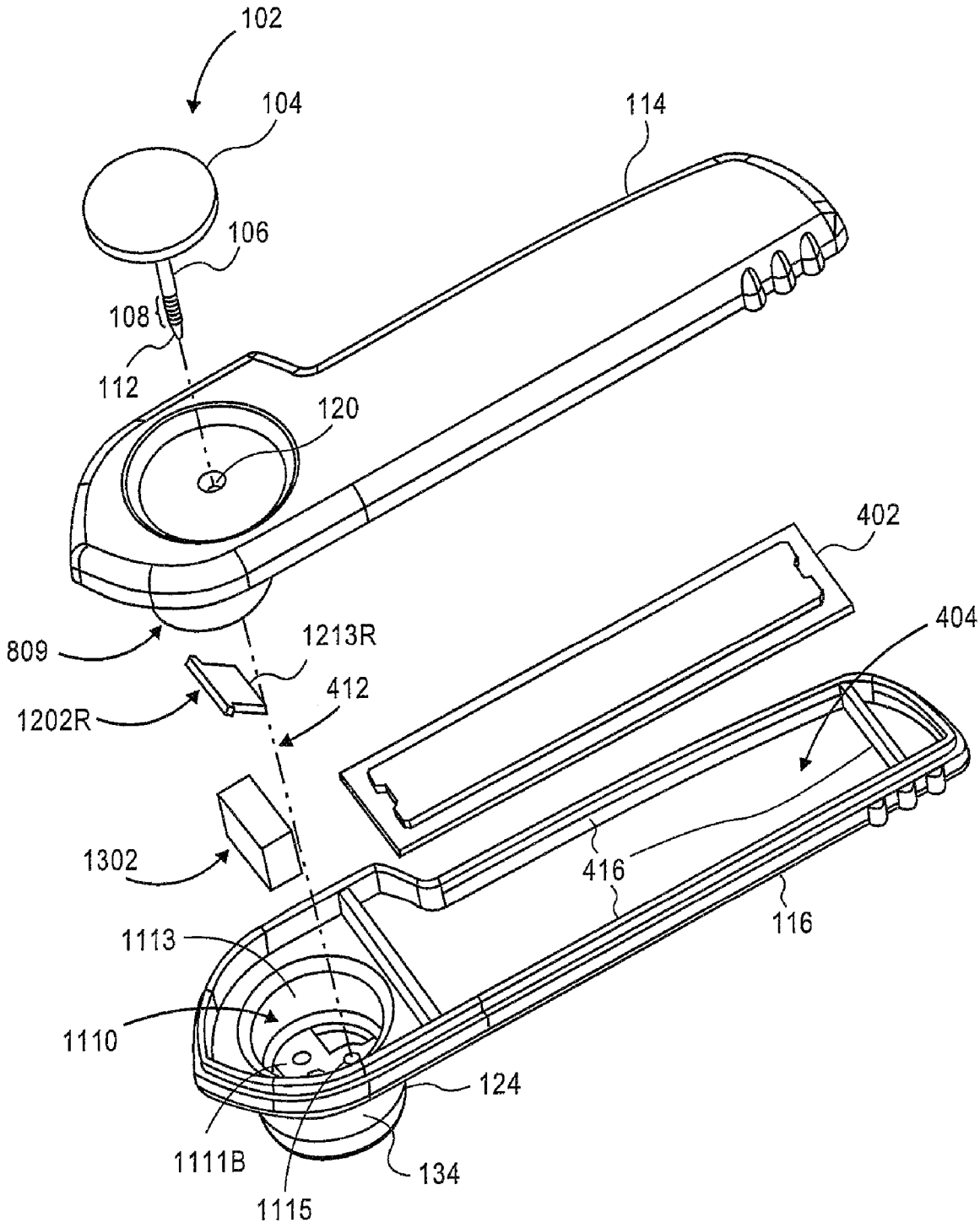
FIG. 4 illustrates a first perspective view of a disassembled security tag in accordance with one embodiment.

FIG. 4 illustrates a first perspective view of a disassembled security tag in accordance with one embodiment. FIG. 4 illustrates a first perspective view for a disassembled security tag 100 suitable for use as a reusable security tag. The first perspective view illustrates in particular the exterior of upper housing 114, and the interior of lower housing 116.

In one embodiment, security tag 100 may include a sensor 402. Sensor 402 may comprise any sensor capable of generating a detectable signal, such as a magnetic sensor, an acoustic magnetic sensor, a Radio-Frequency (RF) sensor, or other type of sensor. In one embodiment, for example, sensor 402 may comprise the UltraMax. Sensor. The signal may be detected by an EAS monitoring system. The EAS monitoring system may include, for example, a transmitter/receiver ("transceiver") to detect the signals, and inform a monitoring system of the presence or absence of security tag 100 in the surveillance zone.

In one embodiment, lower housing 116 may have a sensor compartment 404. Sensor compartment 404 may be representative of, for example, the second compartment discussed with reference to FIG. 1A. Sensor compartment 404 may comprise a plurality of walls 416 to define an area large enough for a given sensor. In one embodiment, for example, sensor 404 may be an UltraMax Sensor having the dimensions of 1.73 inches long, 0.46 inches wide and 0.085 inches thick. Other lengths and sizes can accommodate other detection technologies. Walls 416 may correspond to similar walls for upper housing 114.

In one embodiment, lower housing 116 may also have a pocket 1110, as described with reference to FIG. 11. Pocket 1110 may provide a bearing surface 1111B for a rubber spring 1302, as described in more detail with reference to FIG. 13. The circular inside wall 1113 may guide and secure circular protrusion 809, such as shown in FIG. 5 described below, of upper housing 114 when upper housing 114 and lower housing 116 are joined together to form security tag 100.

Figure 5:
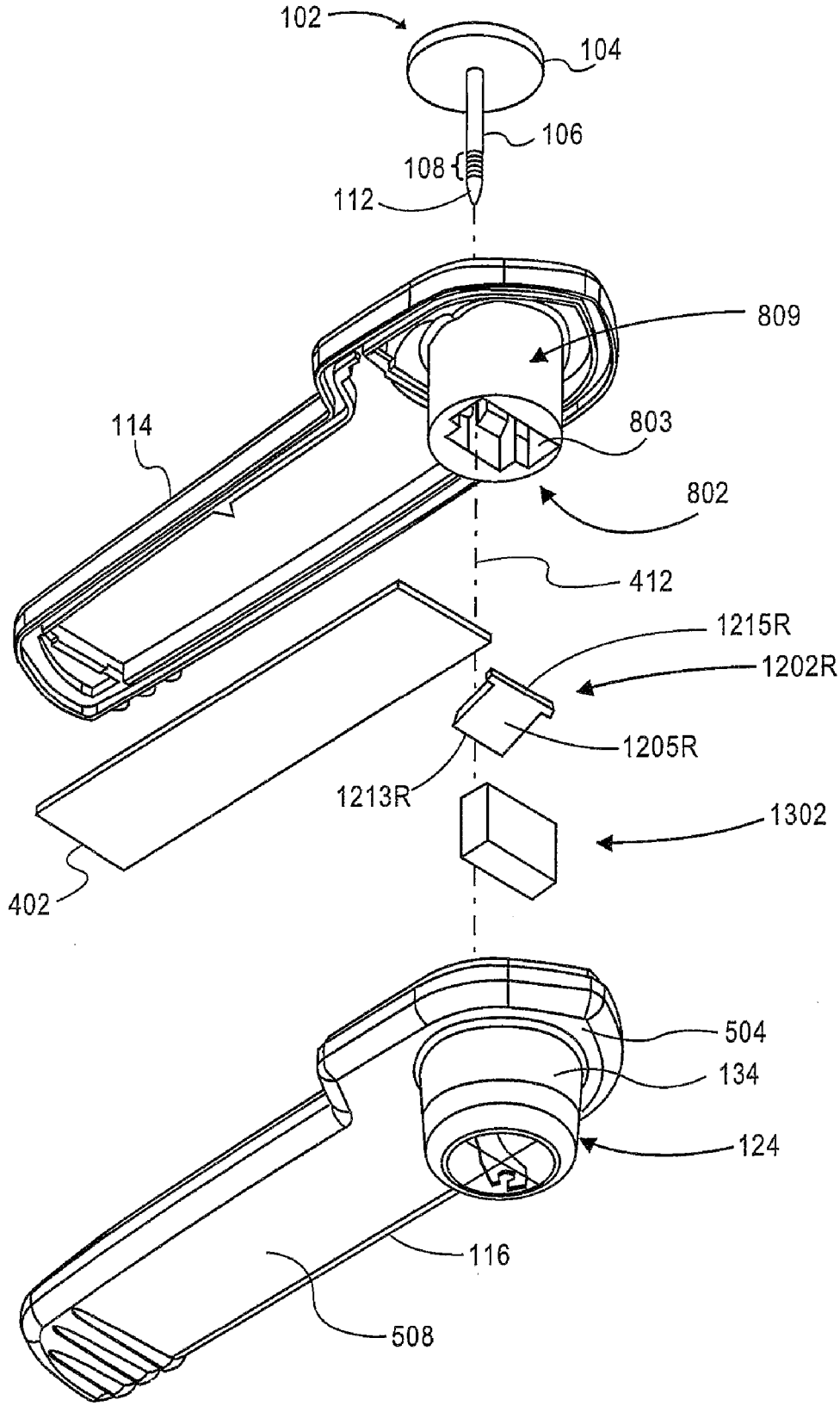
FIG. 5 illustrates a second perspective view of a disassembled security tag in accordance with one embodiment.

FIG. 5 illustrates a second perspective view of a disassembled security tag in accordance with one embodiment. FIG. 5 illustrates a second perspective view for a disassembled security tag 100 suitable for use as a reusable security tag. The second perspective view illustrates in particular the interior of upper housing 114, and the exterior of lower housing 116.

Figure 8A:
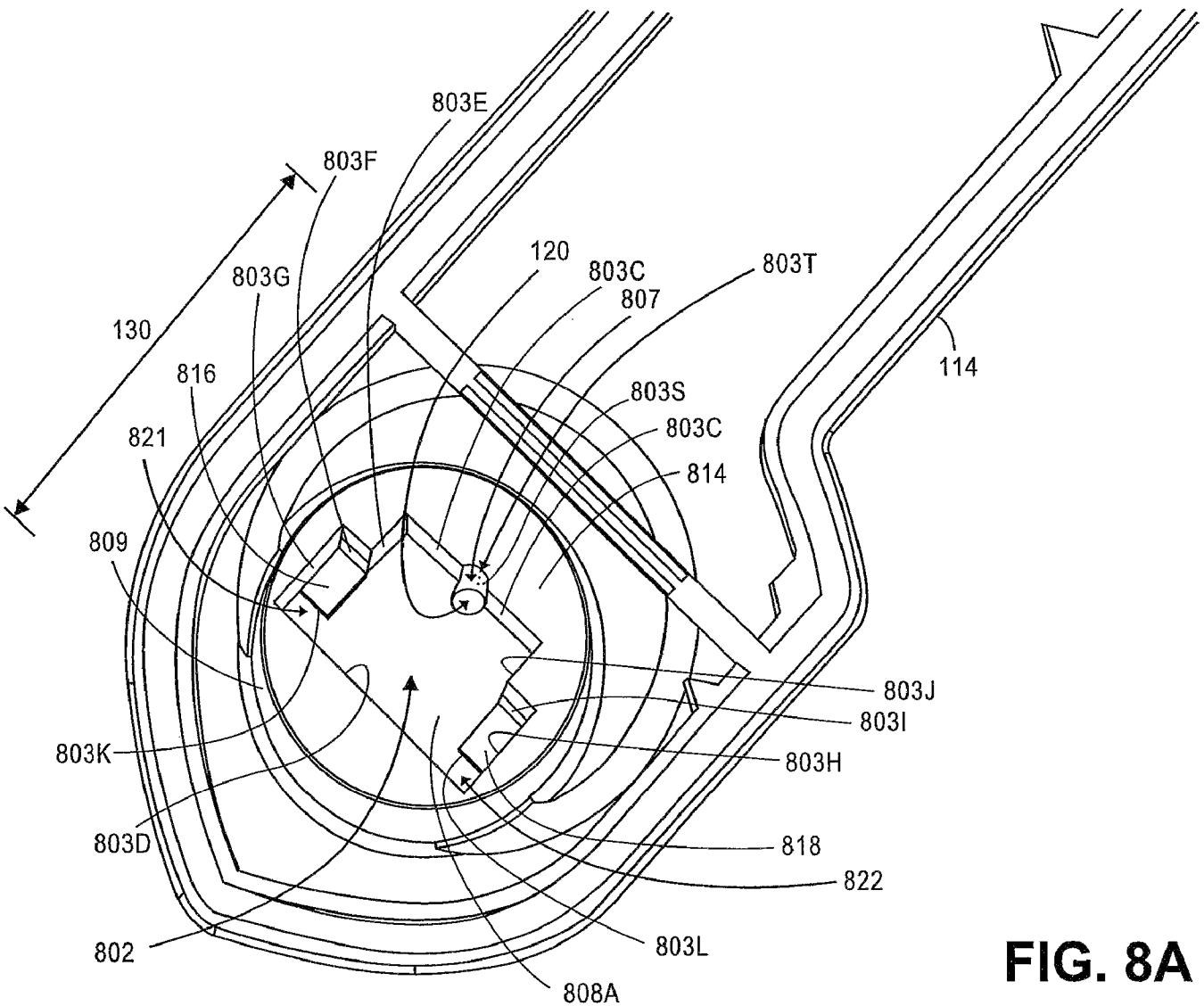
FIG. 8A illustrates an interior view of an upper housing for a security tag in accordance with one embodiment.

In one embodiment, upper housing 114 may include a wedge compartment 802 that is formed within protrusion 809, as described in more detail with reference to FIG. 8A. Wedge compartment 802 may be representative of, for example, the first compartment discussed with reference to FIG. 1A. Wedge compartment 802 may comprise a plurality of side walls 803 to define an area large enough for a wedge 1202R as described in more detail with reference to FIG. 12A, and a rubber spring 1302 as described in more detail with reference to FIG. 13. For example, wedge compartment 802 may be designed to receive and loosely constrain wedge 1202R and rubber spring 1302. Compartment 802 may also be defined by a plurality of posts, recesses, or other structures that define an area that receives wedge 1202R and rubber spring 1302. Once housings 114 and 116 are joined at seam 118, the first and second compartments may be closed and sealed. Sensor 402 may be securely contained, although not deformed, within sensor compartment 404. Wedge 1202R and rubber spring 1302 may be securely contained within wedge compartment 802, such as shown in FIG. 8A (described below) as well as in FIG. 5, thereby forming a tack retaining system.

Positioning rubber spring 1302 between wedge surface 1205R and the bearing surface 1111B may cause wedge 1202R to be biased inwardly into wedge compartment 802. When tack assembly 102 is inserted through upper housing aperture 120 along line 412, tack shank 106 may intersect tack retaining edge 1213R of wedge 1202R, causing wedge 1202R to pivot approximately about pivot edge 1215R against the bias of rubber spring 1302. Tack shank 106 may slide along tack retaining edge 1213R and be biased by rubber spring 1302 into a passing tack groove 108 of tack shank 106. During the attachment operation, a portion of tack shank 106 may move into lower housing shank hole 1115. Once tack retaining edge 1213R is biased into a tack groove 108 at tack lip 107 (see FIGS. 8D and 9A), tack shank 106 cannot be retracted from aperture 120 unless the tack holding strength of the tack retaining system is overcome. In this manner security tag 100 and tack assembly 102 may be locked or fastened together to complete the attachment operation. This may be referred to herein as a "lock condition" or "locked condition."

In one embodiment, lower housing 116 may include a surface 508. Protrusion 124 may be integrally formed with surface 508. The diameter of protrusion 124 may be smaller than the size of tag head 126. In one embodiment, the diameter of protrusion 124 is approximately 0.55 inches, and may protrude 0.45 inches. The smaller size of the protrusion 124 may create a shoulder area 504. Shoulder area 504 may be relatively flat, and may be used to assist seating first end 130 and protrusion 124 into a magnetic detaching device during the detachment operation.

In one embodiment, the detachment operation may refer to detaching or releasing tack assembly 102 from wedge 1202R of security tag 100. Once tack assembly 102 is released from wedge 1202R, tack assembly 102 may be withdrawn from security tag 100. Once tack assembly 102 has been withdrawn from security tag 100, article 202 may be removed from tack body 106, thus completing the detachment operation. This may be referred to herein as an "unlocked condition." The detachment operation may be described in greater detail with reference to FIG. 6.

Figure 6:
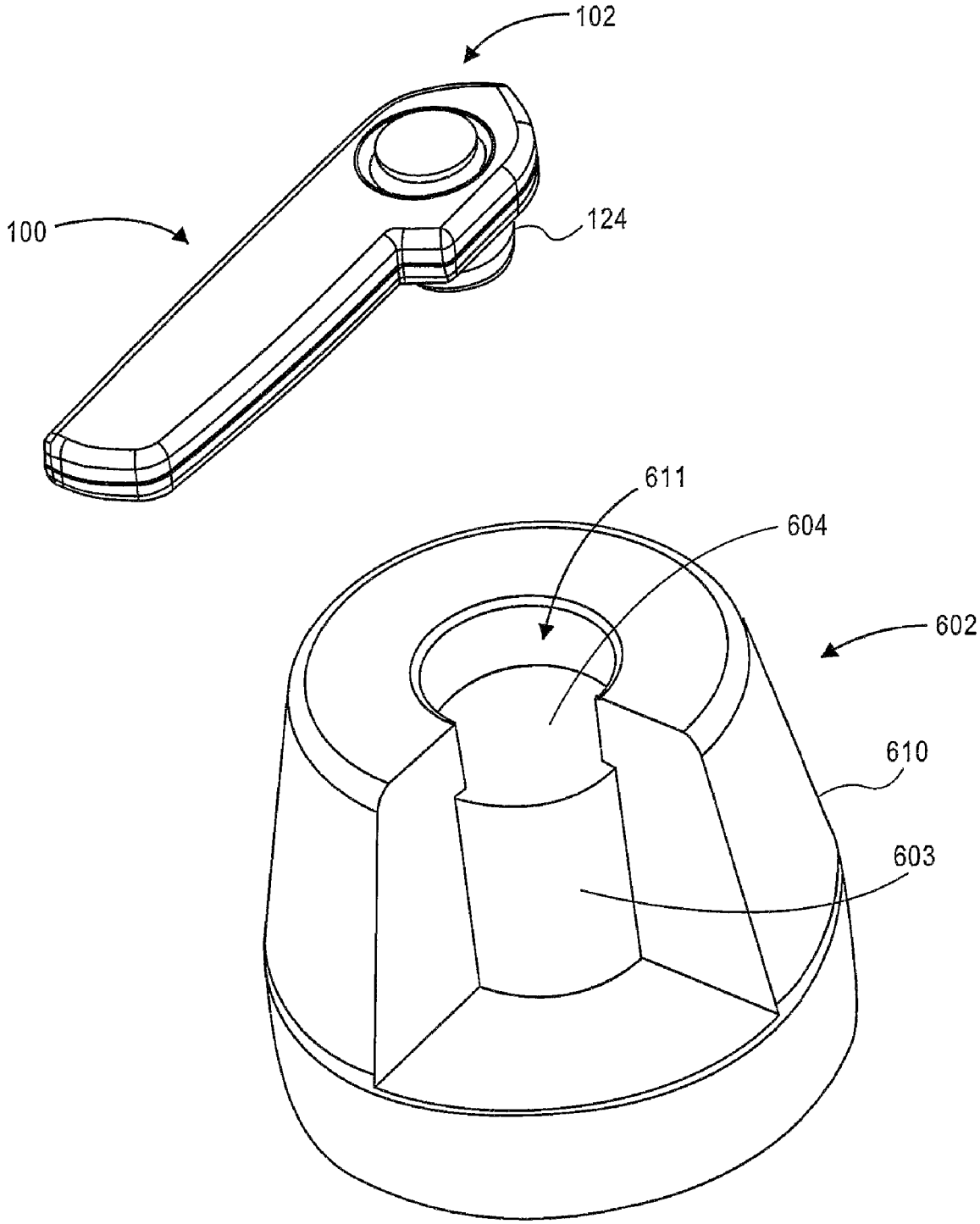
FIG. 6 illustrates a cutaway view of a security tag and tack assembly aligned with a magnetic detaching device in accordance with one embodiment.

FIG. 6 illustrates a cutaway view of a security tag and tack assembly aligned with a magnetic detaching device in accordance with one embodiment. FIG. 6 shows a view of security tag 100 being aligned over a magnetic detaching device 602. Magnetic detaching device 602 is shown in a cutaway view for clarity. Magnetic detaching device 602 may comprise, for example, a magnet assembly 603 and a housing 610. The housing 610 may be, for example, suitable for countertop mounting where the tag receiving hole 611 is above the surface of the countertop. A different housing with a bezel may be suitable for mounting in a hole in the countertop such that the opening for tag receiving hole 611 is flush or nearly flush with the countertop surface. The embodiments are not limited in this context.

In one embodiment, magnetic detaching device 602 may have a tag interface. The tag interface may be arranged to interface with the detacher interface of security tag 100. In one embodiment, for example, the tag interface may comprise tag receiving hole 611. The diameter for the opening of tag receiving hole 611 may be designed to accept tag protrusion 124 loosely for easy insertion by the user, yet still assure proper tag location for detachment. The depth of tag receiving hole 611 may be arranged to allow proper detachment of the tack from the tag, which is typically slightly less than the length of the tag protrusion 124. In one embodiment, for example, the external configuration shown for magnetic detaching device 602 has been designed to interface with the embodiments of security tag 100 as described with reference to FIGS. 1A and 1B. The embodiments, however, are not limited in this context as long as the detacher interface and tag interface are compatible.

Figure 7:
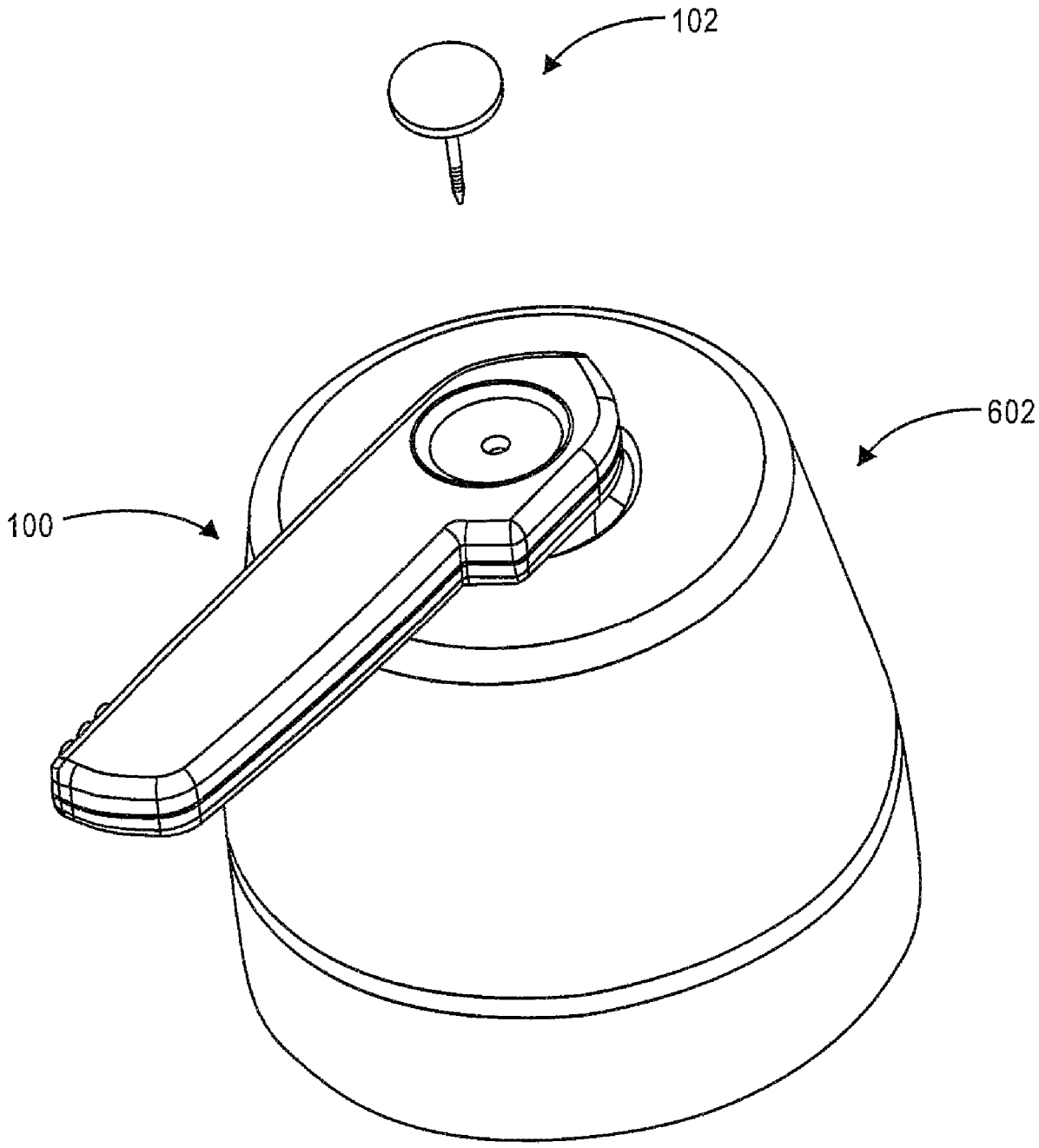
FIG. 7 illustrates a security tag inserted into a magnetic detaching device in accordance with one embodiment.

FIG. 7 illustrates a security tag inserted into a magnetic detaching device in accordance with one embodiment. FIG. 7 illustrates security tag 100 when placed within magnetic detaching device 602. More particularly, FIG. 7 illustrates security tag 100 and tack assembly 102 as seated within or on magnetic detaching device 602. This position may facilitate the detachment of tack assembly 102 from security tag 100.

Figure 12A:
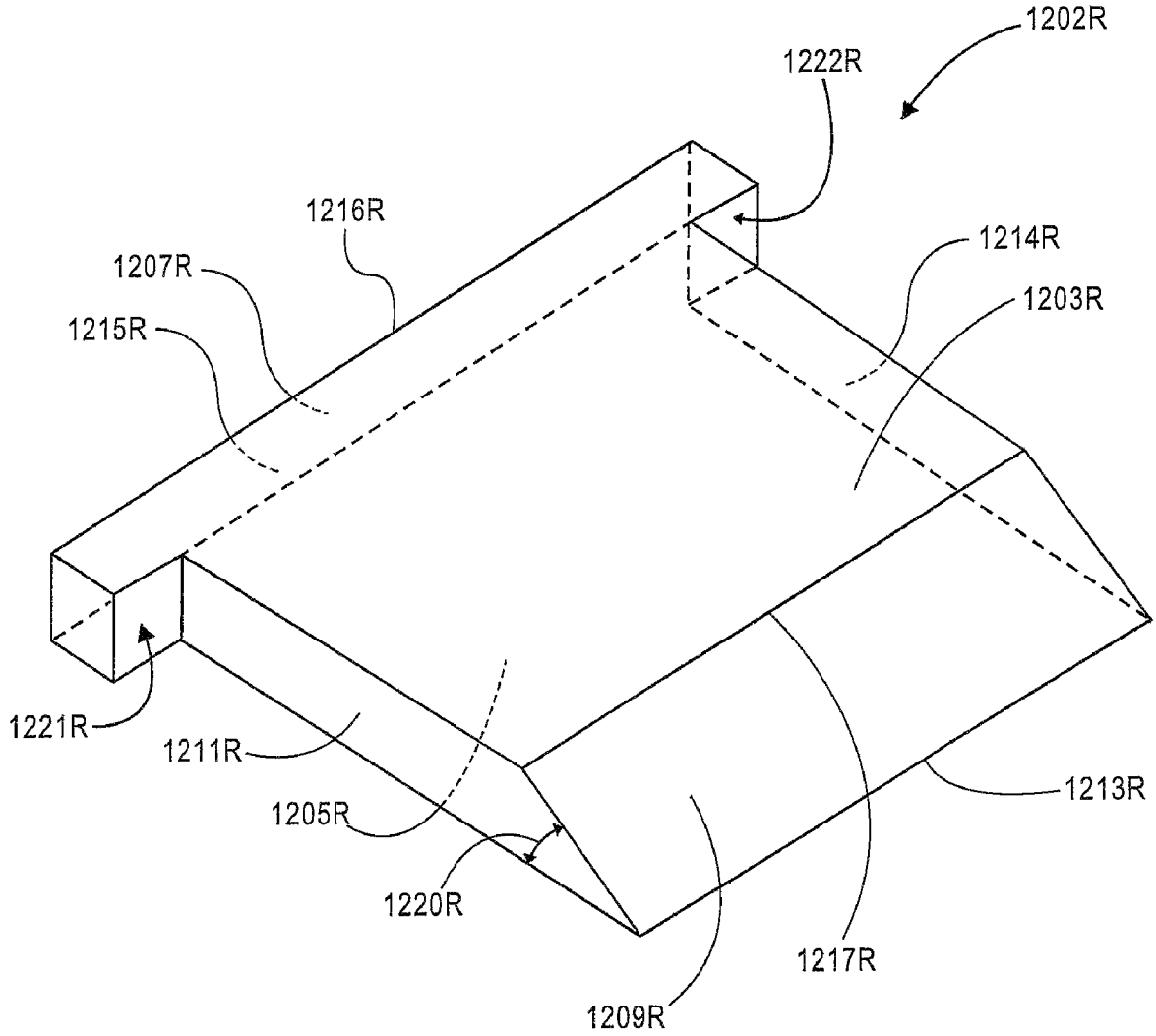
FIG. 12A illustrates a first view of a wedge for a security tag in accordance with one embodiment.
Figure 12B:
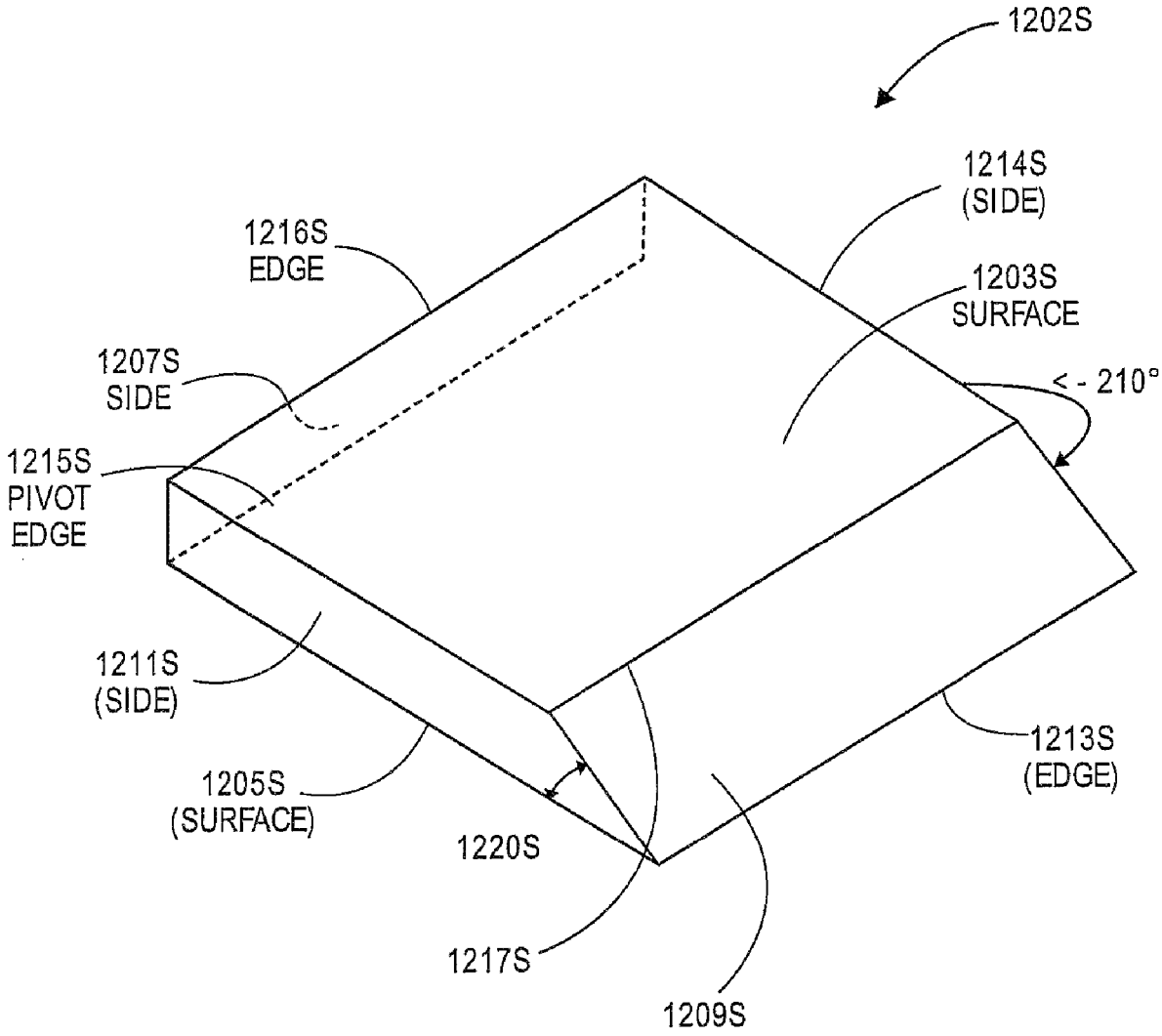
FIG. 12B illustrates a second view of a wedge for a security tag in accordance with one embodiment.

FIG. 8A illustrates an interior view of an upper housing for a security tag in accordance with one embodiment. FIG. 8A shows a detailed view of a wedge compartment 802 of upper housing 114, and in particular the wedge compartment 802 for a tack retaining system as arranged within end 130. This arrangement may be suitable for use in both a reusable or single-use security tag. One difference between the two implementations is the shape of the wedge. In a reusable security tag, the wedge 1202R may have axle protrusions 1221R and 1222R as shown in FIG. 12A, which are not necessarily present in the wedge 1202S used for a single-use security tag as shown in FIG. 12B. The use of an "R" suffix to the wedge designator numeral may refer to a tack retaining system suitable for use with a reusable security tag (e.g., 1202R, 1213R, and so forth). The use of an "S" suffix to the wedge designator numeral may refer to a tack retaining system suitable for use with a single-use security tag (e.g., 1202S, 1213S, and so forth). If no wedge designator numeral suffix is used (e.g. 1202, 1213, and so forth), the description may relate to one or both the reusable wedge 1202R and the single use wedge 1202S. The embodiments are not limited in this context.

As shown in FIG. 8A, wedge compartment 802 may comprise several internal walls. A tack shank hole 807 may comprise the space in which tack shank 106 can move and occupy along line 412, such as shown, e.g., in FIGS. 3-4. Tack shank hole 807 may extend through upper housing 114, beginning at aperture 120 and through a top wall 808A, entering wedge compartment 802 and partially through a front wall 803C to a top surface 814 of a protrusion 809.

The location of front wall 803C may vary in accordance with a desired implementation. For example, front wall 803C may be positioned more distant from back wall 803D than shown in FIG. 8A, where it is coincident with a wall 803T. As shown in FIG. 8A, wall 803C is approximately 0.016 inches closer to back wall 803D than is a wall 803T. Further, wall 803C has a semi-circular surface cut through to clear for tack shank hole 807. The portion of a tack shank bearing surface 803S most distant from back wall 803D may comprise bearing wall 803T. The semi-circular surface may provide several advantages, such as assisting to guide tack shank 106 when inserted, to provide a semi-circular bearing surface 803S for circular tack shank 106 which provides a slightly higher pullout force (Fpo) relative to having a flat bearing surface. The pullout force Fpo may refer to an amount of separation force between security tag 100 and tack assembly 102 that is needed to forcibly extract tack assembly 102 from security tag 100. There may be other factors to be considered in locating wall 803C, as discussed further below.

Figure 9A:
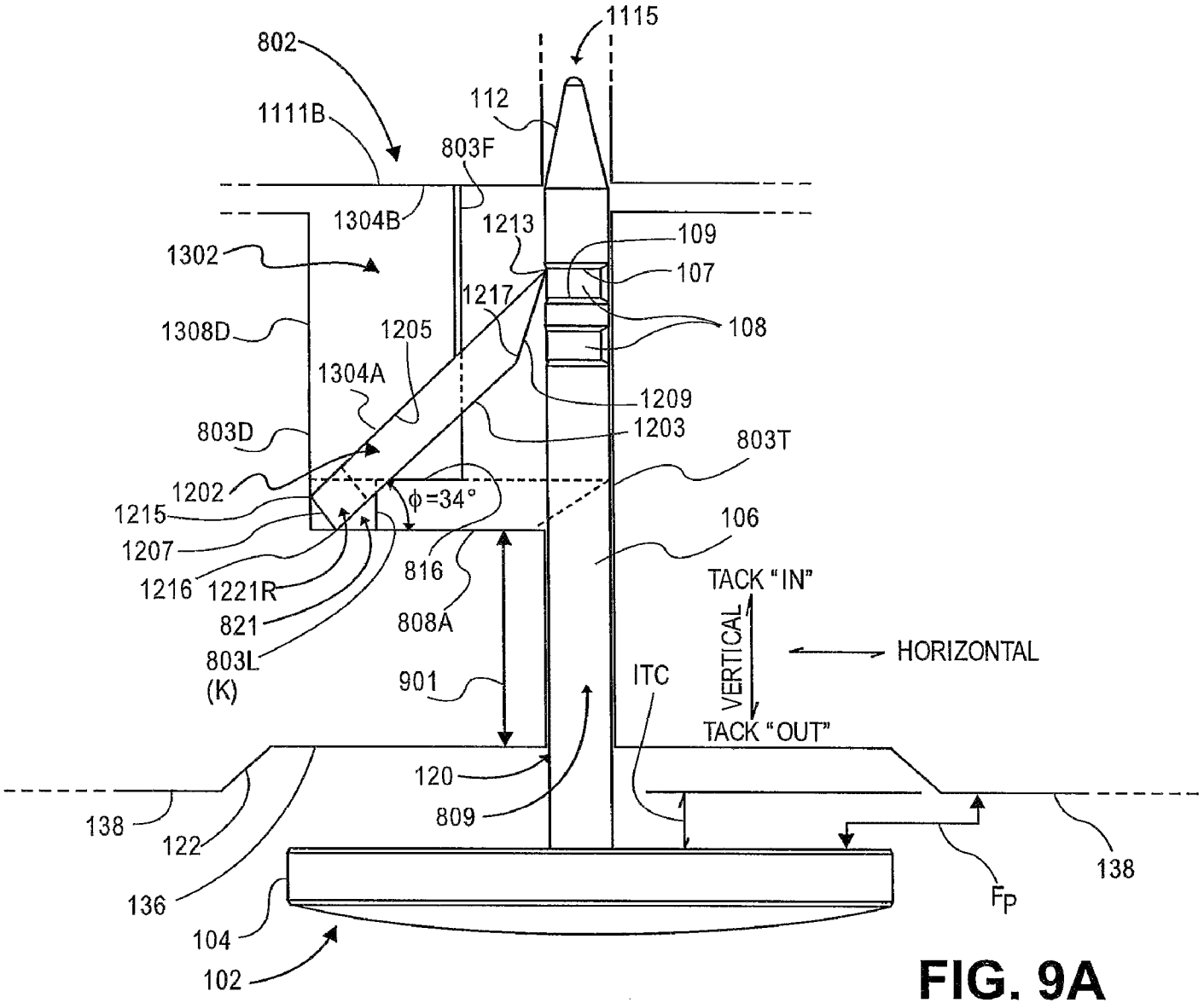
FIG. 9A illustrates the partial section A-A of FIG. 8D in accordance with one embodiment.

When lower housing 116 is joined to upper housing 114, tack shank hole 807 extends further into the lower housing shank hole 1115 where hole 807 terminates (see FIG. 4). When tack shank hole 807 is not occupied, surface 1203, such as shown in FIG. 9A described below, of a wedge 1202 may lay flat against top wall 808A with tack retaining edge 1213 touching or nearly touching front wall 803C. Wedge 1202 may fit in wedge compartment 802 closely but with sufficient clearance that wedge 1202 is free to pivot approximately about pivot edge 1215. For example, wedge side 1211, such as shown in FIGS. 12A-12B described below, is movably close to a side wall 803E, wedge side 1214 (also in FIGS. 12A-12B) is movably close to a side wall 803J, wedge pivot side 1207 (also in FIG. 12A-12B) is movably close or touching back wall 803D, and tack retaining edge 1213 (also in FIG. 12A-12B) is movably close to front wall 803C and covers most of tack hole 807. In a reusable security tag, wedge axle protrusions 1221R and 1222R may loosely reside in their respective recesses 821 and 822 so they can pivot without significant resistance.

Figure 8B:
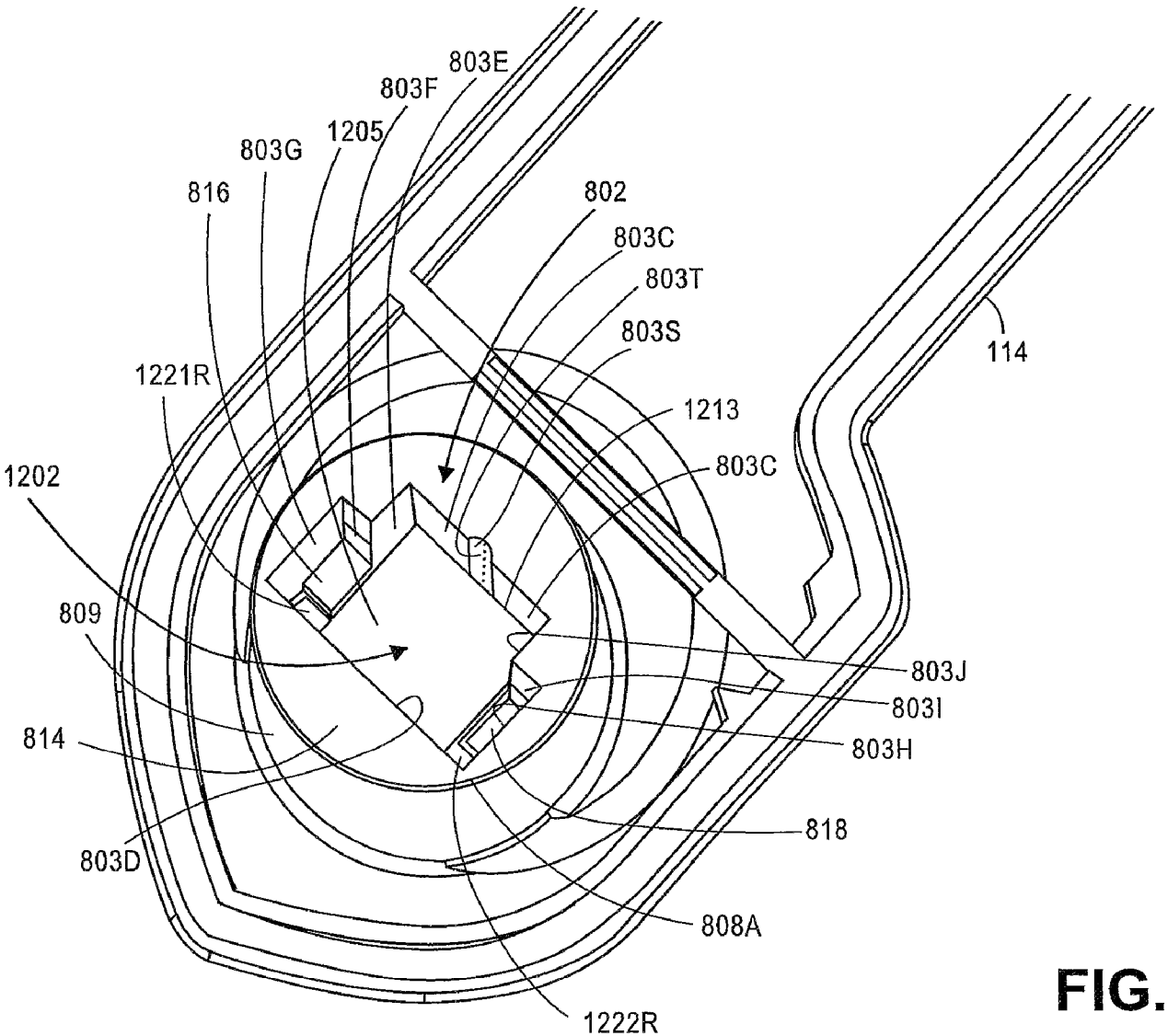
FIG. 8B illustrates an interior view of an upper housing with a wedge inserted for a security tag in accordance with one embodiment.

FIG. 8B illustrates an interior view of an upper housing with a wedge inserted for a security tag in accordance with one embodiment. FIG. 8B shows wedge 1202 as inserted into wedge compartment 802 and lying flat on top wall 808A. Once wedge 1202 is in place, rubber spring 1302 may be placed in its portion of wedge compartment 802. In a reusable security tag, protrusions 1221R and 1222R may be positioned in their respective recesses 821 and 822.

Figure 8C:
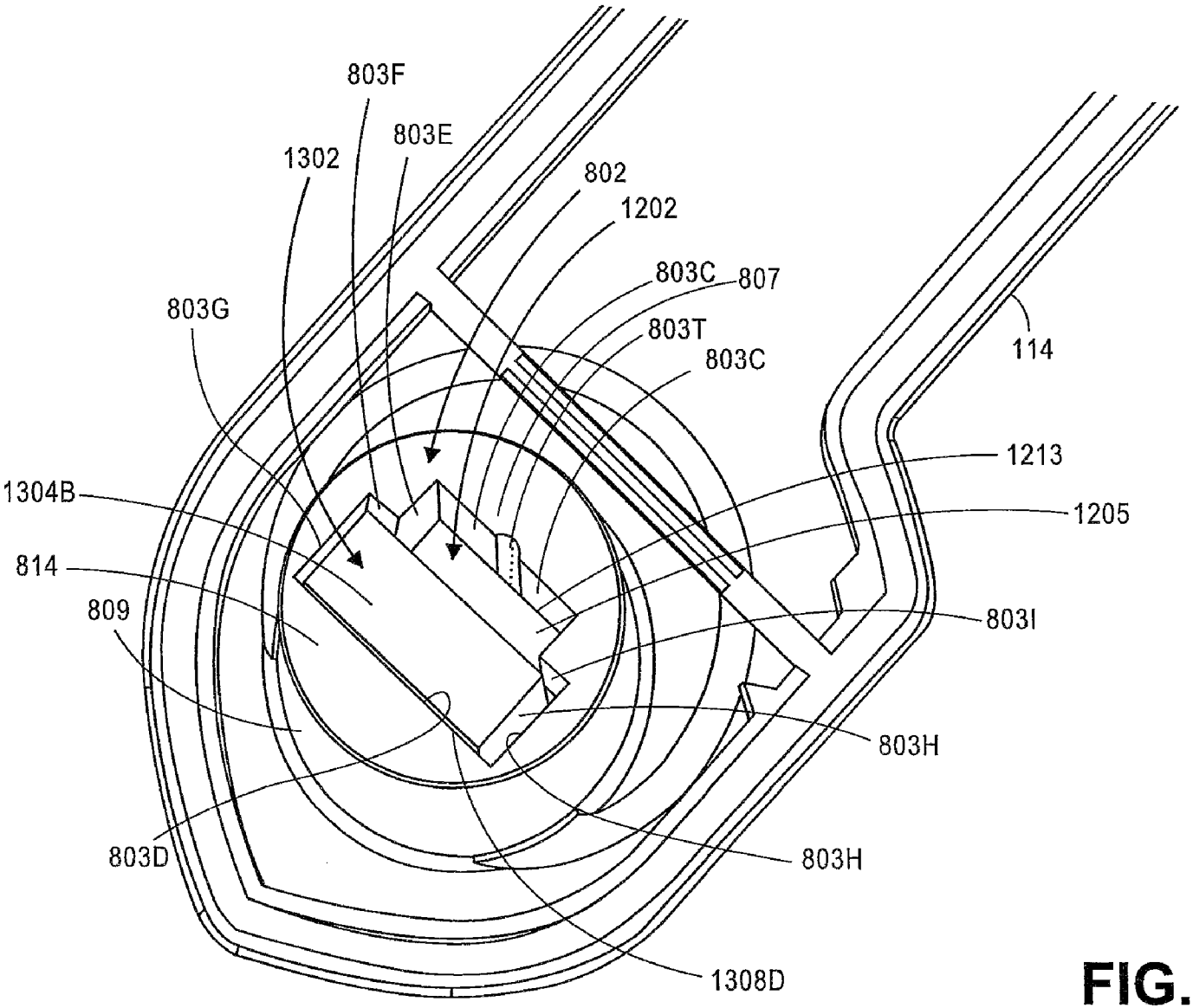
FIG. 8C illustrates an interior view of an upper housing with a wedge and rubber spring inserted for a security tag in accordance with one embodiment.

FIG. 8C illustrates an interior view of an upper housing with a wedge and rubber spring inserted for a security tag in accordance with one embodiment. FIG. 8C shows wedge 1202 and rubber spring 1302 as positioned within wedge compartment 802 in accordance with one embodiment. A side 1304A, such as shown in FIG. 9A described below, of rubber spring 1302 is inserted into wedge compartment 802, keeping rubber spring surface 1308D adjacent to back wall 803D. Rubber spring 1302 is further guided by pocket side walls 803F, 803G, 803H, and 8031, until rubber spring side 1304A rests on surface 1205 of wedge 1202. In one embodiment, the width of rubber spring 1302 may be greater than the width of wedge 1202, which fits closely in the extended portion of the wedge compartment 802 from sidewall 803G to sidewall 803H. In this manner, the location of rubber spring 1302 on wedge 1202 may be controlled. The embodiments are not limited in this context.

Controlling the location of rubber spring 1302 may assure that tags built in a production environment have a reproducible rubber spring bias on wedge 1202 for reliable and consistent detaching. The location of rubber spring 1302 may also reduce or prevent the effects of "slamming" in a single-use security tag. Slamming may refer to a user striking the bottom of protrusion 124 against a hard surface, which may cause a single-use security tag to attain a permanent unlock condition without the use of magnetic detaching device 602. This may occur since the bias of rubber spring 1302 is toward one end of wedge 1202S. The vertical force caused by slamming may operate on the center of gravity of wedge 1202S thereby causing wedge 1202S to twist or rotate under the force of the slam. The effects of slamming may be reduced or eliminated, however, by moving the bias of rubber spring 1302 to the center of gravity of wedge 1202S, as described with reference to FIG. 31. The embodiments are not limited in this context.

In one embodiment, the distance from wedge surface 1205 to bearing surface 1111B is less than the height of rubber spring 1302. Consequently, rubber spring 1302 may be compressed when upper housing 114 and lower housing 116 are joined to construct security tag 100. This may cause wedge 1202 to be biased against top wall 808A of wedge compartment 802. In a reusable security tag, this may also bias axle protrusions 1221R and 1222R into their respective recesses 821 and 822.

Figure 8D:
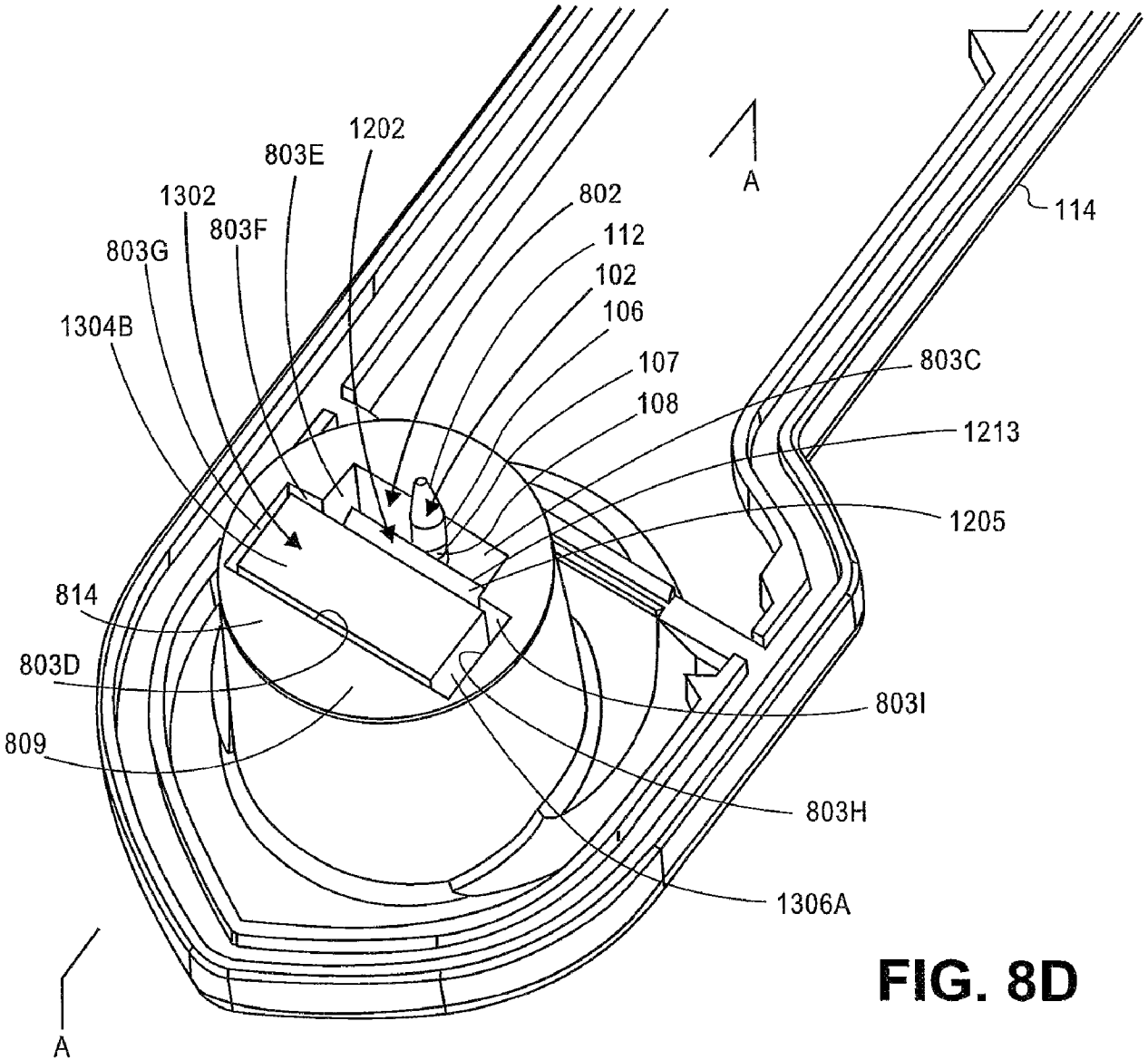
FIG. 8D illustrates an interior view of an upper housing with a wedge, rubber spring, and tack shank inserted for a security tag in accordance with one embodiment.

FIG. 8D illustrates an interior view of an upper housing with a wedge, rubber spring, and tack shank inserted for a security tag in accordance with one embodiment. FIG. 8D shows another view into wedge compartment 802. This view is depicted as though lower housing 116 is joined to upper housing 114 where lower housing 116 is transparent. Thus, wedge surface 1203 is biased against top wall 808A of wedge compartment 802, as it would be in a completed security tag 100.

FIG. 9A illustrates a partial section A-A of FIG. 8D in accordance with one embodiment. Axle protrusion 1221R is shown for reference. FIG. 9A may be used to assist in describing insertion operations of tack assembly 102 into security tag 100. As shown in FIG. 8D and FIG. 9A, pointed end 112 of tack shank 106 may be inserted into security tag 100 through aperture 120 and into tack hole 807. During insertion, pointed end 112 may contact inclined surface 1209 of wedge 1202 causing wedge 1202 to pivot counterclockwise approximately about wedge edge 1215 against the bias of rubber spring 1302 until tack shank 106 begins to slide by the tack retaining edge 1213 of wedge 1202. Further insertion may cause tack groove 108 and lip 107 of tack shank 106 to come adjacent to tack retaining edge 1213 which is then biased into tack groove 108 against lip 107 by rubber spring 1302. Accordingly, tack retaining edge 1213 may be positioned within tack groove 108, thereby preventing tack assembly 102 from being pulled out of security tag 100 unless the holding strength of the tack retaining system is overcome. In this position, tack assembly 102 may be fastened or locked to security tag 100, and the locked condition is attained. In one embodiment, for example, the wedge angle Ø may be approximately 34° when in the locked condition.

FIG. 9A also illustrates a feature concerning the detachment process of the reusable tack retaining system. FIG. 9A depicts the recess 821 in which protrusion 1221R resides, and not shown, but by symmetry recess 822 where protrusion 1222R resides. The depth of the recesses 821/822 is the vertical dimension of walls 803L/803K. During detachment, as the tag 100 approaches the detacher per FIG. 6, the wedge 1202R is urged to rotate counterclockwise about approximately edge 1215R. As the tag gets closer to seating in the detacher, the magnetic attractive force becomes stronger until wedge 1202R rotates enough for edge 1213R to clear lip 107 releasing the tack from the tag. The tag may become fully seated in the detacher (See FIG. 7) immediately after the tack is released. Typically, the tag is fully seated in the detacher, the tag being held in the detacher by the magnetic force attracting the wedge 1202R, and then the tack is removed from the tag. The tack retaining system may be designed such that when the tag is seated, a given magnetic strength "S" is just sufficient to release the tack (unlock condition), or the magnetic strength may exceed the value "S" by for example 25% and the tack retaining system will still release the tack. An operational problem may arise if the magnetic strength of the detacher far exceeds the value "S". The wedge may rotate further compressing the rubber spring 1302 to a point where the wedge approaches verticality and the edge 1213R of wedge 1202R is attracted to contact wall 1111B. This may cause protrusions 1221R and 1222R to be pulled out of their respective recesses 821 and 822, and the expanding rubber spring 1302 to push the protrusion portions of edge 1216R onto walls 816/818 which may constitute a permanent unlock condition. To remedy this condition, the dimensioning of the tack restraining system is such that walls 803L and 803K are sufficiently long vertically, and the wedge length is sufficient, that when edge 1213R contacts wall 1111B, the protrusions 1221R and 1222R cannot be pulled out of their respective recesses 821 and 822.

Referring again to FIG. 9A, one design constraint for a security tag may include the amount of pull force (Fp) needed to forcibly separate tack assembly 102 from security tag 100 without a detaching device 602. This force may be referred to as the "pullout force" (Fpo). For example, assume a pull force (Fp) in the "tack out" direction is applied to tack assembly 102 in an attempt to separate tack assembly 102 from surface 138 of security tag 100. This may occur when a person attempts to pull on cloth 202 and tack assembly 102 in a vertical direction away from security tag 100. Since groove lip 107 of tack groove 108 is engaged with tack retaining edge 1213, the vertical force pulls on tack retaining edge 1213 which attempts to pivot wedge 1202 clockwise about approximately edge 1215. Clockwise pivoting of wedge 1202, however, attempts to put the tack retaining edge 1213 within tack hole 807 while the tack shank 106 is still therein. Consequently, tack shank 106 may become wedged in security tag 100. This may sometimes be referred to herein as a "wedge effect." Wedge 1202 will retain tack assembly 102 in security tag 100 unless the tack holding strength of the tack retaining system is overcome (e.g., Fp>Fpo).

As shown in FIG. 9A, when tack assembly 102 is locked in security tag 100 where tack retaining edge 1213 is in contact with lip 107, there is a certain vertical distance between the bottom of tack head 104 and tag surface 138. This distance may be referred to as an "initial tack clearance" (ITC). Increasing Fp may cause some yielding and/or deforming of components of the tack retaining system, which results in "additional tack clearance" (ATC) adding to the initial tack clearance. If the components did not yield or deform, there would be no additional tack clearance. Additional tack clearance is typically not desirable because it may expose more of tack shank 106 to potential bending or cutting, thereby making security tag 100 more vulnerable and easier to defeat. There may be several design techniques to accommodate or reduce additional tack clearance, as described in more detail below.

Figure 9B:
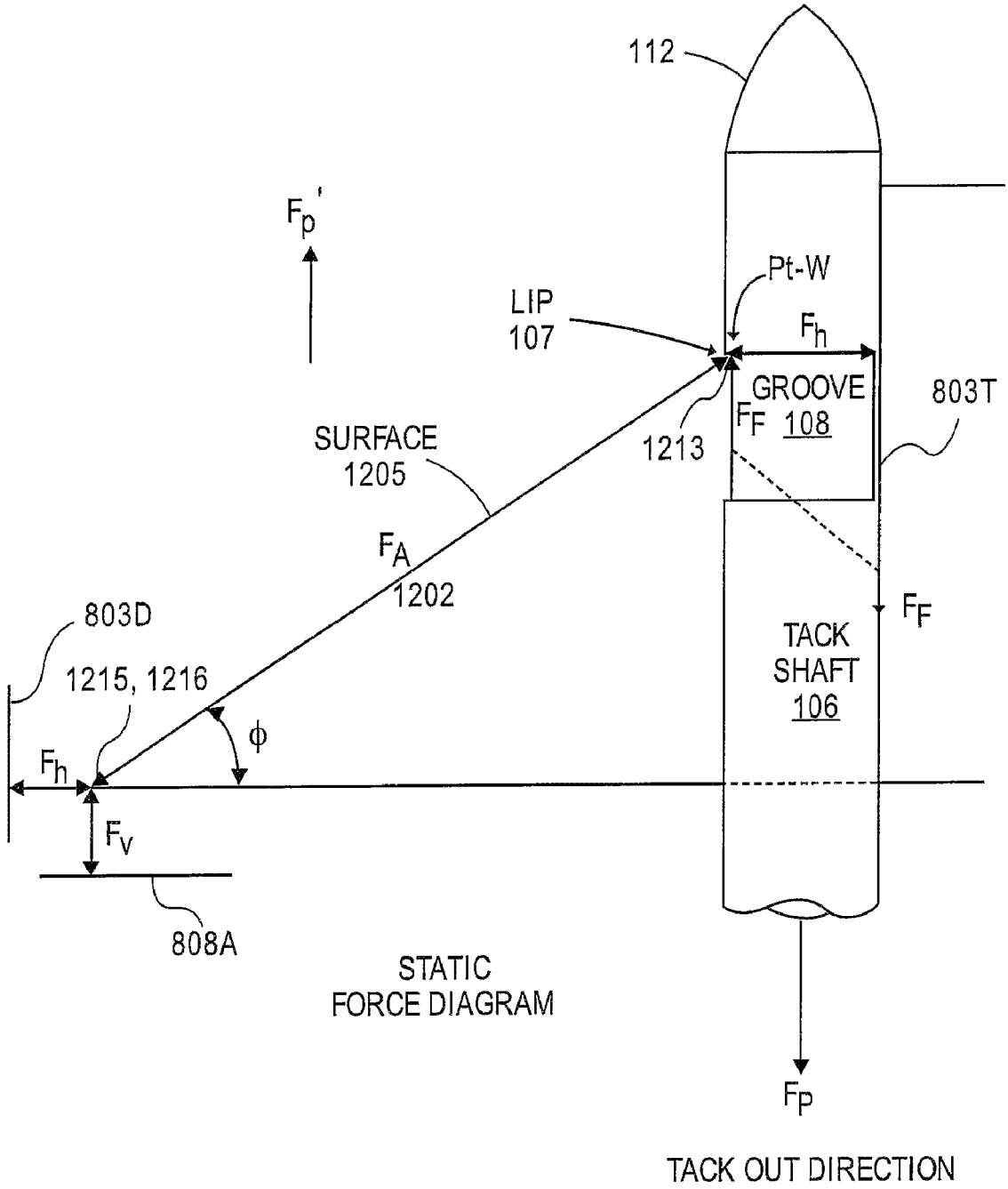
FIG. 9B illustrates a force diagram for components of FIG. 9A in accordance with one embodiment.

FIG. 9B illustrates a static force diagram for the tack retaining system components of FIG. 9A in accordance with one embodiment. In order for Fp not to pull tack assembly 102 out of security tag 100, there must be an equal but opposite force Fp' holding tack assembly 102 in security tag 100. This may describe a static or non-movement condition. If Fp becomes large enough to pull the tack out of the tag while in locked condition, that value of Fp is referred to as the pullout force Fpo as stated earlier.

In the static force diagram shown in FIG. 9B, Fp may refer to the applied pull force on tack assembly 102 from security tag 100, and Pt-W may refer to the point where tack retaining edge 1213 engages groove lip 107 in groove 108. Further, the static force diagram and derived static equations assume that all tack restraining system components do not yield or deform, including walls 803D, 808A, 803T, wedge 1202 and tack shank 106.

In accordance with static mechanics, the following equations may be derived:

$$Fp'=Fp=Fv+Ff;$$

$$Fv=Fa\times\sin ø;$$

$$Ff=\beta\times Fh;\text{ and}$$

$$Fh=Fa\times\cos ø.$$

wherein β may represent the static coefficient of friction between the tack shank and wall 803S/803T. For example, β may approximate 0.5 as determined by experimentation measured at 4 pounds (lbs) and 26 lbs of Fh. These equations may be rewritten in the following form:

$$Ff=\beta\times Fa\times\cos ø;$$

$$Fp=Fv+Ff=Fa\times\sin ø+\beta\times Fa\times\cos ø=Fa(\sin ø+\beta\times\cos ø);\text{ and}$$

$$Fa=Fp/(\sin ø+\beta\times\cos ø).$$

For a wedge angle ø of 34°, the following may be derived:

$$Fp'=Fp=Fv+Ff;$$

$$Fa=1.027\times Fp;$$

$$Fh=Fa\times\cos ø=0.851\times Fp;$$

$$Ff=\beta\times Fh=\beta\times Fa\times\cos ø=0.426\times Fp;\text{ and}$$

$$Fv=Fa\times\sin ø=0.574\times Fp.$$

Figure 10:
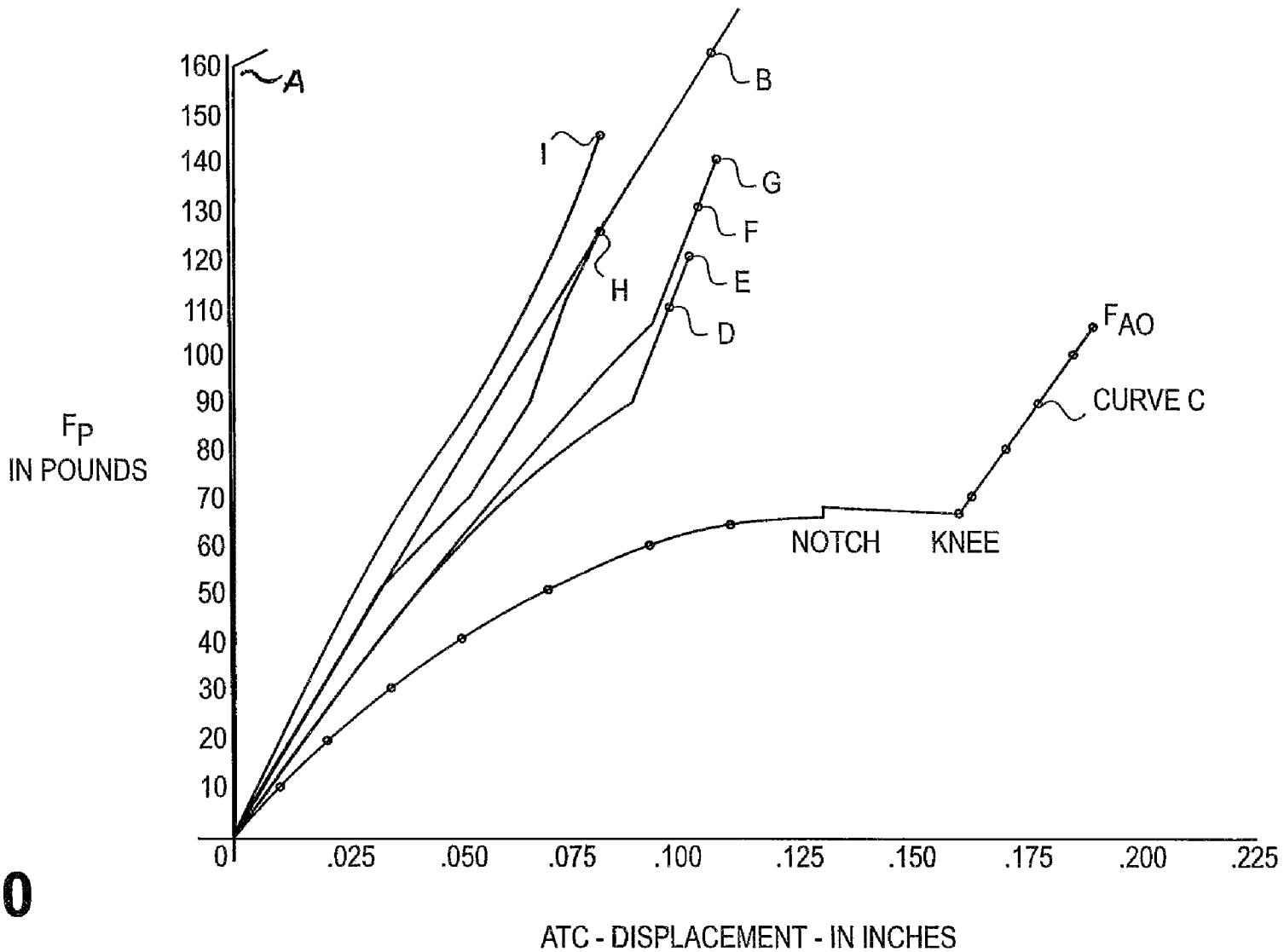
FIG. 10 illustrates a set of curves representing pullout force in accordance with several embodiments.

Based on these equations, Fp will always be countered by an Fp' that equals Fp, so increasing the value of Fp should cause no movement of tack assembly 102, that is no additional tack clearance (ATC) occurs. Curve A of FIG. 10 shows the relationship of additional tack clearance verses Fp for such ideal constraints. Tests for the embodiment shown in FIG. 8D have shown that as the pull force Fp continues higher there is a gradual yielding of the tack retaining system components until the tack assembly 102 is forcibly released from security tag 100. Curve C of FIG. 10 is an example of how additional tack clearance may occur as a result of tack restraining components gradually yielding under the strain of increasing Fp. By employing certain improvements to the embodiment of FIG. 8D yielding curve C, curves much closer to the ideal curve A may be attained, such as curves D, E, F, G, H, and I, as will be discussed below. Concerning the curves A and C of FIG. 10, the curves are relative in the information they provide. For example, if the Fp scale only went to 0.5 pounds instead of 160 lbs, curve A and curve C would look very much alike. Also, if the Fp scale went to a million pounds, Curve A and curve C would appear to release at approximately 0 lbs. The scales used herein may encompass values desired to protect merchandise against most human theft attempts on the retail floor. For example, the direct hand to hand pull force a person can generate is about 80 pounds. Therefore the Fpo of a security tag on a garment, where the direct pull of the tack from the tag is a possible defeat mode, should be at least 80 pounds. Generally, the higher the Fpo of a security tag the higher the perceived quality of the tag. Another factor of quality is the additional tack clearance produced by Fp; the less the better. Additional tack clearance affords a potential thief more of the tack shank (106) or tack head to attack with bending, prying, or cutting devices, for example. The amount of additional tack clearance for different security tags in the industry today, for any given Fp, varies greatly. Good performance of a tag embodiment concerning Fp and tack displacement would be one which yields a curve between curve A and curve B of FIG. 10. A good Fpo for a security tag may have a specification value of at least 125 pounds, for example.

As stated above, increasing Fp may cause no additional tack clearance under certain ideal constraints. For the configuration of FIG. 9A, these ideal constraints may include, but are not limited to, the following: (1) the distance from back wall 803D to tack bearing wall 803T does not increase; (2) the diameter of tack groove 108 does not decrease; (3) the wedge 1202 length from pivot edge 1215 to tack retaining edge 1213 does not decrease; (4) the thickness of wall 901 does not decrease; and (5) the vertical distance between surface 136 and surface 138 does not decrease. These ideal constraints are difficult to maintain in practical implementation, however, since all materials yield to some extent when force is applied to them.

The first constraint involves the distance from back wall 803D to tack bearing wall 803T. Applied pull force Fp may cause groove lip 107 to pull on tack retaining edge 1213 toward top wall 808A. This may urge wedge 1202 to pivot clockwise back to its pre-tack insertion position. With tack retaining edge 1213 engaged in groove 108 at lip 107, however, tack 108 prevents horizontal movement of edge 1213 into the solid metal of groove 108 so that wedge 1202 cannot pivot back to the pre-tack insertion position. This may create a jamming or wedging effect, wherein a vertical "tack out" motion of tack retaining edge 1213 cannot occur unless some horizontal motion of tack retaining edge 1213 into tack groove 108 occurs at the same time. As a result, Fp acting on tack retaining edge 1213 may cause a resultant horizontal force (Fh) on groove 108 that causes tack shank 106 to bear against tack bearing wall 803T (bearing surface 803S), and wedge pivot edge 1215 to bear against back wall 803D. A resultant vertical force (Fv) may cause wedge edge 1216 to bear against top wall 808A. Another resultant vertical force may be frictional force (Ff). The frictional force Ff may bear vertically on bearing wall 803T (bearing surface 803S). These walls are all part of the upper housing 114 which is typically a solid molded part made of a material such as ABS plastic. Alternatively, the part may be machined from a solid piece of the material. ABS plastic is resilient to some extent, but it may also deform permanently to some extent when force is applied. Thus under the stress of Fp, the wedge compartment wall 803D in contact with wedge 1202 and wedge compartment wall 803T/803S in contact with the tack shank 106 may yield somewhat thereby causing some additional tack clearance to occur.

The second constraint involves the diameter of tack groove 108. In one embodiment, for example, tack shank 106 may comprise a material such as steel. The steel shank may be sufficiently hardened to prevent it from deforming under force Fh as exerted by tack retaining edge 1213 on groove 108. For example, tack shank 106 may be implemented using steel hardened to a Rockwell Hardness of approximately RC 48. The yield of the tack groove 108 is thus is negligible, provided that the tack retaining edge 1213 is sufficiently softer than RC 48, for example RC 40. If the hardness of the tack shank 106/groove 108 is sufficiently softer than edge 1213, more yield and thus more additional tack clearance is expected from this source. This may include extruding of the tack shank 106 at lip 107, and/or cutting of the shank 106 at groove 108.

The third constraint involves the wedge 1202 length Lw from pivot edge 1215 to tack retaining edge 1213. Some embodiments may have a wedge hardness of approximately RC 40, and a harder tack having a hardness of approximately RC48. Further, in some embodiments, the angle of tack retaining edge 1213 may comprise approximately 30° (1220) with a tip end radius of no more than 0.002" to fit well within the intersection of tack groove 108 and tack lip 107. The intersection of the lip 107 and the groove 108 is about 90° with an internal radius of no more than 0.002", and is defined as tack contact point Pt-W per FIG. 9B. Dimensions are not limited in this context, but the tack retaining edge 1213 must fit compatibly into Pt-W. Under the influence of applied Fp and the resultant force component Fh, the portion of the tack retaining edge 1213 in contact with the tack at Pt-W may deform. The typically softer tack retaining edge 1213 is forced onto/into the typically harder tack contact point Pt-W, and as Fp increases, edge 1213 forms around and into Pt-W taking the inverse shape of the Pt-W contact area of the tack. The result is that a concave semi-circular ledge is formed in the tack retaining edge 1213 that conforms to and mates with up to ½ of tack lip 107, and around part of groove 108 and part of the shank 106 in the contact area. Essentially, with proper hardness and relative hardness of the wedge and tack shank, a form fitted seat for the tack lip 107 may be created. The size and depth of the semi-circular ledge (seat) is dependent upon the maximum Fp imposed as well as the hardness values selected for the wedge and for the tack. The more Fp applied, the larger the form fitted seat that is created (up to ½ of tack lip 107), and typically the larger the retaining strength of the tack retaining system. If wedge 1202 is made of a much harder material such as RC 58, tack retaining edge 1213 may not form about the contact area. Rather, the RC 58 wedge 1202 under the influence of Fv may shear off a softer tack (RC 48) at Pt-W. If the wedge and thus edge 1213 hardness is RC 30, the semi-circular ledge may form but potentially strip out or extrude under low values of Fp because edge 1213 is too soft. If the wedge hardness is about RC 48 and the tack hardness is about RC 40, the semi-circular ledge will form to some extent but the tack may partially extrude with increasing Fp. Hardness and relative hardness of the wedge 1202 and tack shank 106 may be of different values and the tag/tack will function normally up to an Fp of about 15 pounds, but the Fp/additional tack clearance curves may vary greatly. In one embodiment, a balanced result may be achieved at a wedge hardness of RC 40 and a tack hardness of RC 48. Other hardness's may produce desired balanced results, and the values are not limited in this context. Thus the wedge length Lw may be reduced by the depth of the formed semi-circular ledge and cause some permanent additional tack clearance.

The fourth constraint involves the thickness of wall 901. Compression of typically solid plastic wall 901 is relatively minor for values of Fp of up to >200 pounds and thus adds negligibly to the additional tack clearance. Edge 1216 may be forced against wall 808A by a portion of a resultant force Fv, but the effect on additional tack clearance is relatively minor and may disappear completely when the wedge angle is 0°. Compression of wall 901 under the net separation force Fp may not be significant compared to the net additional tack clearance.

The fifth constraint involves the vertical distance between surface 136 and surface 138. The distance between surface 136 and surface 138 may tend to decrease slightly since the separation force Fp is between the entire surface 138 and the entire under side of tack head 104, and further, tack shank 106 is engaged with the plastic walls under surface 136 (e.g., 808A and 803S). Because surfaces 136 and 138 are offset at rampart 122, the housing may tend to yield resiliently and/or deform at the offset, and surfaces 136 and 138 may tend to be drawn together under the force Fp. Proper design of wall thicknesses and diameter of rampart 122 may prevent this issue from adding any significant amount of additional tack clearance for Fp values of well over 100 pounds compared to the net additional tack clearance. If there was no rampart 122, this issue would not exist.

Figure 9C:
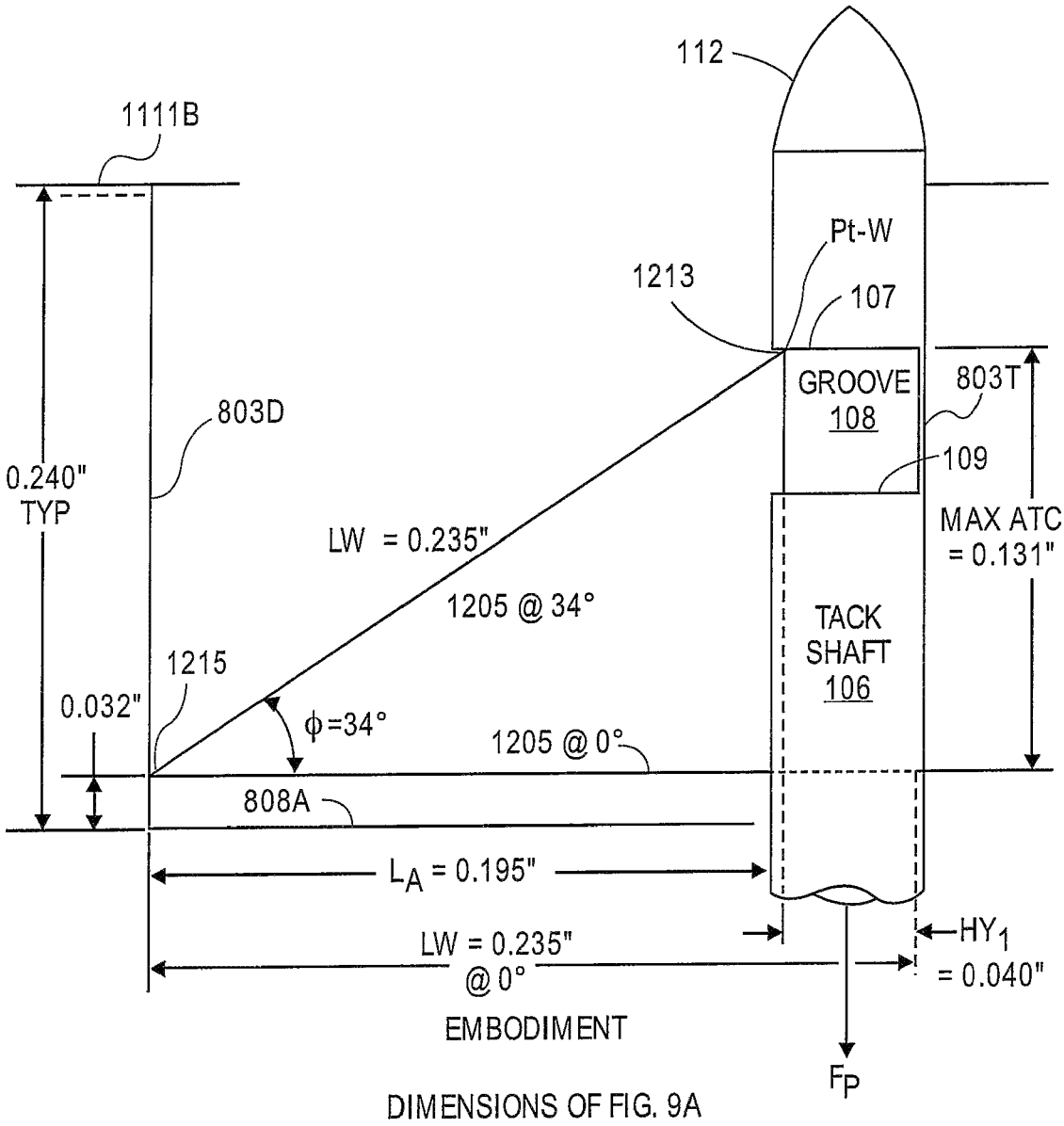
FIG. 9C illustrates a dimensional diagram for components of FIG. 9A in accordance with one embodiment.

FIG. 9C illustrates a dimensional diagram for components of FIG. 9A in accordance with one embodiment. FIG. 9C shows the dimensions and initial conditions with security tag 100 and tack assembly 102 in a locked condition and with a small value of Fp applied just sufficient to cause tack retaining edge 1213 is engaged with lip 107. More particularly, FIG. 9C may show various dimensions of wedge compartment 802, such as the length (Lw) of wedge 1202 from edge 1215 to Pt-W that is inside tack groove 108 under groove lip 107, and the horizontal length (La) from back wall 803D to a point directly below Pt-W, which is set to 0.195 inches by design for the embodiment of FIGS. 8D and 9A. From these given dimensions, the wedge angle Ø is calculated to be 34°, and the additional tack clearance possible is 0.131 inches, barring an over rotation issue to be explained further below. It is worthy to note that the additional tack clearance dimension of 0.131 inches corresponds substantially with the notch of curve C in FIG. 10. Wedge 1202 may need to lie flat on wall 808A for the additional tack clearance of 0.131 inches to be realized. Correspondingly, wedge 1202 should pivot approximately about edge 1215 from Ø =34° to Ø =0°. This means that the Lw of 0.235 inches lies flat in a length of La set to 0.195 inches. This is a dichotomous condition unless some constraints yield. In fact, under an applied Fp of 65 pounds, the wedge does lie flat on wall 808A in the embodiment of FIG. 8D. At an Fp of 65 pounds, semi-circular ledge having a depth of approximately 0.020 inches forms in tack retaining edge 1213 about tack groove 108, groove lip 107, and tack shank 106. This means the Lw reduces from 0.235 inches to 0.215 inches. At the Fp of 65 pounds, a depression of about 0.010 inches develops in wall 803T (803S), and further, wall 803D develops a depression of about 0.010 inches made by edge 1215 and wedge surface 1207. Consequently, dimension La increases from 0.195 inches to 0.215 inches. Accordingly, wedge 1202 fits flat on wall 808A where Fp is equal to 65 pounds due to the net yield of tack retaining edge 1213, walls 803T (803S), and back wall 803D.

The aggregate yield of all the tack retaining system components is incremental with each increment of force Fp applied. Thus, a first increment of Fp from 0 will cause a first increment of additional tack clearance. For example, when Fp increases from 0 to five pounds, the tack clearance may increase from 0 to 0.0033 inches, and so forth. This would produce the linear curve B of FIG. 10. This curve rate of 1500 pounds/inch approximates the curve of some conventional security tags. The increment of additional tack clearance, however, typically becomes larger per the same increment of Fp as Fp becomes larger. Curve C of FIG. 10 may illustrate this non-linearity.

By attempting to forcefully separate tack assembly 102 from tag 100, one or more of the tack retaining system components may yield slightly and cause some additional tack clearance. There are typically two types of yield, referred to as "resilient" and "permanent." The yields of the metal elements (e.g., metal tack and/or metal wedge) as previously discussed are almost totally permanent. The metals may permanently deform and therefore the yield contribution to additional tack clearance becomes permanent. The yields of the plastic elements, however, may have both resilient and permanent components. Some of the yielding by the plastic elements contributing to the additional tack clearance may be recoverable when Fp is removed, while some is not. The net additional tack clearance for a given pull force Fp will therefore have a permanent component and a recovered component. For example, for a pull force Fp of 50 pounds that is less than or equal to the Fpo, the additional tack clearance may comprise approximately 0.040 inches. When Fp is removed, however, the additional tack clearance may revert to 0.020 inches. This means that there is a permanent additional tack clearance of 0.020 inches, and a resilient (recoverable) additional tack clearance of 0.020 inches. A second applied Fp should not cause further permanent additional tack clearance unless the second Fp is greater than the first Fp. Typically, the largest normal usage Fp is less than 20 pounds, and the permanent additional tack clearance is less than 0.007 inches. When added to the initial tack clearance of typically 0.040 inches, the permanent additional tack clearance is not significant. Experiments have shown that some embodiments may have a permanent additional tack clearance of between 25-80% of the net additional tack clearance, dependent upon the Fp applied.

The resulting relationship of the additional tack clearance as a function of the applied force Fp is presented as curve C of FIG. 10. It is worthy to note that curve C lies well outside the desired area between curve A and curve B. At an applied force Fp of approximately 65 pounds, the additional tack clearance may comprise 0.131 inches corresponding to the notch in curve C. The additional tack clearance from the notch to the knee in curve C is a result of a slight increase in Fp causing the tack to move as much as an additional 0.032 inches beyond where the wedge angle is 0°. This occurs because after the wedge rotates clockwise to 0° about approximately edge 1215, it may further rotate clockwise about edge 1217 when it contacts wall 808A until wedge surface 1209 lies flat on wall 808A. This rotation about edge 1217 is referred to herein as "over rotation." The resultant additional downward movement of edge 1213, in contact with lip 107, is the additional tack clearance of up to 0.032 inches between the notch and knee of curve C. As this occurs, edge 1215 moves vertically scraping wall 808D which may offer some resistance to over rotation. The portion of curve C from 65 pounds at the knee to 105 pounds at Fpo is a result of groove 108 and lip 107 being forced through the opening between the semi-circular ledge formed on wedge tack retaining edge 1213 and surface 803S when the wedge angle is at 0° or less due to over rotation. When the wedge angle is at about 0°, the semi-circular ledge in tack retaining edge 1213 may be fully formed around one side of tack groove 108 and under lip 107 and the opposite side of tack groove 108 and lip 107 may be pressed into and somewhat deform surface 803S. Thus, in order for the tack shank 106 to be pulled through the "groove 108 size" opening, the opening must be forcibly enlarged. In the embodiment described with reference to FIGS. 8D, 9A, 9B, and 9C, the pull force Fp required to pull tack shank 106 through the "groove 108 size" opening may therefore equal approximately 105 pounds (release point of curve C). The process of pulling tack shank 106, groove 108 and groove lip 107 through the "groove 108 size" opening may include extruding some or all the semi-circular ledge from tack retaining edge 1213, extruding some or all of surface 803S, extruding some or all of groove lip 107, or causing the plastic walls in contact with wedge 1202 to yield further. The net yield from the knee to Fpo is additional tack clearance of about 0.030 inches as shown in curve C of FIG. 10.

Although the embodiment described with reference to FIGS. 8A, 8B, 8C, 8D, 9A, 9B, 9C, and curve C of FIG. 10 may be used in an EAS security system, the embodiment may have some characteristics that can be improved upon. These characteristics may include: (1) curve C of FIG. 10 is outside of the desired area between curve A and curve B; (2) the Fpo is not more that the desired 125 pounds; (3) wedge 1202 and tack 100 may become substantially jammed and cannot be detached with the detacher of FIG. 6 when Fp pulls the wedge 1202 to about 250 or lower, which is primarily a function of a frictional force Ff' described below; (4) after more than a certain value of Fp is applied and then removed, and the tag is "un-jammed", the wedge will not re-catch the tack groove lip 107; (5) over rotation causes additional tack clearance after the wedge 1202 angle has reached 0°; (6) the single use configuration may be manipulated to the permanent unlock condition with a magnetic detacher weaker than at least strength "S".

To detach the tack 100 from the tag 102, the wedge 1202 must be in a "free condition," which may refer to freely rotating under the influence of the detacher of FIG. 6. The garment being protected may offer a small resistance to the wedge attaining the free condition. For example, the garment being protected may fit snugly between the tack head and tag (see FIG. 3) providing a small "tack out" pressure on the tack causing tack retaining edge 1213 to be held in the groove 108 at lip 107 such that the detacher of FIG. 6 may not readily release the tack retaining system. A slight "tack in" finger pressure (Fi) on the tack head will cause the tack to move 0.003" to 0.004" which is sufficient to release the wedge to the free condition, allowing wedge edge 1213 to be rotated to the unlock position when the tag is positioned on the detacher per FIG. 7. Requiring a small Fi on the tack head to detach the tack from the tag is characteristic of virtually all magnetically releasable ball clutches used on security tags today and it is seldom if ever a problem. This "tack out" pressure provided by the garment is herein referred to as "garment pressure".

When in the free condition, the only tack retaining system restraint on the wedge 1202 to keep it from rotating is the bias of the rubber spring 1302, which can be overcome by the detacher of FIG. 6 to release the tack. A jammed wedge 1202 can be forced to the free condition by pushing on the tack head, thus pushing the tack shank 106 into the tag 102 by hand. The push in force (Fi) required depends on more than one factor, but primarily upon the amount of Fp applied. At a wedge angle of about 34°, the wedge may be in the free condition. As Fp is applied the wedge angle reduces as the plastic walls and the wedge resiliently yield and/or deform. From the previously derived equations, the frictional force Ff ($Ff=Fp\times\beta\times\cos Ø\ /\sin Ø\ +\beta\times\cos Ø$) resists any movement of the tack, and the vertical force Fv ($Fv=Fp\times\sin Ø\ /\sin Ø\ +\beta\times\cos Ø$) strains to hold the tack in the tag. These forces are effectively in the "tack in" direction opposing the Fp applied. At some point the Fp is removed. The resilient portion of the net yield now attempts to recover. This recovery force Fh' is primarily horizontal (plastic recovering back towards its original pre-pull position) and applies resultant forces on the wedge and tack. A new Ff' ($Ff'=Fh'\times\beta$) now exists resisting any movement of the tack. A new Fv' ($Fv'=Fh'\times\tan Ø$) now exists in the "tack in" direction. If Fv' is larger than Ff', the net force is in the "tack in" direction and the tack and wedge will move to the free condition without requiring any hand push in force (Fi) on the tack head. If Ff " is larger than Fv', the net force does not allow movement of the tack and wedge and the tack retaining system will not move to the free condition automatically but will require some amount of Fi on the tack head to attain the free condition (e.g., un-jam the tack). Tests have shown that, for example, no hand push Fi on the tack is required to attain free condition after an Fp of about 15 lbs has been applied and then removed. After an Fp of 20 pounds, the Fi required to attain the free condition is about 5 pounds. After an Fp of 40 to 50 lbs, a Fi of about 15 lbs is required (wedge angle of about 20°) to attain free condition. After an Fp of 65 lbs (wedge angle=0°), a Fi of about 35 lbs is required to attain free condition.

Thus it can be appreciated that the frictional force Ff' between tack shank 106 and surface 803S/wall 808T may not always allow wedge 1202 and tack assembly 102 to automatically retreat to the free condition. Rather, the frictional force Ff' may need to be overcome by a force Fi on the tack head to put wedge 1202 in the free condition. The particular amount of Fi required to cause the tack retaining system to reach the free condition may vary with the Fp applied and corresponding wedge angle Ø attained, and to some extent the slope and shape of lip 109. Other factors could involve the time elapsed between Fp and Fi applied, and the difference in temperature when Fp and Fi are applied. Thus a desirable characteristic is to have little or no Fi required when in normal use where Fp could reach 20 to 30 lbs or when even more Fp is applied (e.g., Fi required should be minimized).

The discussion of the jamming characteristic (3) above describes typical results for the subject embodiment of FIGS. 8D and 9A, where the housings 114 and 116 are made of ABS plastic, the tack shank 106 has two circular grooves 108 about tack shank 106 that are approximately 0.040 inches long and spaced about 0.040 inches apart, the tack shank hardness is approximately RC 40, the wedge hardness is approximately RC 45, the surface of the grooves 108 are parallel to the surface of shank 106 and 0.003"/0.004" deep, both groove lips 107 and 109 are at an angle of 90° with respect to the shank 106 surface, and the first groove lip 107 is about 0.12 inches from the point.

In some embodiments, for example, it may be desirable to limit the wedge angle to approximately 15°or higher. When the semi-circular ledge is formed by wedge angles of about 15° or less, and then tack assembly is pushed back to the free condition by Fi, the semi-circular ledge may not "re-catch" groove lip 107, thus the tack could easily be removed from the tag by hand. This would be an easy form of defeat if an unauthorized user could pull on tack assembly 102 with sufficient force to cause the wedge angle to reach about 15° or less. One reason that this problem can occur is that the formed face of wedge tack restraining edge 1213 can have a length of about 0.011 inches under the semi-circular ledge. When tack assembly 102 is pushed back into security tag 100, the yield of the plastic recovers somewhat so the angle that the formed end of the semi-circular ledge engages tack groove 108 is different than when it was formed. The depth of groove lip 107 is about 0.003 inches. This means that the wedge angle cannot be less than arctan 0.003/0.011=15°. The value can be different for different hardness values of tack assembly 102 and wedge 1202, and different amounts of plastic yield recovery.

In some embodiments, for example, it may be desirable to prevent wedge 1202 from pivoting beyond 0°. When wedge 1202 rotates clockwise from 34 ° to 0° it is flat on top wall 808A as is wedge edge 1217. Additional Fp may be sufficient to cause wedge 1202 to rotate further clockwise about edge 1217. As a result, wedge 1202 may pivot clockwise further about edge 1217, causing edge 1215 to then move primarily vertically and scrape back wall 803D. Once the pivoting about edge 1217 begins, the semi-circular ledge of edge 1213 may move down as much as the thickness of the wedge 1202 and away slightly from tack lip 107/groove 108, causing the gripping pressure on the tack groove 108 to be reduced and thus less extrusion of the semi-circular ledge of edge 1213 and wall 808S required to reach pullout. Pivoting about edge 1217 may cause the tack retaining system to have as much as 0.032 inches more additional tack clearance and a lower pullout force. Curve C of FIG. 10 shows this additional tack clearance as the distance between the notch and the knee. If the wedge angle was limited to for example 15° or higher, and/or if the wedge surface 901 was completely supported, no pivoting about edge 1217 could occur and Fpo would not be affected.

Referring again to FIGS. 8D, 9A, and 9I, FIG. 9I illustrates a partial section A-A of FIG. 8D in accordance with one single-use embodiment. FIG. 9I may aid in describing the ratcheting effect in a single-use tack retaining system. A potentially undesirable characteristic of the embodiment of FIG. 8D and FIG. 9I is that the single use tack retaining system is subject to possible defeat by tack manipulation. Assume the configuration of FIG. 9A as a reusable (R) tack retaining system only. The wedge 1202R is constrained to rotational movement about the axle protrusions 1221R and 1222R. When the tag 100 is placed in the magnetic detacher of at least sufficient strength "S", the wedge rotates enough (possibly requiring a slight push down on the tack head to counteract garment pressure) against the bias of rubber spring 1302 so that tack retaining edge 1213R clears lip 107 and the tack 102 can be withdrawn from the tag 100. When the tag is removed from the magnetic detacher, it reverts to the rest condition.

In the single use configuration of FIG. 9I, the desire is to release the tack assembly 102 from the tag 100 by placing the tag 100 onto a magnetic detacher of at least sufficient strength "S". The wedge 1202S rotates and edge 1216S translates enough (possibly requiring a slight push down on the tack head to counteract garment pressure) against the bias of rubber spring 1302 so that tack retaining edge 1213S clears lip 107, the wedge 1202S rotates to be parallel with tack shank 106, and the tack 102 can be withdrawn from the tag 100 (the tag went from lock condition to permanent unlock condition). When the tag is removed from the magnetic detacher, it stays in the unlocked condition permanently.

One difference between the reusable configuration and the single use configuration is the translational movement of the wedge 1202S required to attain the permanent unlock condition. As can be seen in FIG. 9I, the wedge edge 1216S is not restrained from moving to the right except for the frictional force at the contact point where edge 1216S rests on wall 808A. This frictional force is dependent upon the vertical component of the compression force bias of rubber spring 1302 and a related coefficient of friction ω. Further, there is a horizontal component of the compression force of rubber spring 1302 which tends to push the wedge edge 1216S to the right from its first position, which may cause the edge 1216S to move to the right until the frictional force and the horizontal component of force are equal. If the tack is pushed in beyond the lock condition so groove 108 slides on edge 1213S and then further so lip 109 pushes edge 1213S to the left by the depth of the groove 108, the edge 1216S may move slightly to the right to a second position. At this point, if the tack is pulled in the "tack out" direction, edge 1213S will catch in lip 107 and further pulling may drive the edge 1216S back to a point where edge 1215S contacts wall 808D as shown in FIG. 9I. If the tack is pulled so that edge 1213S just falls back in groove 108, however, the edge 1213S may remain in the second position. The result is that edge 1213S has been moved to the right slightly by manipulating the tack. If the tag is placed on a detaching magnet of less strength than "S", and this simple push-pull manipulation of the tack is repeated causing edge 1213S to be lifted and lowered over lip 109, the magnetic bias of the lesser magnet may allow the edge 1216S to be "ratcheted" to the right until the wedge 1202S is advanced to the permanent unlock condition. Ratcheting is thus a form of defeat similar to "slamming" and should be corrected.

It is worthy to note that before the tack is inserted, wedge 1202S surface 1203S lies flat on wall 808A, biased to wall 808A by the compression force of rubber spring 1302. When the tack is inserted to the point where the wedge is at approximately 34°, edge 1215S may be slightly to the right of wall 808D due to the relative vertical and horizontal components of the rubber spring compression force on the wedge 1202S. If this condition exists, the first position of edge 1216S may not be when edge 1215S is touching wall 808D as is shown in FIG. 9I, but slightly to the right.

One aspect of this issue is that there may be an instability of the position of the wedge 1202S because edge 1216 may be moved along horizontal surface 808A by manipulating the tack thereby making it possible attain the permanent unlock condition by using a detacher of less strength than the proper detacher of at least strength "S".

Figure 9D:
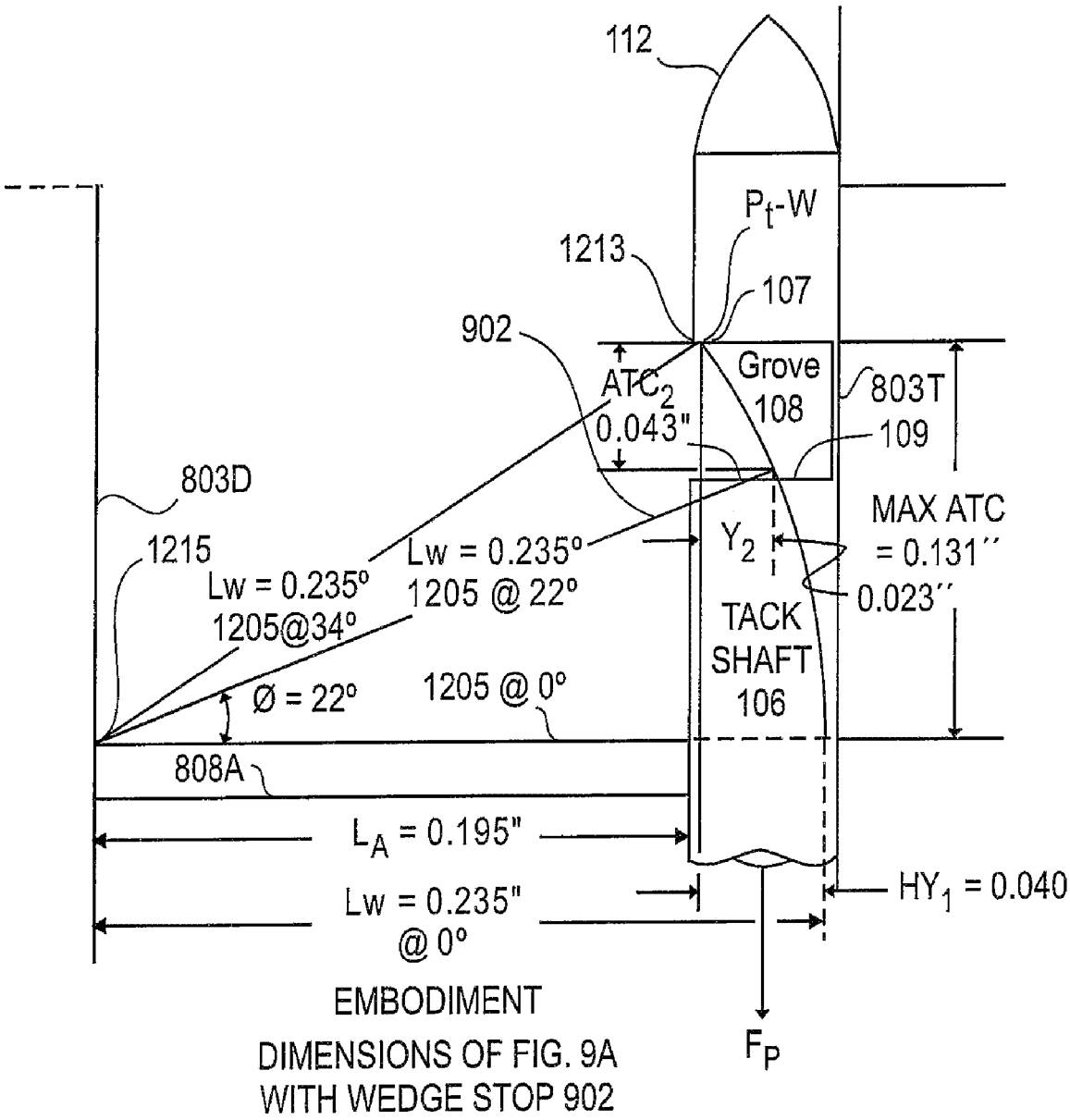
FIG. 9D illustrates a second dimensional diagram for components of FIG. 9A in accordance with one embodiment.

FIG. 9D illustrates a second dimensional diagram for components of FIG. 9A in accordance with one embodiment. FIG. 9D may be useful in describing a first of several possible modifications that have been implemented to improve the operation of the embodiment shown in FIGS. 8A, 8B, 8C, 8D, 9A, 9B, 9C, 9I, and curve C of FIG. 10. For example, to eliminate the re-catch characteristic (4) and the over rotation characteristic (5) which depend on the wedge 1202 attaining angles of 15° or less, and greatly improve the jamming characteristic (3), a first modification may include installing a wedge stop (e.g., wedge stop 902 shown in FIG. 9D, and other FIGS. discussed below) in order to keep the wedge angle from becoming less than 22°. Wedge stop 902 may reduce the additional tack clearance from 0.131 inches at 0° to 0.043 inches at 22°, as shown as ATC2 in FIG. 9D (0.131 inches−0.235 inches× sin 22°=0.131 inches−0.088 inches=0.043 inches). It is worthy to note that derived dimensions herein discussed are approximate due to the manufacturing and yield tolerances of the tack retaining system components. If adding the wedge stop 902 was the only modification made, the Fpo may be reduced. Consider FIG. 9D where the wedge surface 1205 angle rotates to 0° compared to where it rotates to only 22°. The net amount of horizontal yield of the tack retaining system is a measure of the force holding the tack between the wedge edge 1213 and wall 803T, e.g., for wedge 1202 to rotate from 34° to 0°, the net horizontal yield becomes 0.235 inches× cos 0°−0.235 inches× cos 34°=0.235 inches−0.195 inches=0.040 inches (See HY1 in FIG. 9D). The net amount of horizontal yield of the tack retaining system with wedge stop 902 when wedge 1202 rotates from 34° to 22° may be 0.235 inches× cos 22°−0.235 inches× cos 34°=0.218 inches−0.195 inches=0.023 inches (See HY2 in FIG. 9D). Therefore, the aggregate horizontal yield imposed may be reduced from 0.040 inches to 0.023 inches, thus reducing the size of the formed seat for lip 107/groove 108 in the edge 1213, and thus reducing the amount of extrusion required to release the tack, e.g., the pullout force Fpo may be reduced. This arrangement may solve the issues of characteristics (4) and (5) and improve characteristic (3), but the pullout force possible may be further reduced and must be compensated for by further Fpo enhancement modifications.

Figure 9E:
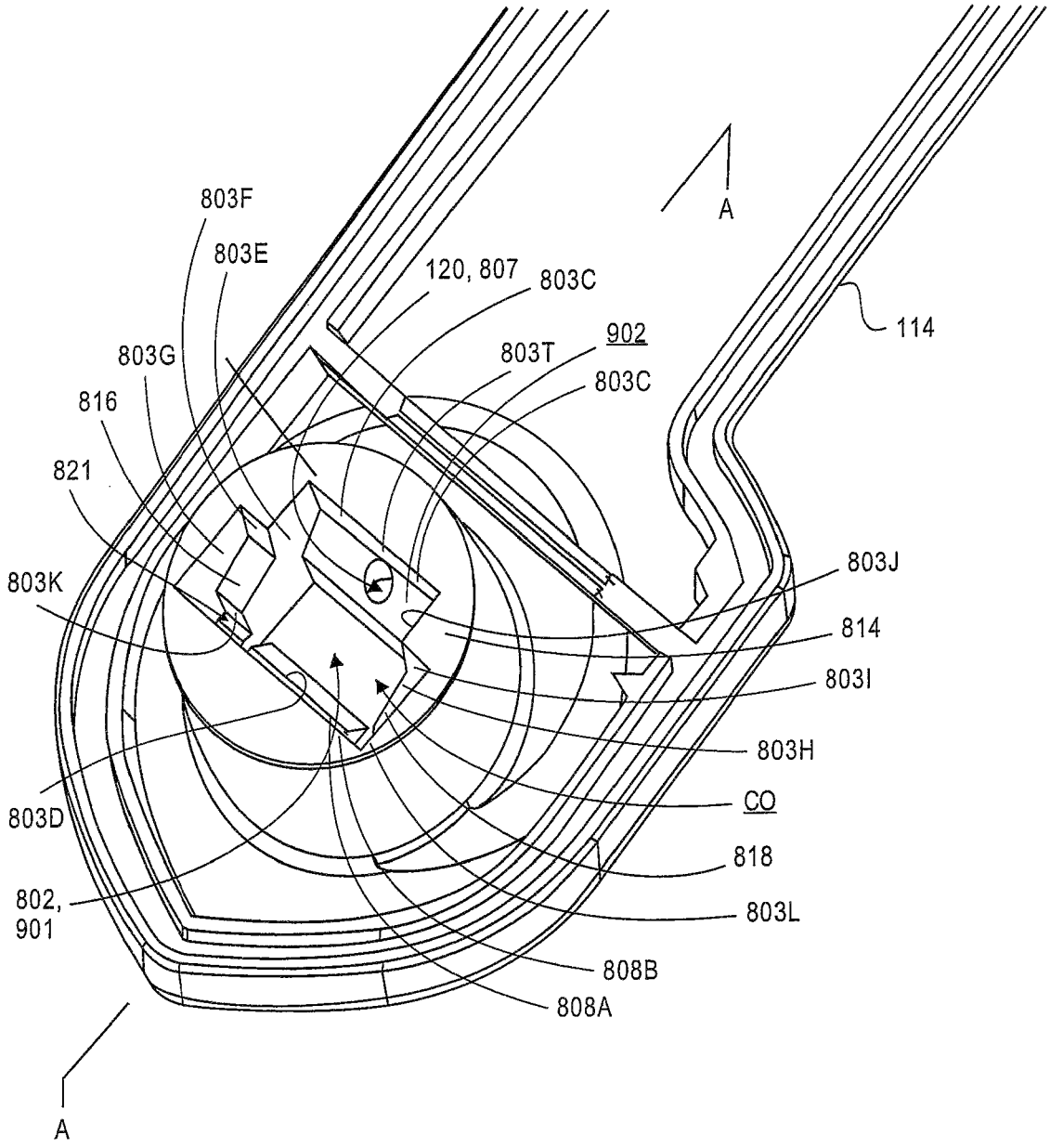
FIG. 9E illustrates an interior view of an upper housing for a security tag in accordance with one embodiment.
Figure 9F:
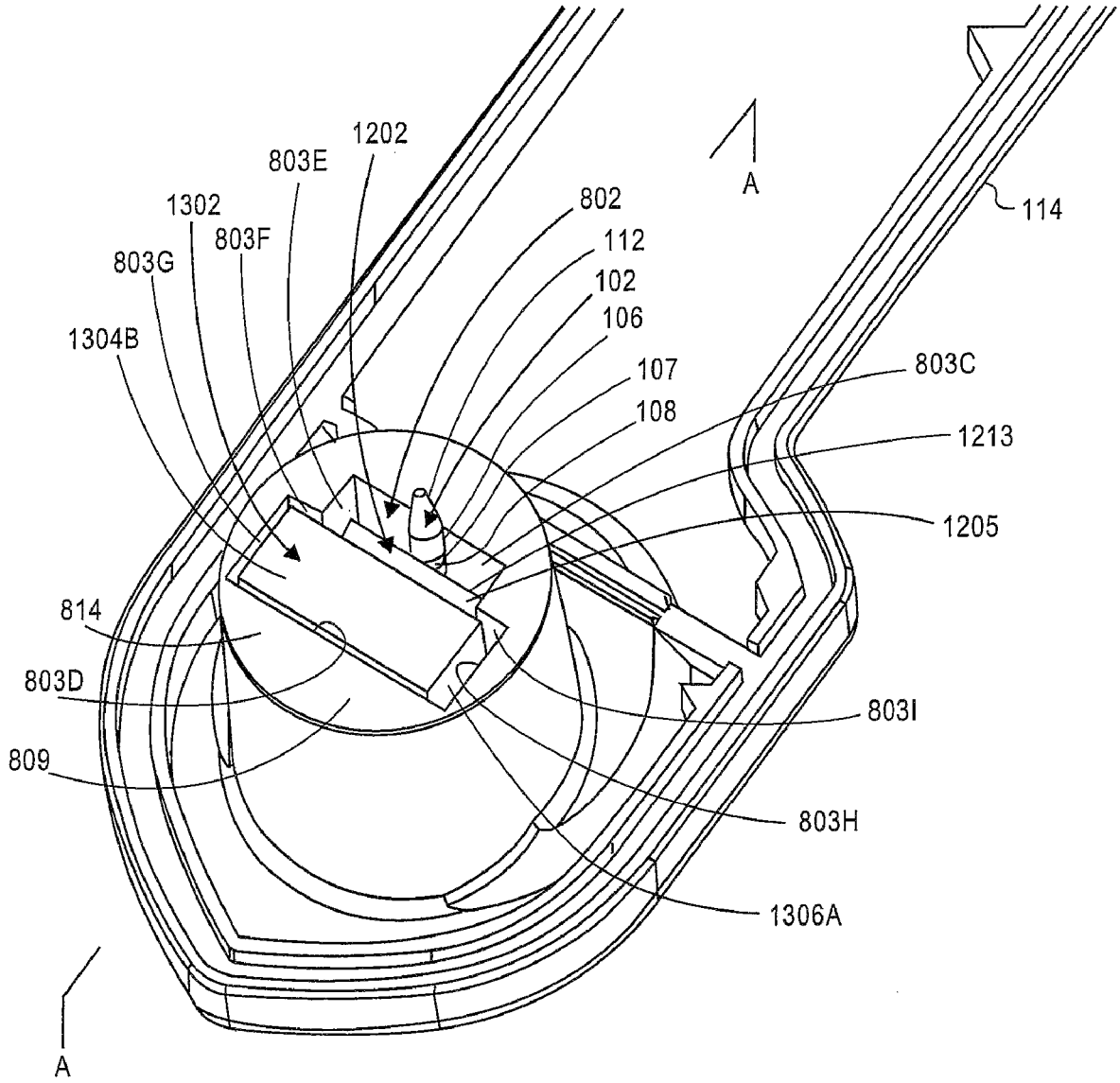
FIG. 9F illustrates an interior view of an upper housing with a wedge, rubber spring, and a tack shank inserted for a security tag in accordance with one embodiment.

FIG. 9E illustrates an interior view of an upper housing for a security tag in accordance with a second embodiment. FIG. 9E shows a detailed view of an improved wedge compartment 802 of upper housing 114. In particular, the wedge stop 902 is shown, a "cored out" area is shown as well as several other features described below. This arrangement is suitable for use in both a reusable or single-use tag. FIG. 9F illustrates an interior view of an improved upper housing with a wedge, rubber spring, and a tack shank inserted for a security tag in accordance with a second embodiment. The rubber spring 1302 in FIG. 9F is shown compressed as if the lower housing 116 was attached to the preferred upper housing 114 forming a complete tack retaining system.

Figure 9G:
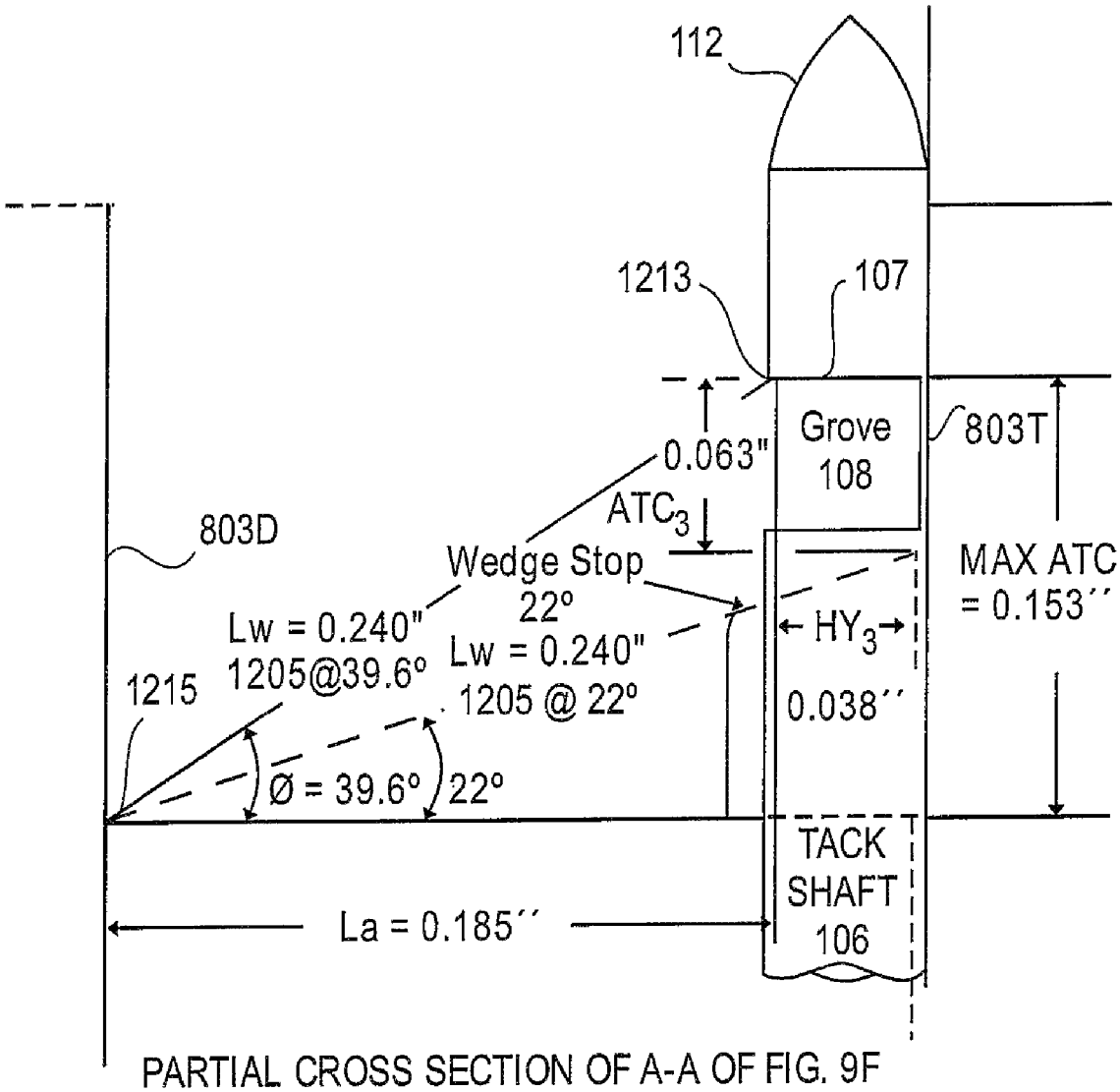
FIG. 9G illustrates a dimensional diagram for components of FIG. 9F in accordance with one embodiment.
Figures 9H, 9I:
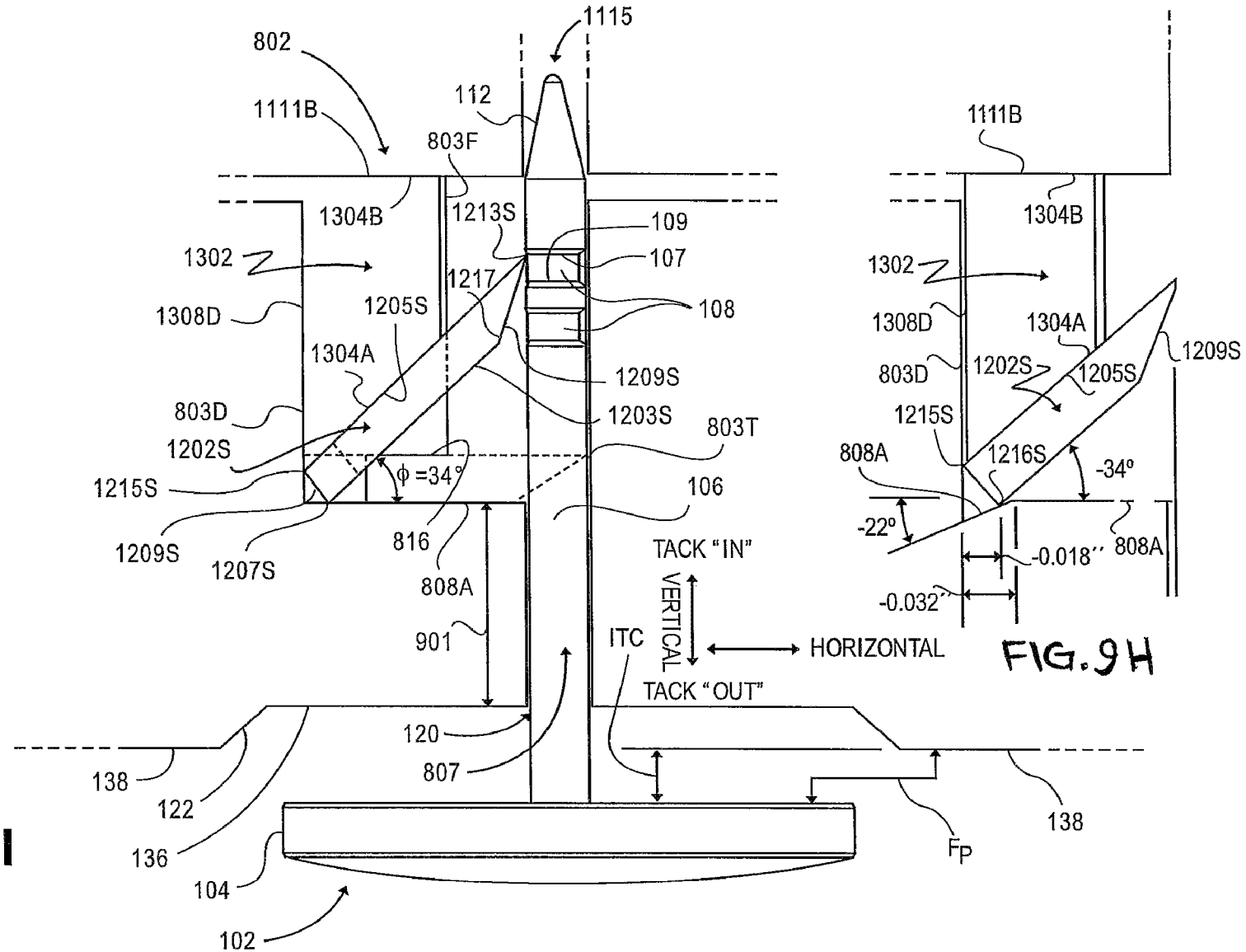
FIG. 9H illustrates the partial section A-A of FIG. 8D in accordance with a single use embodiment.
FIG. 9I illustrates the partial section A-A of FIG. 8D in accordance with a single use embodiment.

FIG. 9G illustrates a dimensional diagram for components of FIG. 9F in accordance with a second embodiment. FIG. 9G is a partial cross section A-A of FIG. 9F showing some dimensions and may be instrumental in describing improvements to the embodiment of FIGS. 8A, 8B, 8C, 8D, 9A, 9B, 9C, 9I, and curve C of FIG. 10. A second modification to improve the curve C characteristic (1) and Fpo characteristic (2) above, and to compensate for the loss of Fpo caused by introducing the wedge stop 902, may be implemented. La may be reduced from 0.195 inches of FIG. 9D to 0.185 inches of FIG. 9G to help establish a higher initial wedge angle Ø in an effort to further improve curve C and Fpo. Further, the initial Lw may be increased from 0.235 inches of FIG. 9D to 0.240 inches of FIG. 9G. Initial wedge angle was thus increased from 34° to 39.6°. These changes rendered a maximum possible additional tack clearance, if wedge stop 902 was not incorporated, from 0.131 inches of FIG. 9D to 0.153 inches of FIG. 9G (barring the issue of over rotation as explained earlier). The net horizontal yield when the wedge 1202 rotates from 39.6° to 22° is now equal to (0.240 inches× cos 22°−0.024 inches× cos 39.6°=0.223 inches−0.185 inches=0.038 inches) 0.038 inches (See HY3 of FIG. 9G), which is improved over the 0.023 inches discussed above in the first modification. Yet another improvement is that the possible additional tack clearance has been reduced from 0.131 inches when the wedge angle rotated from 34° to 0° per FIG. 9C, to only 0.063 inches when the wedge angle rotates from 39.6° to 22° (0.240 inches× sin 39.6°−0.240 inches× sin 22°=0.153 inches−0.090 inches=0.063 inches), as indicated by ATC3 in FIG. 9G. Wall 803C is made coincident with wall 803T as seen in FIG. 9E since tack shank 106 is well supported by the increased length of tack hole 807 (From FIG. 8A to FIG. 9E) which now extends through wedge stop 902. Another salient reason was to improve issues concerning ultrasonic welding. Wedge stop 902 sloped top surface may support wedge surface 1209 prior to tack entry. A third modification to further improve characteristics (1) and (2) above, and to compensate for the loss of Fpo caused by introducing the wedge stop 902, may be implemented. The embodiment shown in FIG. 9E may be molded using hi-impact ABS plastic or polycarbonate plastic to reduce the amount of plastic yield even more to improve curve C of FIG. 10 and the Fpo. A fourth modification to further improve characteristics (1) and (2) above, and to compensate for the loss of Fpo caused by introducing the wedge stop 902, may be to change the tack and wedge hardness. Typical security tacks in use today have a hardness of approximately RC 40. The wedge of the embodiment of FIG. 8D has a hardness of approximately RC 45. There is a tendency therefore for the wedge to cut and/or extrude the softer tack under the stress of Fp, and the semi-circular ledge may not form well in the edge 1213. This may lead to a lower Fpo than if the ledge was formed better. Tests have indicated that higher values are possible with a tack hardness of approximately RC 50 and a wedge hardness of approximately RC 43, thus this change may improve curve C of FIG. 10.

FIG. 9H illustrates the partial section A-A of FIG. 8D in accordance with a second single-use embodiment. FIG. 9H may be useful in describing the effect of sloped surface 808*a* on the wedge 1202S in a single-use embodiment. Ratcheting concerns the single-use tack retaining system only, referring to FIGS. 9H and 9I, with some reference to FIG. 9E. In one embodiment, a portion of top wall 808A may be sloped at approximately 22° from horizontal beginning approximately 0.032 inches from back wall 803D as shown in FIG. 9H (in contrast to no sloped surface in FIG. 9I). Before the tack 102 is inserted, wedge 1202S is biased flat on wall 808A by the compression force of rubber spring 1302 as stated before, with edge 1216S touching or virtually touching wall 808D directly above sloped surface 808*a*. The sloped portion may comprise surface 808*a* as shown in FIG. 9H. When tack shank 106 is inserted to where the wedge angle is approximately 34°, the edge 1216S of the wedge pivot end rests on the sloped surface 808*a*. When tack shank 106 and wedge 1202S are in the locked condition, edge 1216S is approximately 0.018" from back wall 803D resting on the sloped surface 808*a* in the first position. As described earlier concerning FIG. 9I, the compression force of the rubber spring 1302 has a net horizontal component that urges edge 1216S to the right, and the compression force has a net vertical component that, coupled with a coefficient of friction ω, provides a frictional force on edge 1216S that urges no movement. If the horizontal force component overcomes the frictional force, edge 1216S will move to the right until the net vertical component diminishes to where the frictional force and the net horizontal force are equal. When the sloped surface 808*a* is added, another component of force on edge 1216S is added urging edge 1216S to move to the left. This bias to the left is a function of at least the net vertical component of the compression force of rubber spring 1302, and the angle of the sloped surface 808*a*, and a coefficient of friction ω. The bias to the left plus any frictional force may counteract the bias to the right. If the angle of the sloped surface 808*a* is sufficient, the bias to the left may overcome the bias to the right. If the tag 100 is placed on a magnetic detacher of sufficient strength "S", the wedge 1202S may be rotated and attracted sufficiently to overcome the net bias to the left and translate edge 1216S off of sloped surface 808*a* and onto flat surface 808A where resistance to the translational movement of edge 1216S may become much less because the bias to the left has been eliminated. Thus a condition has been established that the magnetic detacher strength of at least "S" is required to translate edge 1216S from the sloped surface 808*a* to the flat surface 808A. The sloped surface is equally effective in the configuration of FIGS. 9E and 9F and so it may be adapted. The only difference is that the wedge angle when in locked condition (i.e., 39.6° versus 34°) causes a small difference in the distance that edge 1216S must traverse on surface 808*a* to get to surface 808A (0.016 to 0.013 inches in the embodiment of FIG. 9F). A further improvement is introduced by removing or "coring out" (See "CO" in FIG. 9E and FIG. 20) all or a portion of wall 901 from surface 808A so that edge 1216S does not slide on a surface 808A after it translates off of sloped surface 808*a* shown in Fig. E, but "falls" into the cored out hole shown in FIG. 9E and FIGS. 14 through 31, which offers no resistance to translational movement of edge 1216S or rotational movement of the wedge 1202S, so that the whole wedge 1202S immediately begins a virtually uninhibited counterclockwise rotation around the expanding rubber spring to the permanent unlock condition. Thus, a threshold has been established whereby a magnetic detacher of at least strength "S" is required to advance the edge 1216S over the end of sloped surface 808*a* (ledge 808*b*) and into the uninhibited rotation of the wedge 1202S, aided by the expanding rubber spring 1302, to the permanent unlock condition. The same sloped surface 808*a* may prevent ratcheting. If tack shank 106 has sufficient tack clearance and is pushed in and ratcheting is attempted, wedge edge 1216S may move to a second position slightly to the right of the first position but still on sloped surface 808*a*. When the tack shank 106 is pulled back to its first position, the wedge edge 1216S may return to its first position due to the sufficient slope of sloped surface 808*a*. Whereas the bias of rubber spring 1302 may tend to hold edge 1216S in the second position when in contact with a horizontal surface 808A as per FIG. 9I, the same bias tends to push the edge 1216S back down the sloped surface 808*a* to its first position due to the sufficient slope of sloped surface 808*a*. Thus, the sloped surface 808*a*, with sufficient slope, reduces or eliminates the ratcheting characteristic. In this embodiment, 22° is sufficient slope for the smooth sloped surface 808*a*. Surface 808*a* may also provide better control of wedge pivot end during assembly. It is noted here that the sloped surface 808*a* is an option providing smooth travel for the edge 1216S to the ledge 808*b*. This configuration could be replaced with a flat surface 808*a* and a fence like barrier providing a threshold that edge 1216S must surmount before the wedge 1202S can attain uninhibited rotation to the permanent unlock condition. The sloped surface 808*a* is chosen for smooth translational movement of edge 1216S and ease of molding.

In one embodiment, a portion of wall 901 may be removed or "cored out" from the surface of top wall 808A to facilitate operation of the single-use tack retaining system as discussed above. It is not necessary to core out a portion of wall 901 in the reusable tack retaining system because the protrusions 1221R and 1222R residing in recesses 821 and 822 prevent wedge 1202R from rotating into the cored out area. However, coring out of wall 901 to the extent shown in FIG. 9E and FIGS. 14 through 31, may assist in the molding process without substantially reducing the strength of the tag, so the cored out area of wall 901 is shown in views of both the single-use and reusable tack retaining systems henceforth. Another change seen in FIG. 9E is the improved position of walls 816 and 818 and walls 803K and 803L. Walls 816 and 818 are sloped to be parallel with the wedge surface 1205 when in the rest condition, providing for a virtually even surface for the entire surface 1304A of the rubber spring to bear against. Additionally, referring to the reusable embodiment, walls 803K and 803L are extended vertically to intersect walls 816 and 818 respectively at their improved position. This may provide deeper recesses 821 and 822 to better contain protrusions 1221R and 1222R of the wedge.

Figure 11:
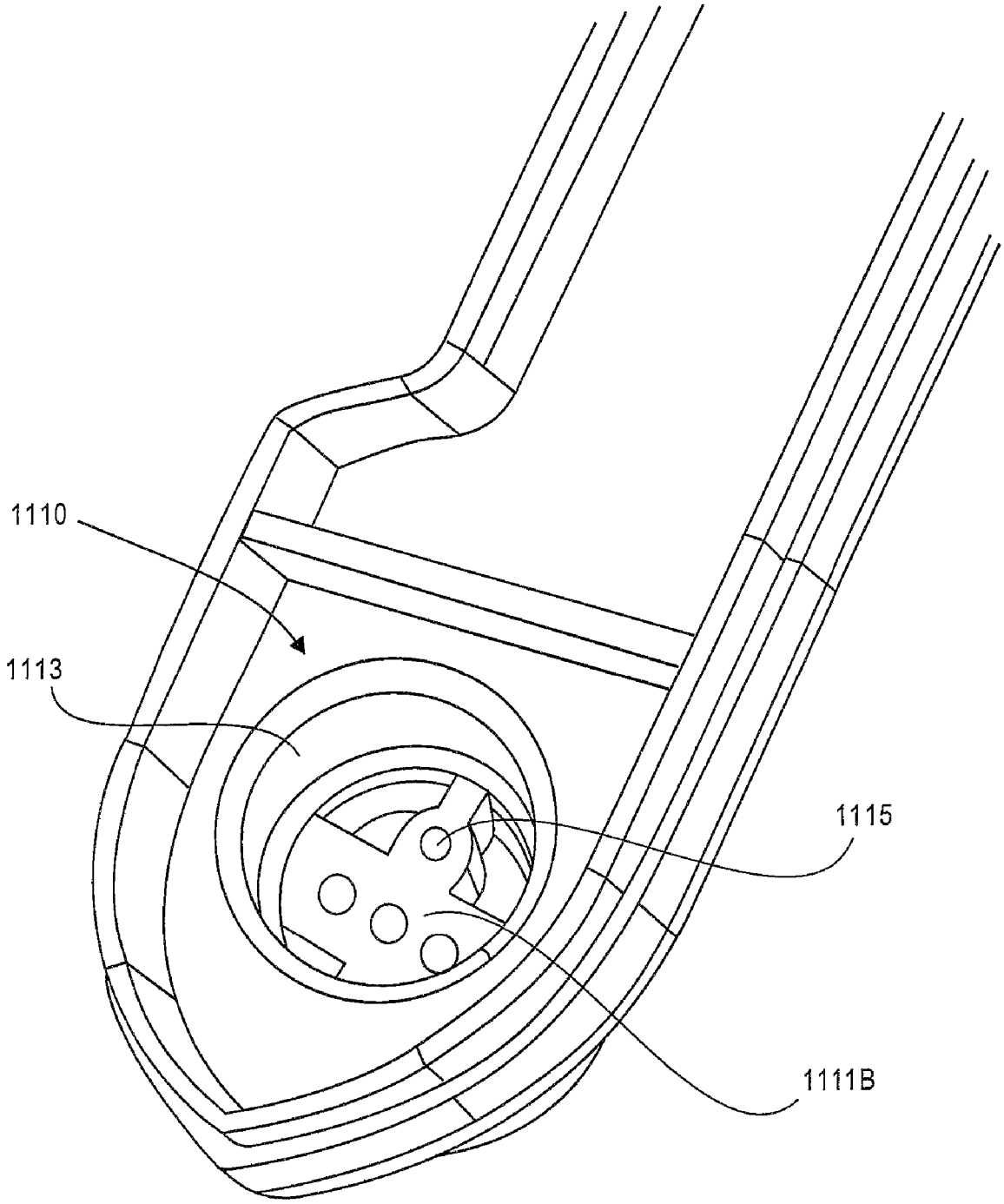
FIG. 11 illustrates an interior view of a lower housing for a security tag in accordance with one embodiment.

FIG. 11 illustrates an interior view of a lower housing for a security tag in accordance with one embodiment. As previously described, lower housing 116 may have pocket 1110. Pocket 1110 may provide bearing surface 1111B for rubber spring 1302, as described in more detail with reference to FIG. 13. The circular inside wall 1113 may guide and secure circular protrusion 809 of upper housing 114 when upper housing 114 and lower housing 116 are joined together to form security tag 100.

FIG. 12A illustrates a first view of a wedge for a security tag in accordance with one embodiment. FIG. 12A illustrates a wedge 1202R suitable for use with a reusable tack retaining system. In one embodiment, for example, wedge 1202R may be formed using magnetically attractable steel. Wedge 1202R may have a shape that is approximately 0.240 inches by 0.240 inches by 0.032 inches thick. Protrusions 1221R and 1222R may assist wedge 1202R for reuse. Protrusions 1221R and 1222R may each have the approximate dimensions of 0.032 inches by 0.032 inches by 0.032 inches. The embodiments are not limited in this context.

Wedge 1202R may have alternate arrangements as well. For example, wedge pivot side 1207R may be rounded from end to end including axle protrusions 1221R and 1222R, and the intersection of top wall 808A and back wall 803D may be rounded to movably fit the rounded pivot side 1207R. This configuration may potentially provide a better bearing surface for rounded pivot side 1207R, although at additional wedge manufacturing costs. The embodiments are not limited in this context.

FIG. 12B illustrates a second view of a wedge for a security tag in accordance with one embodiment. FIG. 12B illustrates a wedge 1202S suitable for use with a single-use tack retaining system. In one embodiment, for example, wedge 1202S may be similar to wedge 1202R. Wedge 1202S may omit, however, axle protrusions 1221R and 1222R. Since wedge 1202S does not have axle protrusions 1221R and 1222R, compartment 802 of security tag 100 does not need corresponding recesses 821 and 822 to hold axle protrusions 1221R and 1222R. The embodiments are not limited in this context.

In a single-use tack retaining system, for example, wedge 1202S is not only attracted to the magnetic surface, but is also driven to a vertical stance by the magnetic force urging rotational movement around the expanding rubber spring 1302. The magnetic attracting force field direction of the magnet, which is typically perpendicular to the pole surface in the center of the surface, drives the long dimension of wedge 1202S into alignment with the direction of the magnetic attracting force field. The single-use tack retaining system may utilize wedge 1202S and the magnetic rotational effect characteristic to attain a permanent unlock condition for security tag 100.

Certain dimensions may be selected for one or more elements of a single-use tack retaining system in order to allow tack retaining edge 1213S to be rotated from under groove lip 107 of tack shank 106 during detachment operations. At the same time, edge 1216S should be thrust off edge 808*b* (see FIGS. 25 and 26) of surface 808*a* and into the CO area of wall 808A. The movement of edge 1216S is rotational and also slightly down and lateral off of surface 808*a* and edge 808*b* and into CO.

Figure 13:
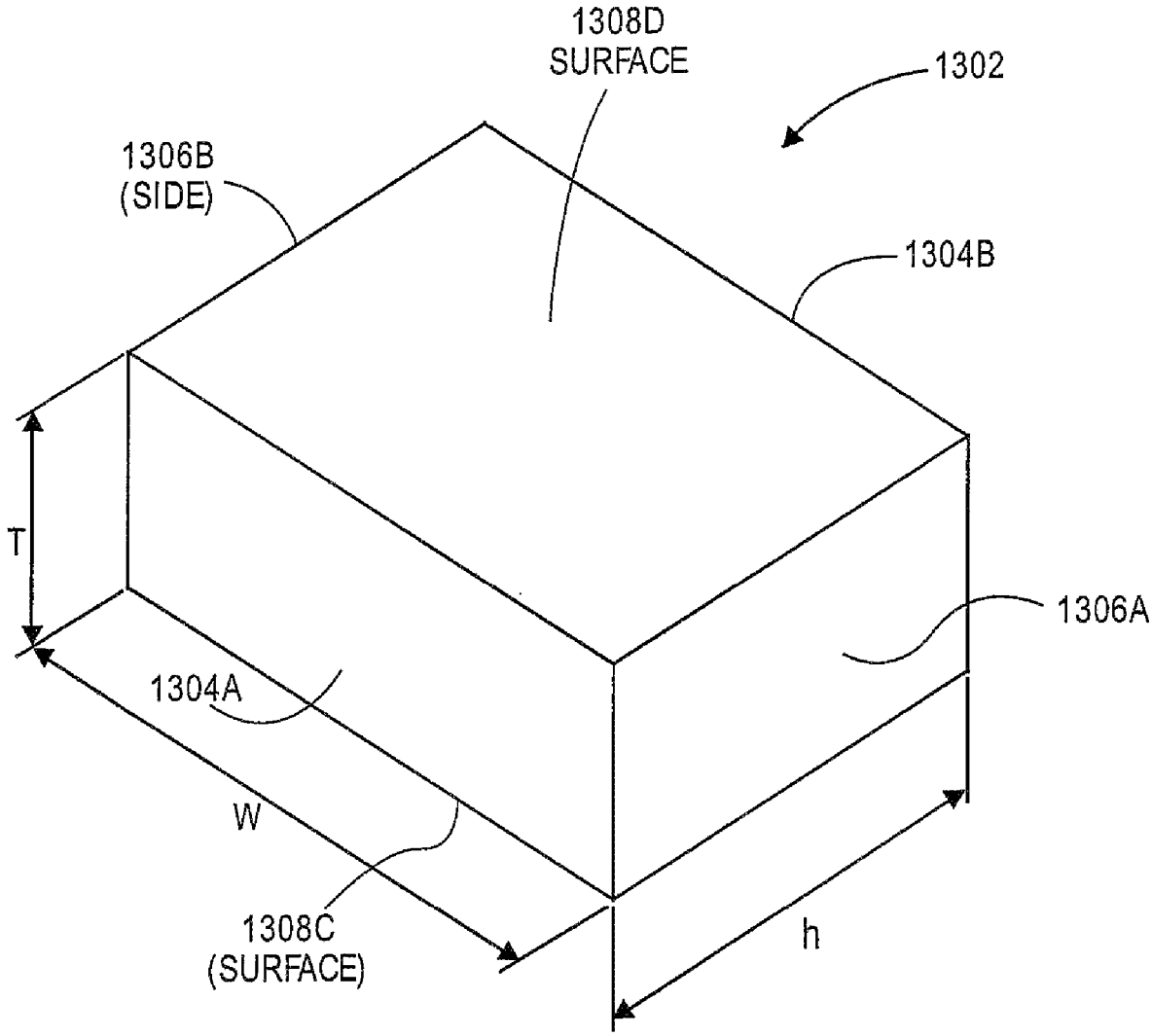
FIG. 13 illustrates a view of a rubber spring for a security tag in accordance with one embodiment.

FIG. 13 illustrates a view of a rubber spring for a security tag in accordance with one embodiment. FIG. 13 illustrates a rubber spring 1302 suitable for use with a reusable security tag or single-use security tag. In one embodiment, rubber spring 1302 may approximate the shape of a rectangular block, having a width w, height h, and a depth t. Rubber spring 1302 may also be implemented using other shapes as desired for a given set of design constraints. One feature of the rubber spring is that it provides a bias that is resilient in all directions relatively uniformly similar to a rubber ball. This feature provides vertical and horizontal components of bias essential in the functioning of the tack retaining system. The embodiments are not limited in this context.

In one embodiment, rubber spring 1302 may be made from a material such as rubber or foam rubber. The rubber material may provide a certain amount of bias (or compression force) suitable for a given implementation. The amount of bias provided by rubber spring 1302 can be changed by the formulation of the rubber product used to make rubber spring 1302. Consequently, the amount of magnetic strength needed for magnetic detaching device 602 may vary in accordance with the amount of bias provided by rubber spring 1302. For example, if rubber spring 1302 is made of a rubber product having a lower firmness and therefore providing a lower bias, magnetic device 602 may be arranged to perform detachment operations using a lower magnetic strength. In another example, if rubber spring 1302 is made of a rubber product having a higher firmness and therefore providing a higher bias, magnetic device 602 may be arranged to perform detachment operations using a higher magnetic strength. The embodiments are not limited in this context.

In one embodiment, rubber spring 1302 may be implemented using a number of different rubber products. For example, the rubber material may comprise PORON Urethane Foam number 4701-40 Soft, or 4701-50 Firm, or 4701-60 Very Firm, all made by Rogers Corporation. In addition to the previously described characteristics, the specific rubber material selected for rubber spring 1302 should offer sufficient stability and durability desired for a given implementation of security tag 100. The dimensions of rubber spring 1302 may also be important for proper detachment as well. The design flexibility offered by potentially modifying one or more characteristics of rubber spring 1302 may allow "scalability" of design for different detachment characteristics for different security tags 100. The embodiments are not limited in this context.

Figure 14:
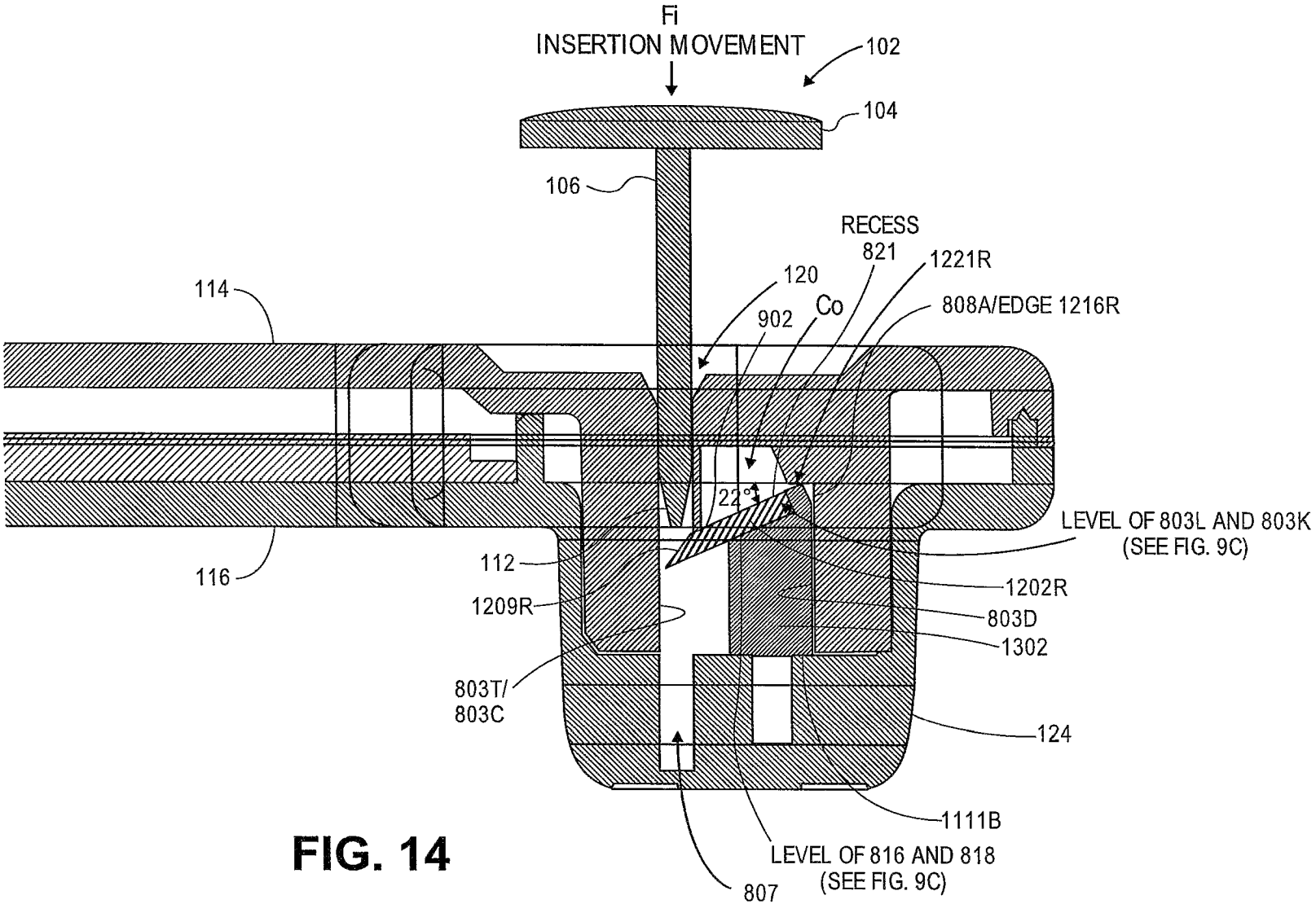
FIG. 14 illustrates a first view of a cross-section taken along line D-D of a reusable security tag with a tack, wedge, and rubber spring in accordance with one embodiment.

FIG. 9E shows the upper cover configuration used in FIGS. 14-31. The improved position of walls 816 and 818 and walls 803K and 803L are indicated for reference in reusable tag cross sections FIGS. 14 through 19. FIG. 14 illustrates a first view of a cross-section taken along line D-D of a reusable security tag with a tack, wedge, and rubber spring in accordance with one embodiment. FIG. 14 is a partial cross section D-D of FIG. 1A with the reusable tack retaining system showing tack shank 106 partially inserted into tack hole 807. The reusable tack retaining system is in a rest condition, and the operations for attaching tack assembly 102 to security tag 100 have been initiated. Pointed end 112 is inserted into aperture 120 and into tack hole 807. Pointed end 112 is approaching inclined surface 1209R of wedge 1202R. Axle protrusions 1221R and 1222R are constrained to their respective recesses 821 and 822, but are allowed to rotate within recesses 821 and 822. In one embodiment, wedge 1202R may be biased with surface 1209R on wedge stop 902 and edge 1216R on sloped surface 808*a* by rubber spring 1302 at a wedge angle Ø of approximately 22° when in the rest condition. Edge 1216R is about 0.012 inches from back wall 808D.

Figure 15:
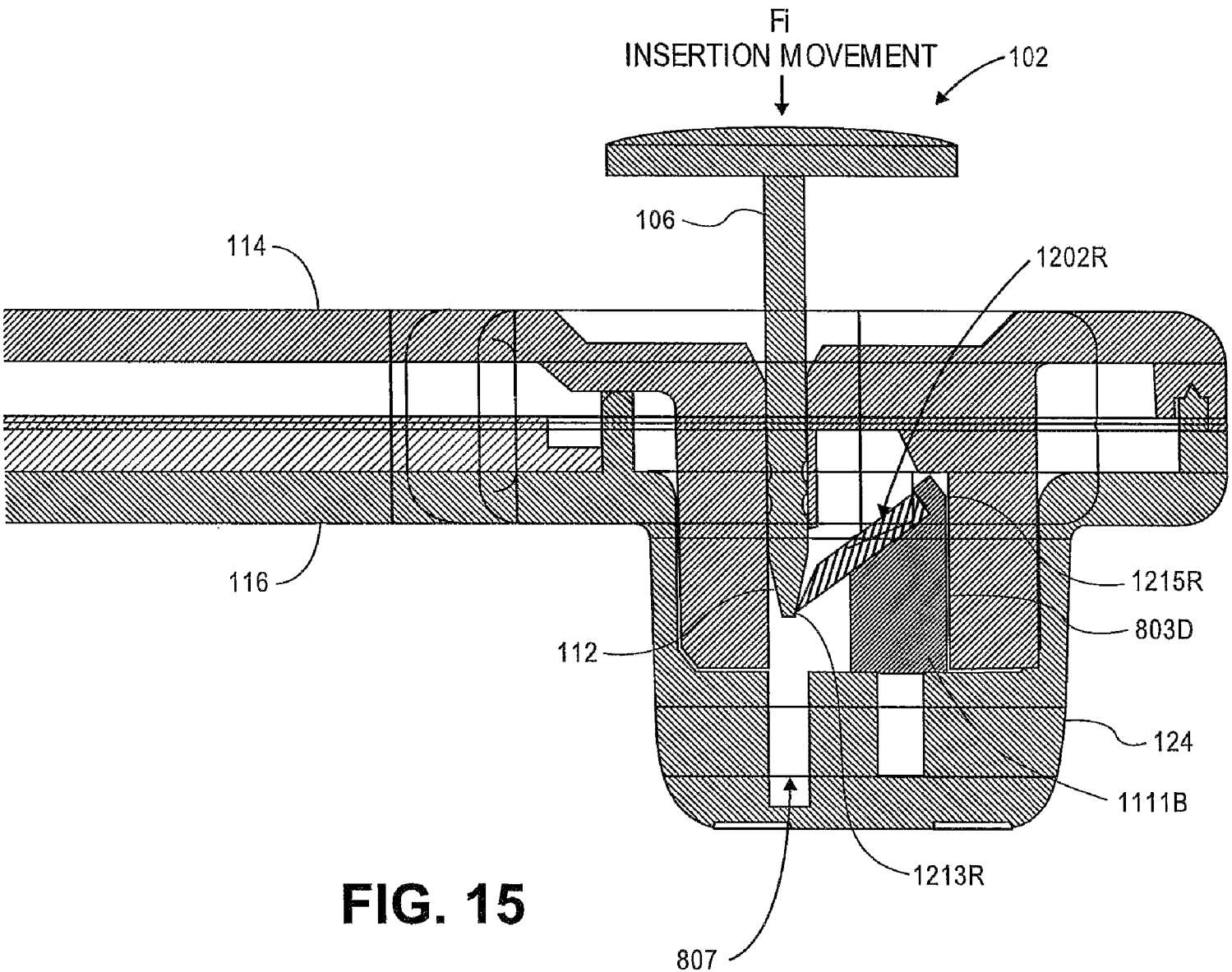
FIG. 15 illustrates a second view of a cross-section taken along line D-D of a reusable security tag with a tack, wedge, and rubber spring in accordance with one embodiment.

FIG. 15 illustrates a second view of a cross-section taken along line D-D of a reusable security tag with a tack, wedge, and rubber spring in accordance with one embodiment. FIG. 15 shows tack shank 106 further inserted into tack hole 807 until pointed end 112 has contacted surface 1209R. Such contact may force wedge 1202R to begin rotating counterclockwise approximately about edge 1215R, and edge 1216R to slide slightly on surface 808*a*. It is worthy to note that wedge 1202R does not necessarily rotate exactly about contact point of edge 1215R and back wall 803D. There may be a small movement of the contact point on wall 808D as wedge angle Ø changes. The movement on back wall 803D may approximate 0.002 inches in total as wedge angle Ø changes from 22° to 40°. This movement may slightly effect the initial tack clearance. Pointed end 112 may slide across surface 1209R such that it is contacting tack retaining edge 1213R. Rubber spring 1302 may compress slightly more between wedge 1202R and surface 1111B. The reusable tack retaining system does not necessarily enter a locked condition since tack assembly 102 could still be retracted from security tag 100.

Figure 16:
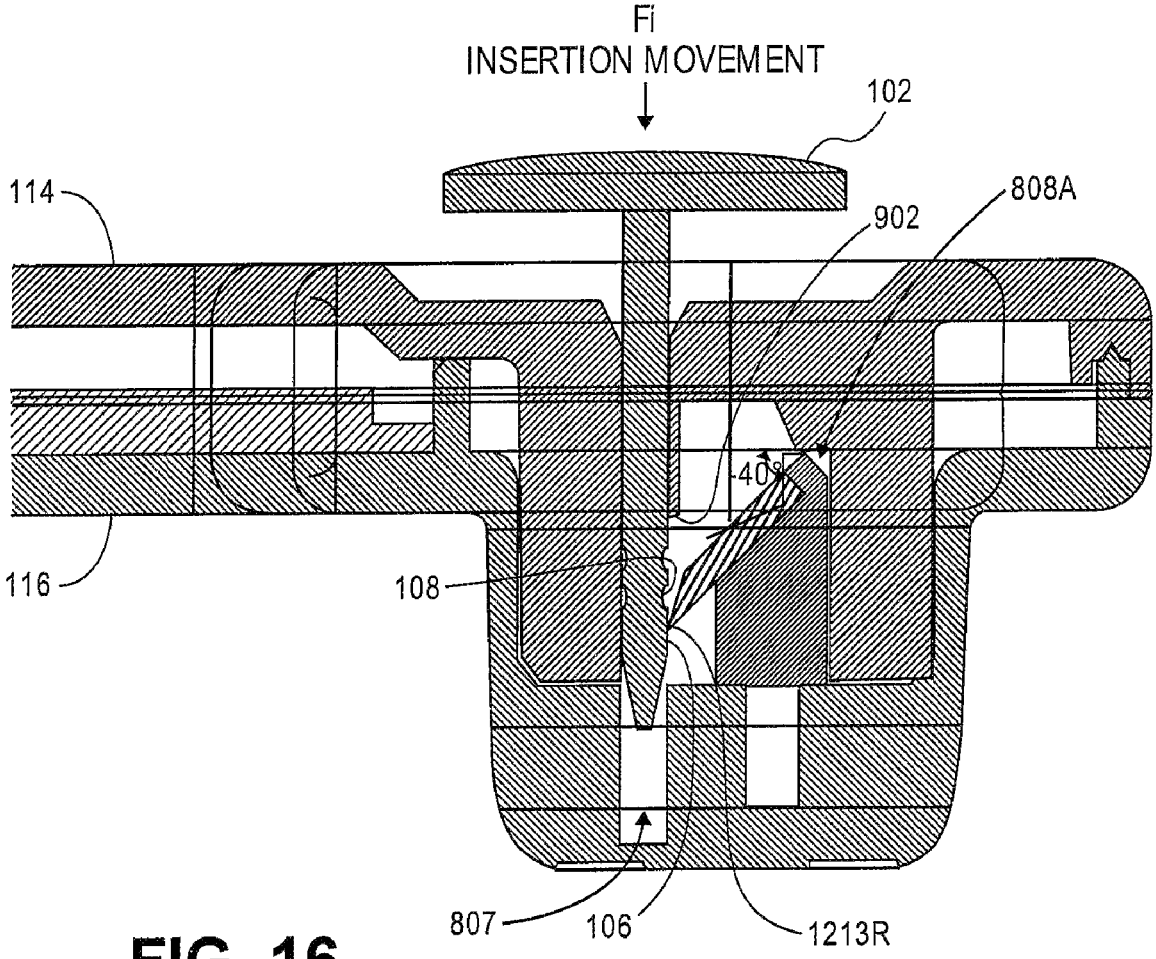
FIG. 16 illustrates a third view of a cross-section taken along line D-D of a reusable security tag with a tack, wedge, and rubber spring in accordance with one embodiment.

FIG. 16 illustrates a third view of a cross-section taken along line D-D of a reusable security tag with a tack, wedge, and rubber spring in accordance with one embodiment. FIG. 16 shows tack shank 106 when inserted further into tack hole 807 until tack shank 106 makes contact with and begins to slide by tack retaining edge 1213R. Wedge angle Ø is approximately 40°. Further insertion of tack shank 106 may position tack retaining edge 1213R adjacent to a first of grooves 108. While tack retaining edge 1213R is in contact with tack shank 106, there is no further counterclockwise rotation of wedge 1202R. The reusable tack retaining system may not yet enter a locked condition since tack assembly 102 could still be retracted from security tag 100.

Figure 17:
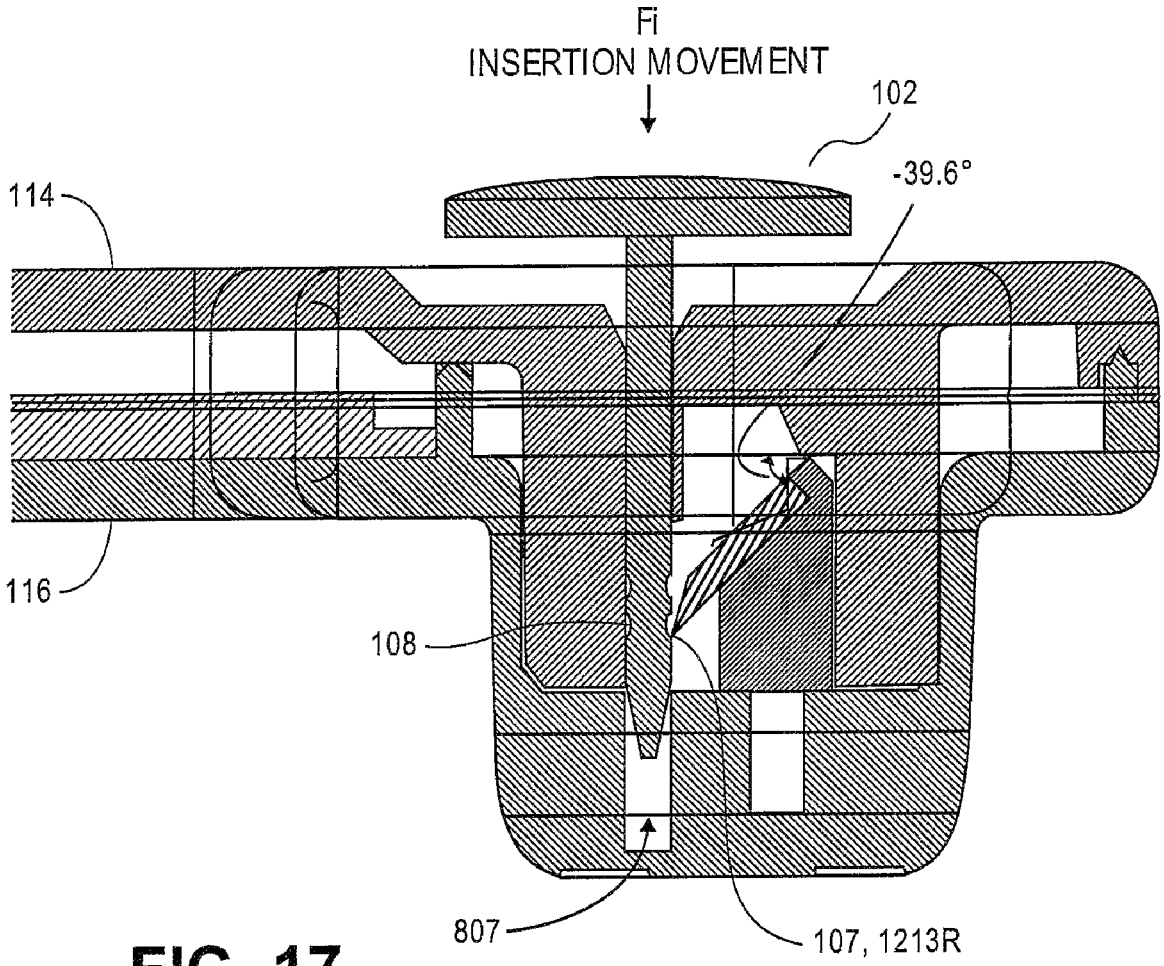
FIG. 17 illustrates a fourth view of a cross-section taken along line D-D of a reusable security tag with a tack, wedge, and rubber spring in accordance with one embodiment.

FIG. 17 illustrates a fourth view of a cross-section taken along line D-D of a reusable security tag with a tack, wedge, and rubber spring in accordance with one embodiment. FIG. 17 shows tack shank 106 inserted further into tack hole 807 until tack groove 108 is adjacent to tack retaining edge 1213R. At this point, the bias of rubber spring 1302 between wedge 1202R and walls 1111B and 808D may force tack retaining edge 1213R into tack groove 108 via a clockwise rotation of wedge 1202R. Wedge angle Ø is approximately 39.6°, and edge 1216R is approximately 0.019 inches from back wall 808D. Attempts to retract tack assembly 102 from security tag 100 are now prevented by the wedge as previously described. Tack retaining edge 1213R pointed tip end is now biased into the intersection of groove lip 107 of tack groove 108 by rubber spring 1302, thus restraining the tack 102 from being extracted from the tag 100. At this point the reusable tack retaining system is in a locked condition.

In one embodiment, tack assembly 102 may be removed or detached from security tag 100 implemented with a reusable tack retaining system through the use of magnetic detaching device 602. In order to detach tack assembly 102 from security tag 100, security tag 100 should be seated or nearly seated in magnetic detaching device 602. The affects of magnetic detaching device 602 on the reusable tack retaining system to detach tack assembly 102 from security tag 100 may be described in more detail with reference to FIGS. 18 and 19.

Figure 18:
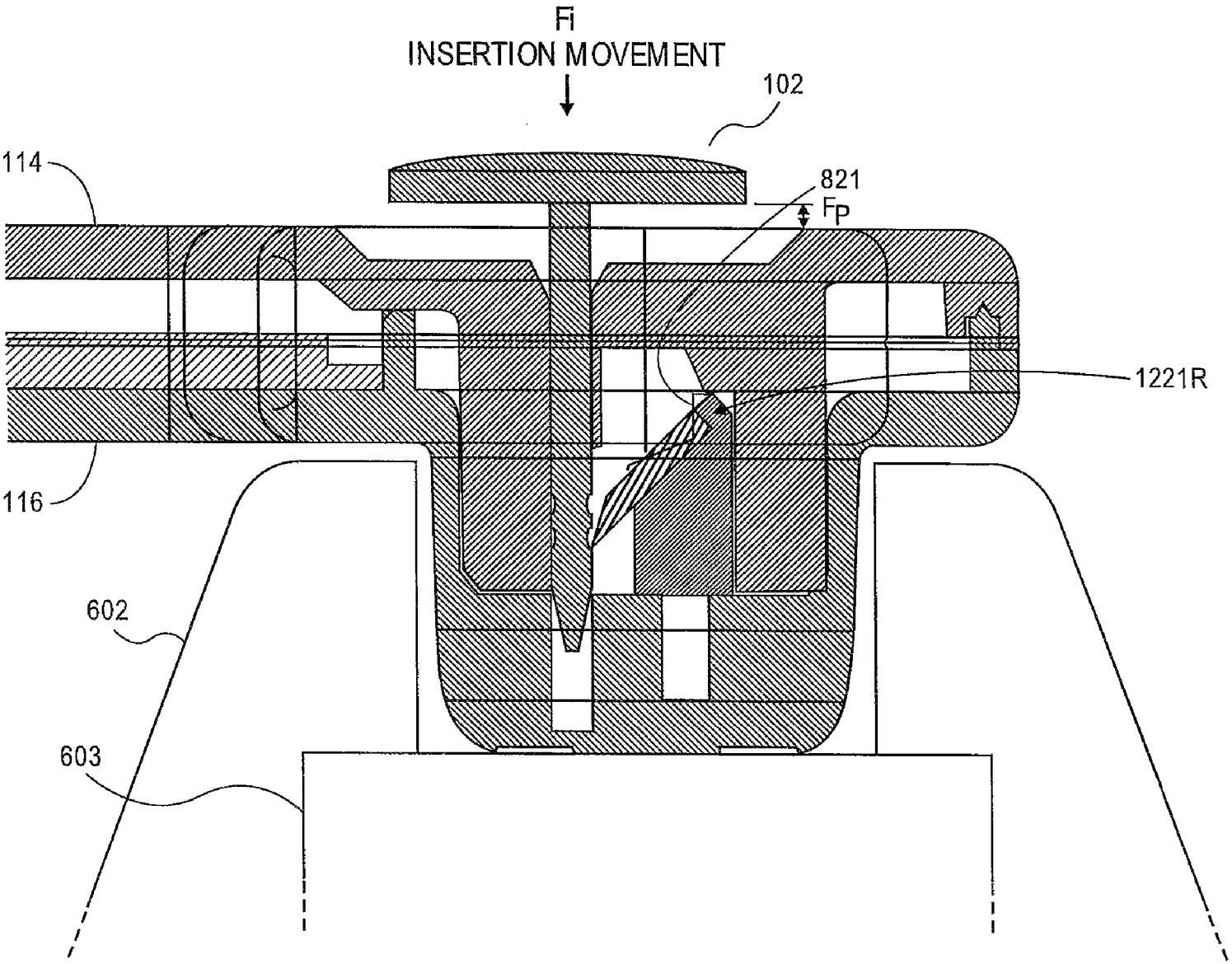
FIG. 18 illustrates a first view of a cross-section taken along line D-D of a security tag with a tack, wedge, rubber spring, and a magnetic detaching device in accordance with one embodiment.

FIG. 18 illustrates a first view of a cross-section taken along line D-D of a reusable security tag with a tack, wedge, rubber spring, and a magnetic detaching device in accordance with one embodiment. FIG. 18 shows the same partial cross section of FIG. 17 but as seated in magnetic detaching device 602. Further, assume sufficient Fp has been applied to hold the position of wedge 1202R in the locked condition when tag 100 is placed in magnetic detacher 602. When Fp is removed, magnetic detaching device 602 should be strong enough to attract wedge 1202R against the bias of rubber spring 1302, causing wedge 1202R to rotate counterclockwise about edge 1215R and axle protrusions 1221R and 1222R which are contained in their respective recesses 821 and 822, such that tack retaining edge 1213R is rotated sufficiently to clear groove lip 107 of tack shank 106.

The condition shown in FIG. 18 may occur without necessarily applying Fp to hold the locked condition since sufficient Fp may already be applied by garment 202 when secured between tack head 104 and security tag 100. In some cases, when security tag 100 is in magnetic detaching device 602, an insertion force Fi may be applied to tack head 104 to move tack shank 106 into security tag 100 sufficiently to allow groove lip 107 to release tack retaining edge 1213R so that detaching operations can be performed. Typically, movement needed for tack shank 106 may approximate 0.004 inches. This type of push-in operation to assist detachment typically exists to some extent for all magnetic clutches. In the vast majority of detachments, however, merely placing security tag 100 in magnetic detaching device 602 will be sufficient to free tack assembly 102 from security tag 100 for detachment operations to be completed.

Figure 19:
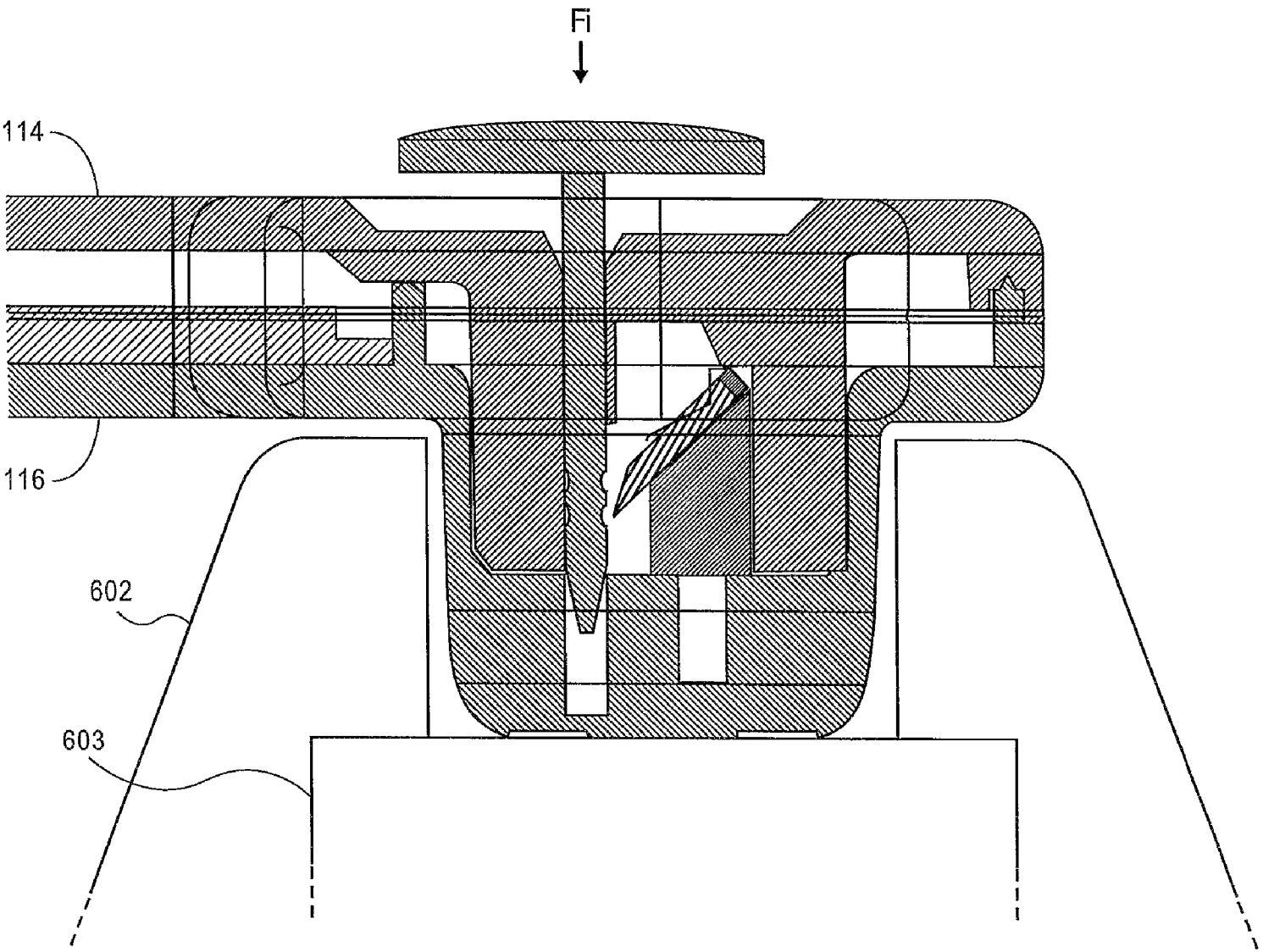
FIG. 19 illustrates a second view of a cross-section taken along line D-D of a security tag with a tack, wedge, rubber spring, and a magnetic detaching device in accordance with one embodiment.

FIG. 19 illustrates a second view of a cross-section taken along line D-D of a reusable security tag with a tack, wedge, rubber spring, and a magnetic detaching device in accordance with one embodiment. FIG. 19 shows the unlock condition after Fp is removed. Groove lip 107 is released from tack retaining edge 1213R and thus tack assembly 102 can be retracted from security tag 100 as long as security tag 100 remains in magnetic detaching device 602. When tack assembly 102 is retracted and security tag 100 is removed from magnetic detaching device 602, the condition of wedge 1202R reverts to the rest condition shown in FIG. 14. If tack shank 106 is left in tack hole 807 when security tag 100 is removed from magnetic detaching device 602, the condition of wedge 1202R may revert to that shown in FIG. 17. This operation may be counter productive however, since the purpose is to detach tack assembly 102 from security tag 100.

Figure 20:
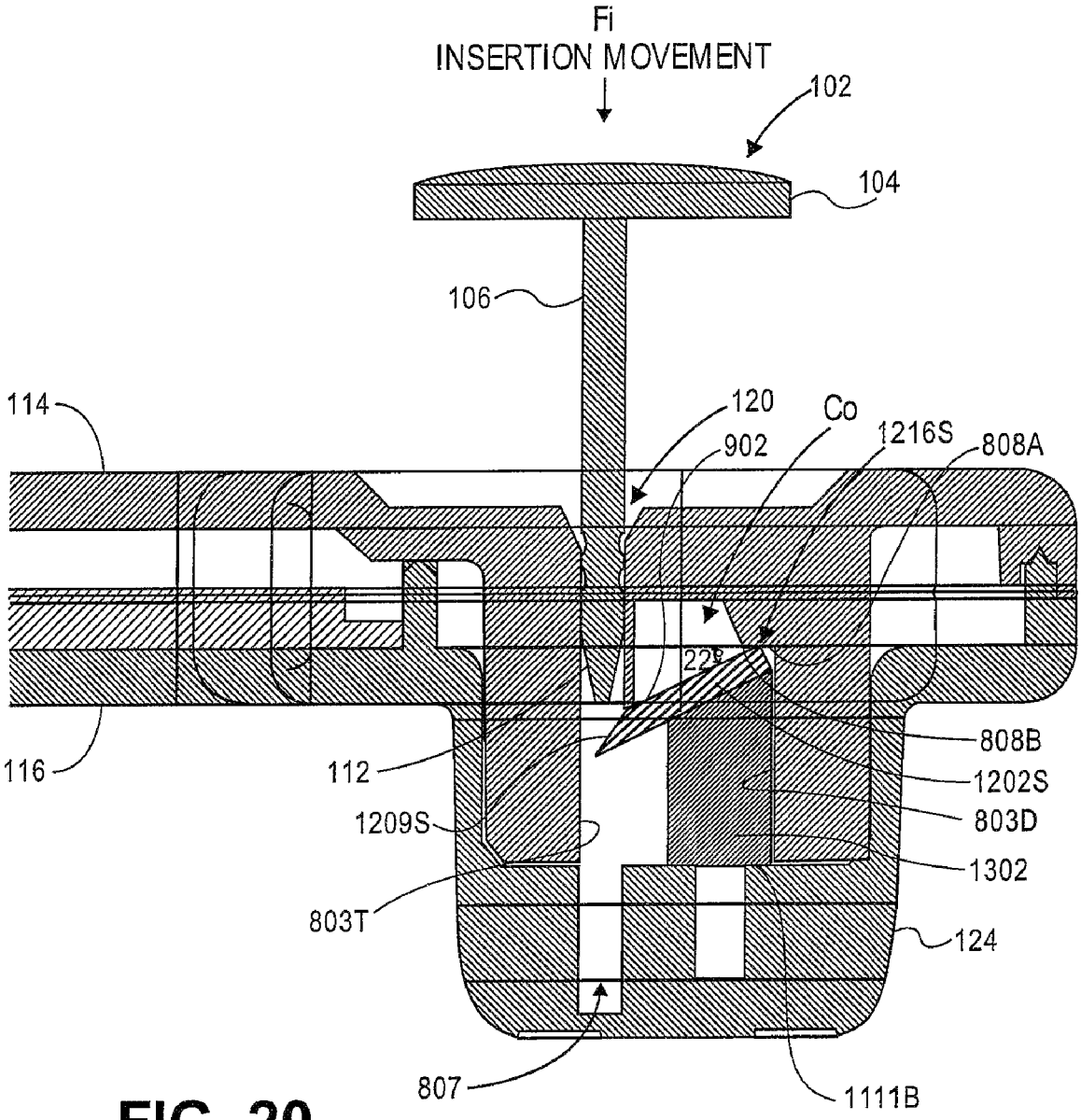
FIG. 20 illustrates a first view of a cross-section taken along line D-D of a single-use security tag with a tack, wedge, and rubber spring in accordance with one embodiment.

FIG. 20 illustrates a first view of a cross-section taken along line D-D of a single-use security tag with a tack, wedge, and rubber spring in accordance with one embodiment. FIG. 20 is a partial cross section D-D of FIG. 1A with a single-use tack retaining system showing tack shank 106 partially inserted into tack hole 807. As shown in FIG. 20, the single-use tack retaining system is in a rest condition, and attachment operations to attach tack assembly 102 to security tag 100 have been initiated. Pointed end 112 may be inserted into aperture 120 and tack hole 807. Pointed end 112 may be approaching inclined surface 1209S of wedge 1202S. Wedge 1202S may be biased against wedge stop 902 and sloped surface 808*a* by rubber spring 1302. In a rest condition, wedge 1202S may be biased with surface 1209S on wedge stop 902 (not fully shown) and edge 1216S on sloped surface 808*a* by rubber spring 1302 at a wedge angle Ø of approximately 22° when in rest condition. Edge 1216S is approximately 0.012 inches from back wall 808D and approximately 0.020 inches from ledge 808*b*.

Figure 21:
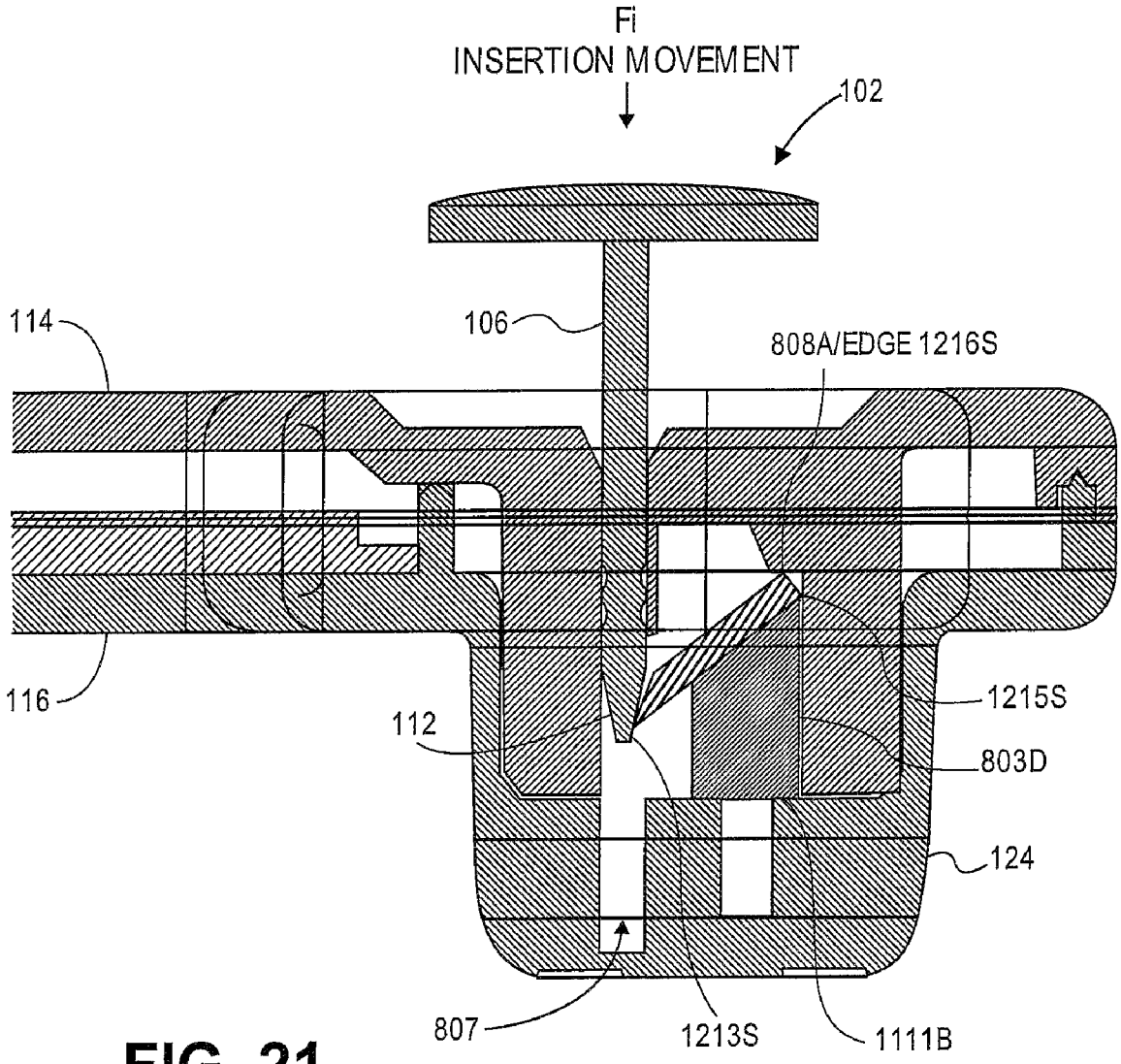
FIG. 21 illustrates a second view of a cross-section taken along line D-D of a single-use security tag with a tack, wedge, and rubber spring in accordance with one embodiment.

FIG. 21 illustrates a second view of a cross-section taken along line D-D of a single-use security tag with a tack, wedge, and rubber spring in accordance with one embodiment. FIG. 21 shows tack shank 106 further inserted into tack hole 807 and where pointed end 112 has contacted surface 1209S. The contact may force wedge 1202S to begin rotating counterclockwise approximately about edge 1215S, and edge 1216S to slide slightly to the left on surface 808*a*. It is worthy to note that wedge 1202S does not necessarily rotate exactly about the rest condition contact point of edge 1215S and back wall 803D. There may be a small movement of the contact point as angle Ø changes. The movement on back wall 803D may comprise, for example, 0.002 inches in total when the wedge angle moves from 22° to 40°. The movement may slightly effect the initial additional tack clearance. Pointed end 112 may slide across surface 1209S such that it makes contact with tack retaining edge 1213S. Rubber spring 1302 may compress slightly more between wedge 1202S and surface 1111B. The single-use tack retaining system may not yet enter into a locked condition since tack assembly 102 could still be retracted from security tag 100.

Figure 22:
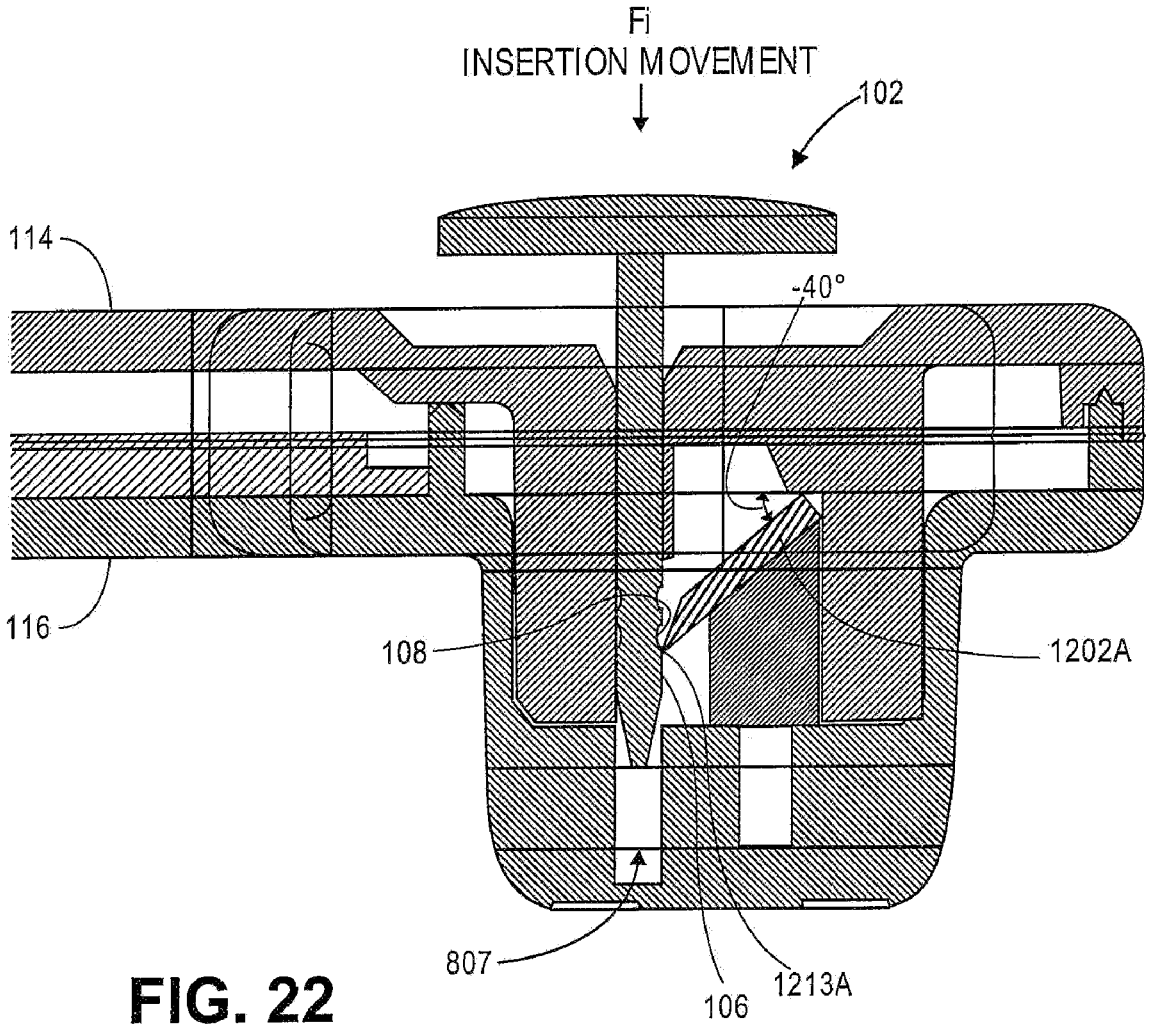
FIG. 22 illustrates a third view of a cross-section taken along line D-D of a single-use security tag with a tack, wedge, and rubber spring in accordance with one embodiment.

FIG. 22 illustrates a third view of a cross-section taken along line D-D of a single-use security tag with a tack, wedge, and rubber spring in accordance with one embodiment. FIG. 22 shows tack shank 106 inserted further into tack hole 807 until tack shank 106 makes contact with, and begins to slide by, tack retaining edge 1213S. Further insertion of tack shank 106 may cause tack retaining edge 1213S to become adjacent to a first tack groove 108. While tack retaining edge 1213S is in contact with tack shank 106, there may be no further counterclockwise rotation of wedge 1202S. The wedge angle Ø is approximately 40°. The single-use tack retaining system may not yet be in a locked condition since tack assembly 102 could still be retracted from security tag 100.

Figure 23:
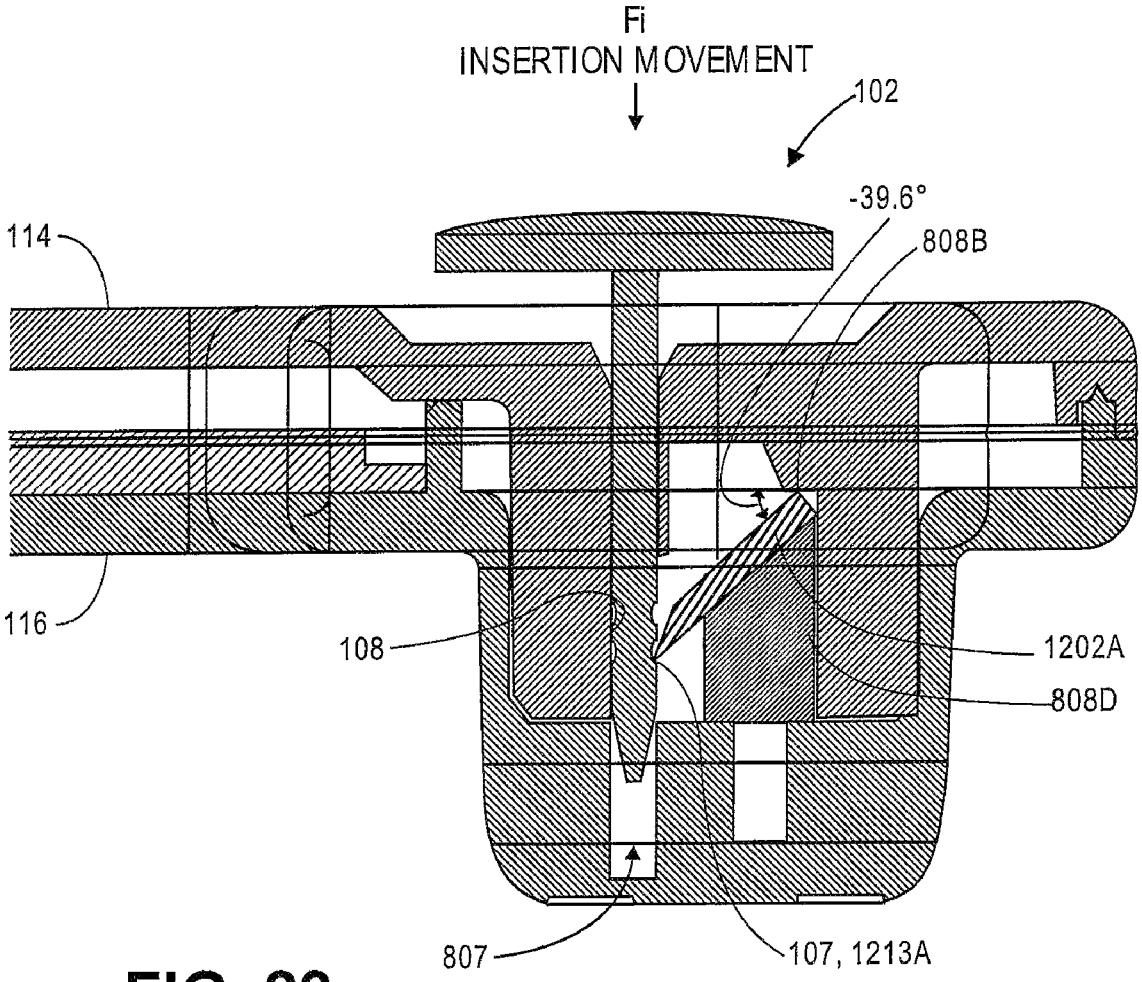
FIG. 23 illustrates a fourth view of a cross-section taken along line D-D of a single-use security tag with a tack, wedge, and rubber spring in accordance with one embodiment.

FIG. 23 illustrates a fourth view of a cross-section taken along line D-D of a single-use security tag with a tack, wedge, and rubber spring in accordance with one embodiment. FIG. 23 shows tack shank 106 inserted further into tack hole 807 until tack groove 108 is adjacent to tack retaining edge 1213S. At this point, the bias of rubber spring 1302 between wedge 1202S and walls 1111B and 808D may force tack retaining edge 1213S into tack groove 108 via a clockwise rotation of wedge 1202S. Wedge angle Ø is approximately 39.6°. Edge 1216S is approximately 0.019 inches from back wall 808D and approximately 0.013 inches from ledge 808*b*. Attempts to retract tack assembly 102 from security tag 100 are now prevented by wedge 1202S as previously described. Tack retaining edge 1213S pointed tip end is now biased into the intersection of groove lip 107 and tack groove 108 thus restraining the tack 102 from being extracted from the tag 100. The single-use tack retaining system is now in a locked condition.

In one embodiment, tack assembly 102 may be removed or detached from security tag 100 as implemented with a single-use tack retaining system through use of magnetic detaching device 602. In order to detach tack assembly 102 from security tag 100, security tag 100 should be seated or nearly seated in magnetic detaching device 602. The affects of magnetic detaching device 602 on the single-use tack retaining system to detach tack assembly 102 from security tag 100 may be described in more detail with reference to FIGS. 24-30.

Figure 24:
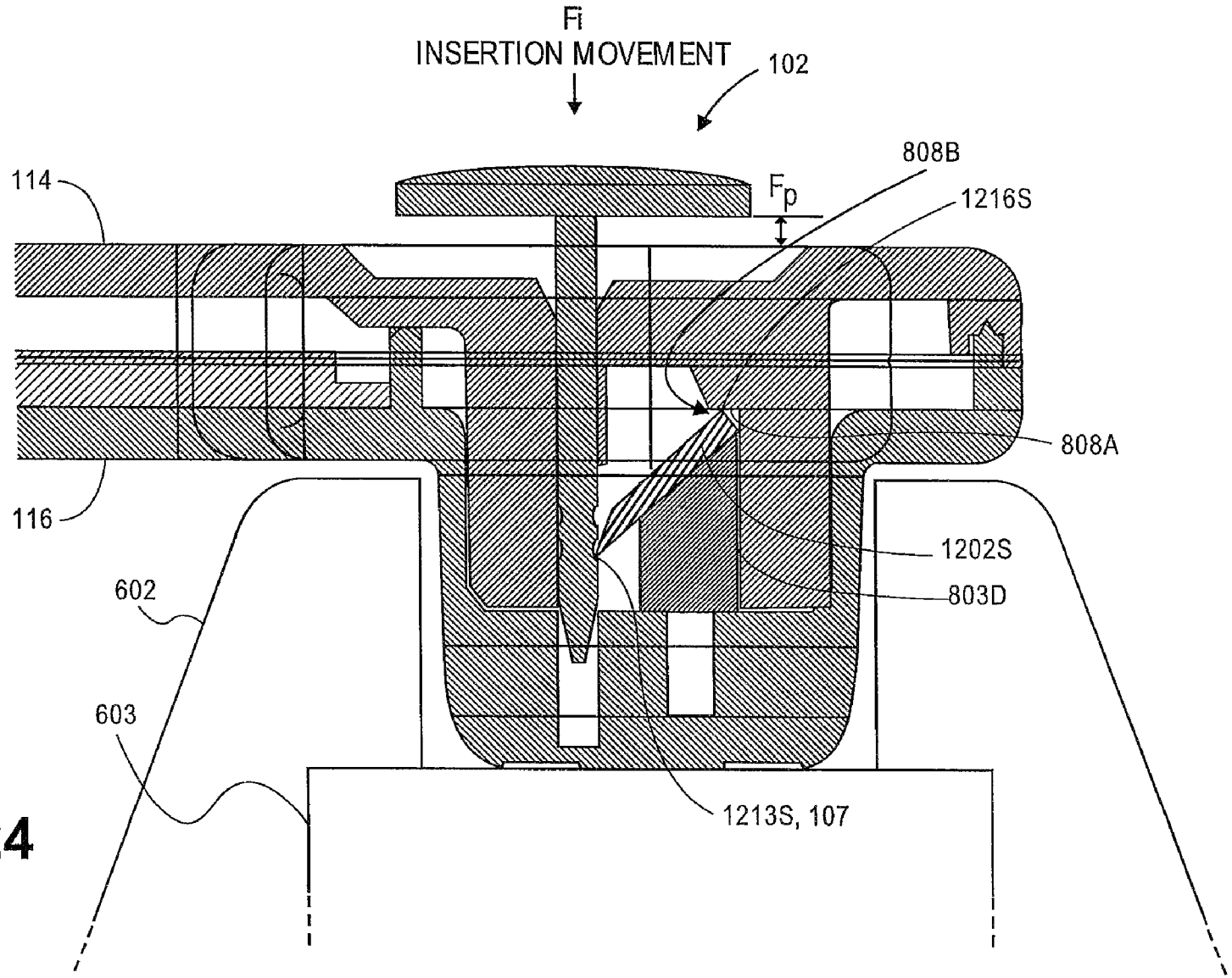
FIG. 24 illustrates a first view of a cross-section taken along line D-D of a single-use security tag with a tack, wedge, rubber spring, and a magnetic detaching device in accordance with one embodiment.

FIG. 24 illustrates a first view of a cross-section taken along line D-D of a single-use security tag with a tack, wedge, rubber spring, and a magnetic detaching device in accordance with one embodiment. FIG. 24 shows the same partial cross section of FIG. 23 but as seated in magnetic detaching device 602. Further, assume sufficient Fp has been applied to hold the position of wedge 1202S in the locked condition when tag 100 is placed in magnetic detacher 602. When Fp is removed, detachment begins. Magnetic detaching device 602 begins to attract wedge 1202S against the bias of rubber spring 1302, thereby urging wedge 1202S to rotate counterclockwise approximately about edge 1215S, and urging translation of edge 1216S to the left on sloped surface 808*a* towards ledge 808*b*.

The condition shown in FIG. 24 may occur without applying Fp to hold the locked condition because sufficient Fp may already be applied by garment 202 when secured between tack head 104 and security tag 100. In some cases, when security tag 100 is placed within magnetic detaching device 602, an insertion force Fi may be applied to tack head 104 to move tack shank 106 into security tag 100 with sufficient depth to allow groove lip 107 to release tack retaining edge 1213S so that detaching can occur. In some cases, for example, tack shank 106 may need to be pushed or moved approximately 0.004 inches to release tack retaining edge 1213S. The occasional use of addition insertion force Fi to assist detachment typically exists to some extent for all magnetic clutches. In the vast majority of detachments, however, merely placing security tag 100 in magnetic detaching device 602 will be sufficient to cause the single-use tack retaining system to attain a permanent unlock condition.

Figure 25:
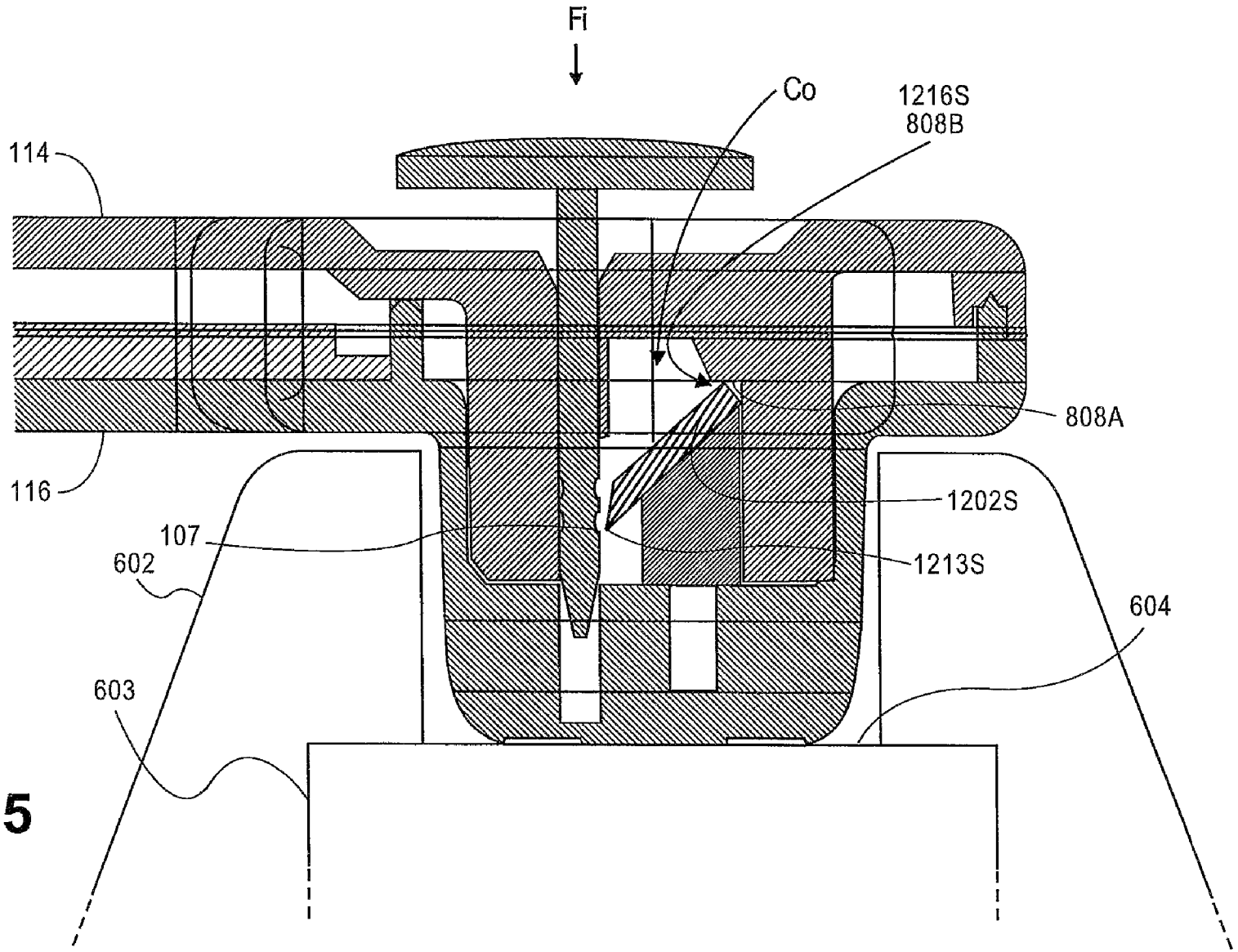
FIG. 25 illustrates a second view of a cross-section taken along line D-D of a single-use security tag with a tack, wedge, rubber spring, and a magnetic detaching device in accordance with one embodiment.

FIG. 25 illustrates a second view of a cross-section taken along line D-D of a single-use security tag with a tack, wedge, rubber spring, and a magnetic detaching device in accordance with one embodiment. FIG. 25 shows the effect of an attractive force from magnetic assembly 603 on wedge 1202S. The magnetic attractive force may cause wedge 1202S to compress rubber spring 1302 slightly more than shown in FIG. 24, and tack retaining edge 1213S may be rotated slightly out from under groove lip 107 and drawn slightly toward magnetic assembly pole surface 604. Virtually at the same instant, edge 1216S may move across surface 808*a* to ledge 808*b*. It is worthy to note that with the reusable tack retaining system, the lateral movement of wedge edge 1216R across surface 808*a* is prevented since axle protrusions 1221R and 1222R are restricted from lateral movement by their respective recesses 821 and 822.

Figure 26:
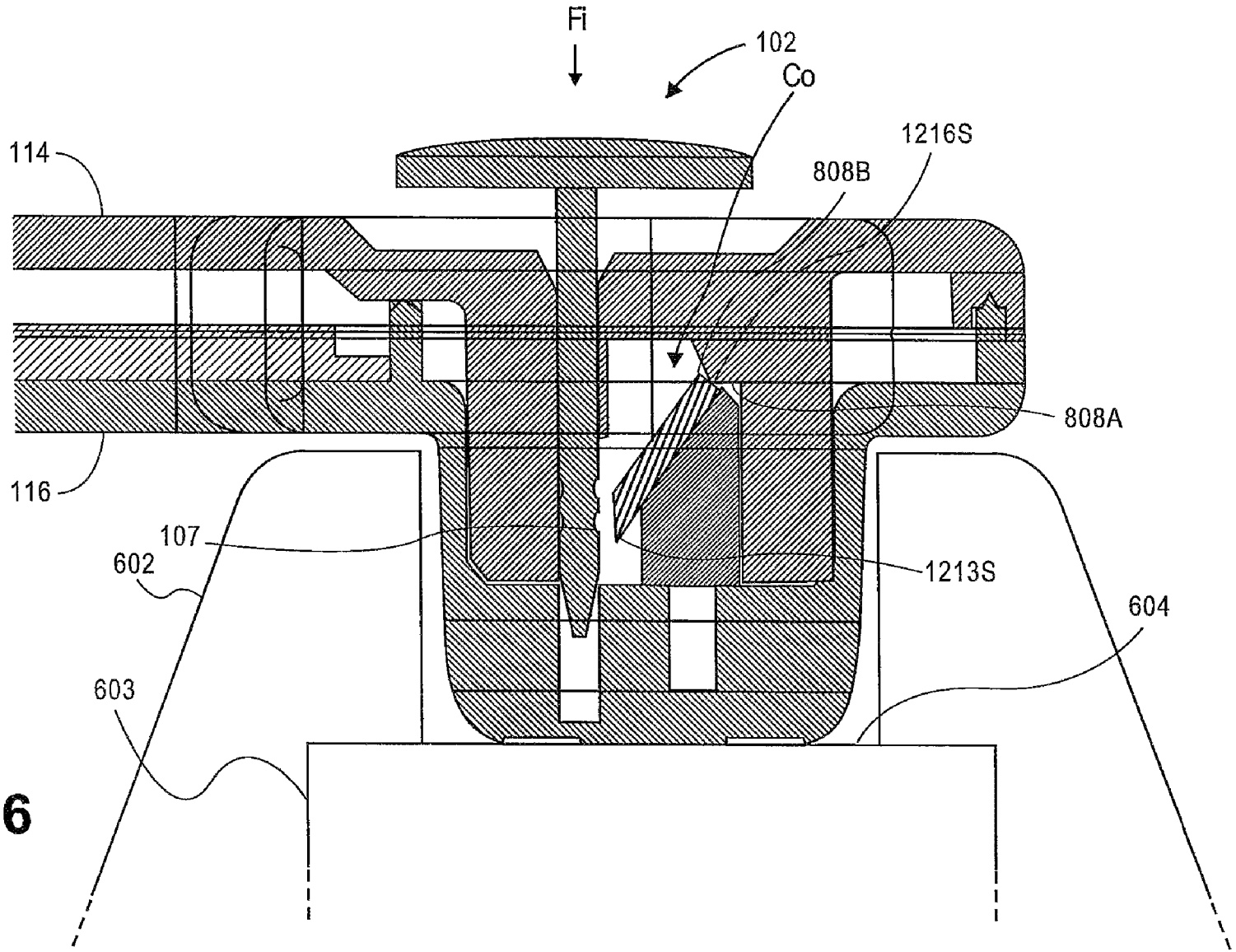
FIG. 26 illustrates a third view of a cross-section taken along line D-D of a single-use security tag with a tack, wedge, rubber spring, and a magnetic detaching device in accordance with one embodiment.

FIG. 26 illustrates a third view of a cross-section taken along line D-D of a single-use security tag with a tack, wedge, rubber spring, and a magnetic detaching device in accordance with one embodiment. FIG. 26 shows tack retaining edge 1213S of wedge 1202S being attracted toward magnetic assembly surface 604 while edge 1216S clears ledge 808*b*. In addition, rubber spring 1302 may begin to expand from the compressed condition shown in FIG. 25, which may push edge 1216S toward tack assembly 102.

Figure 27:
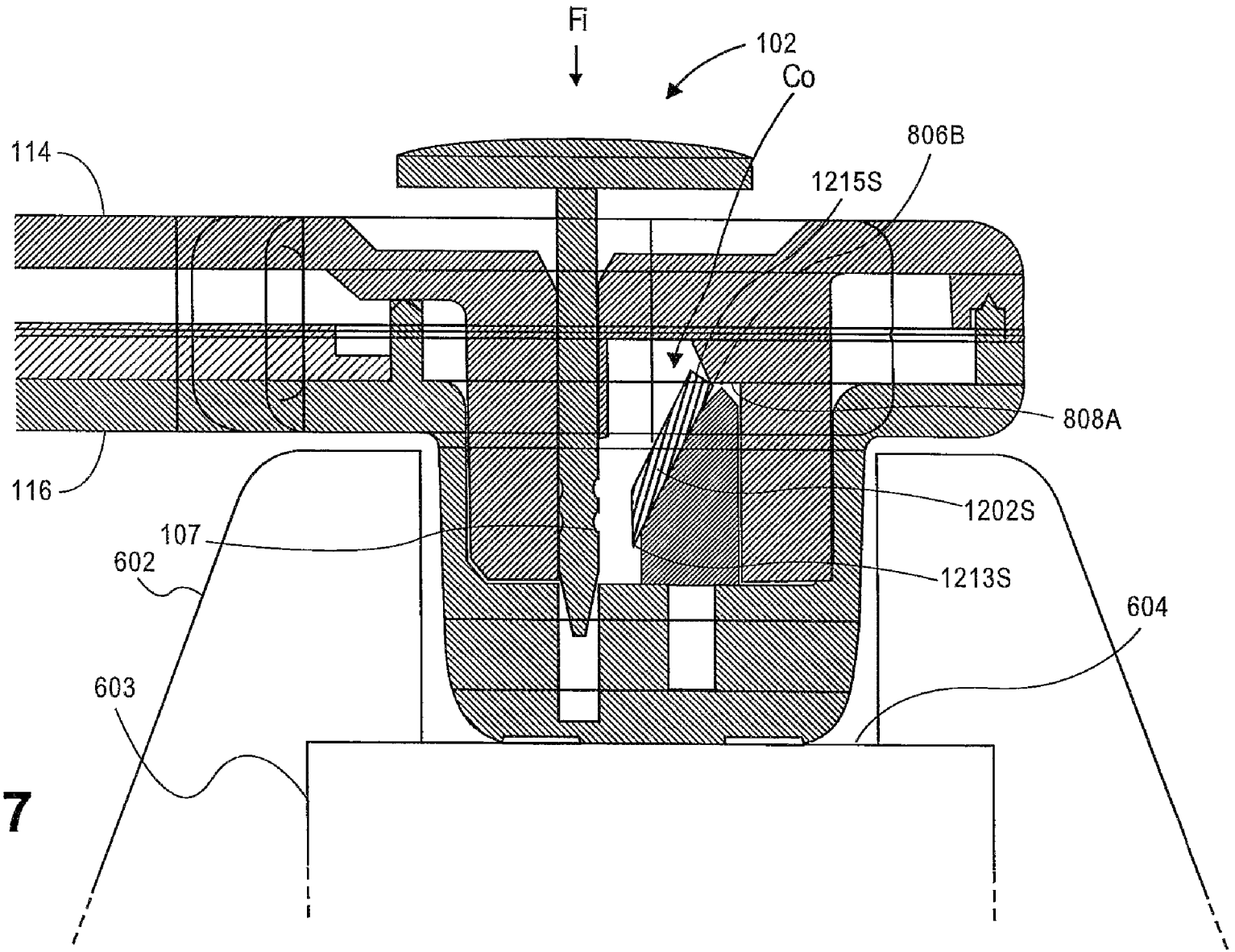
FIG. 27 illustrates a fourth view of a cross-section taken along line D-D of a single-use security tag with a tack, wedge, rubber spring, and a magnetic detaching device in accordance with one embodiment.

FIG. 27 illustrates a fourth view of a cross-section taken along line D-D of a single-use security tag with a tack, wedge, rubber spring, and a magnetic detaching device in accordance with one embodiment. FIG. 27 shows edge 1213S of wedge 1202S being attracted further toward magnetic assembly surface 604, while edge 1215S clears ledge 808*b*. Further, rubber spring 1302 may continue to expand further from the compressed condition shown in FIG. 26, which may push edge 1216S further toward tack assembly 102.

Figure 28:
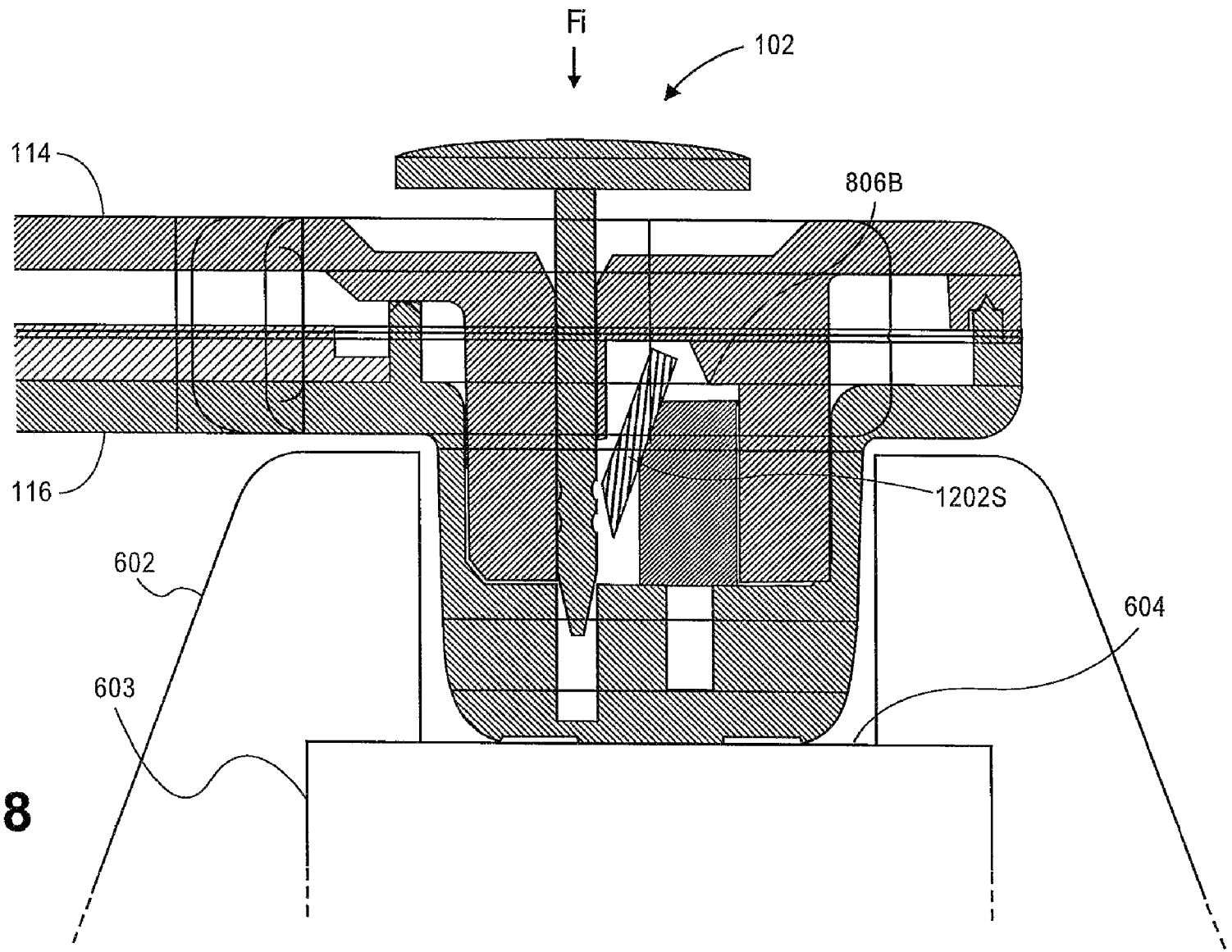
FIG. 28 illustrates a fifth view of a cross-section taken along line D-D of a single-use security tag with a tack, wedge, rubber spring, and a magnetic detaching device in accordance with one embodiment.

FIG. 28 illustrates a fifth view of a cross-section taken along line D-D of a single-use security tag with a tack, wedge, rubber spring, and a magnetic detaching device in accordance with one embodiment. FIG. 28 shows rubber spring 1302 in an expanded position which may help drive wedge 1202S to a substantially vertical position, while magnetic assembly 603 continues to attract tack retaining edge 1213S toward magnetic assembly surface 604, and drive wedge 1202S to a vertical position.

Figure 29:
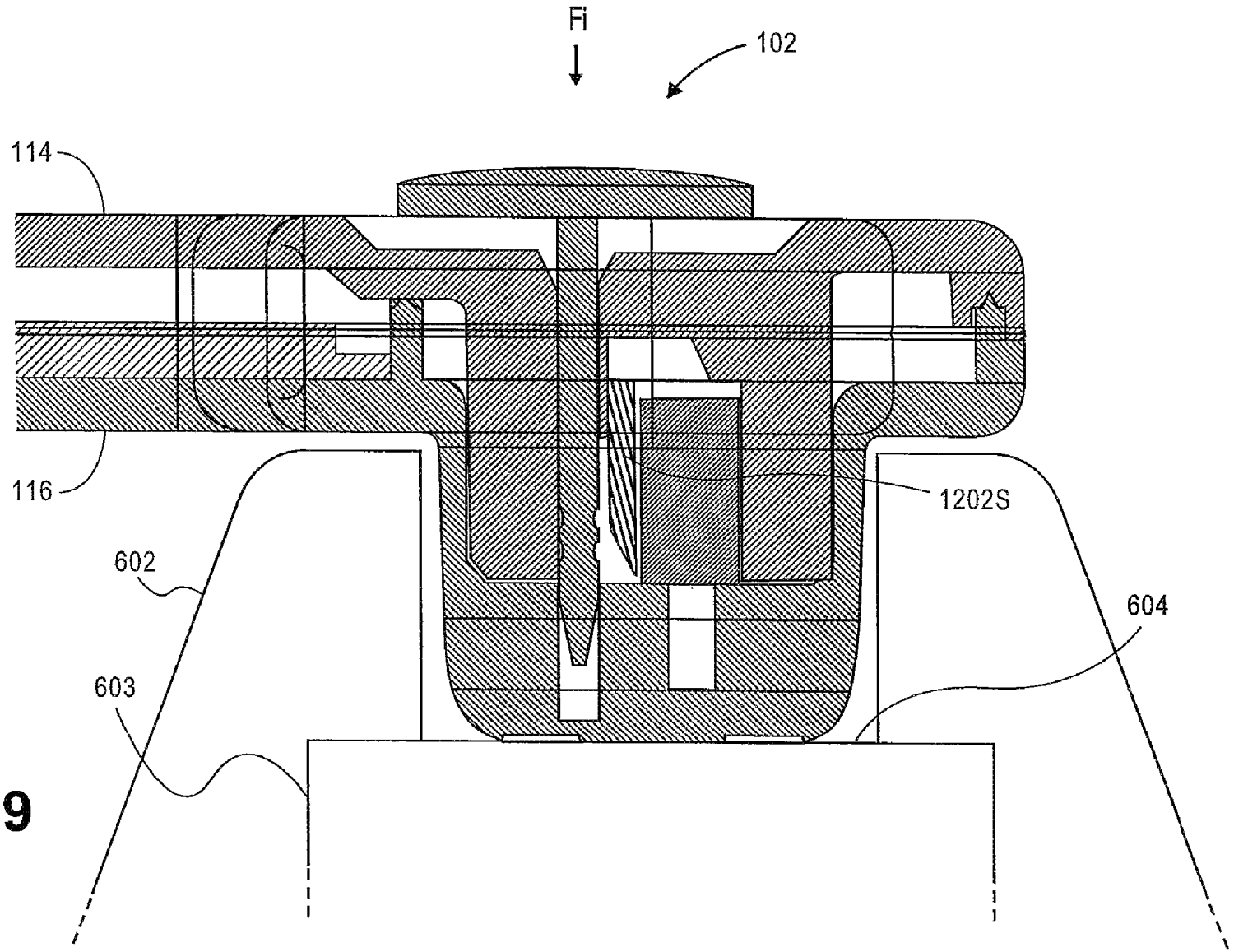
FIG. 29 illustrates a sixth view of a cross-section taken along line D-D of a single-use security tag with a tack, wedge, rubber spring, and a magnetic detaching device in accordance with one embodiment.

FIG. 29 illustrates a sixth view of a cross-section taken along line D-D of a single-use security tag with a tack, wedge, rubber spring, and a magnetic detaching device in accordance with one embodiment. FIG. 29 shows wedge 1202S in a substantially vertical position beside a fully expanded rubber spring 1302. Tack retaining edge 1213S is as close to pole surface 604 as possible, and is in contact with surface 1111B. Tack assembly 102 is completely free from impediment and can be retracted from security tag 100. Security tag 100 is now in a permanent unlock condition.

Figure 30:
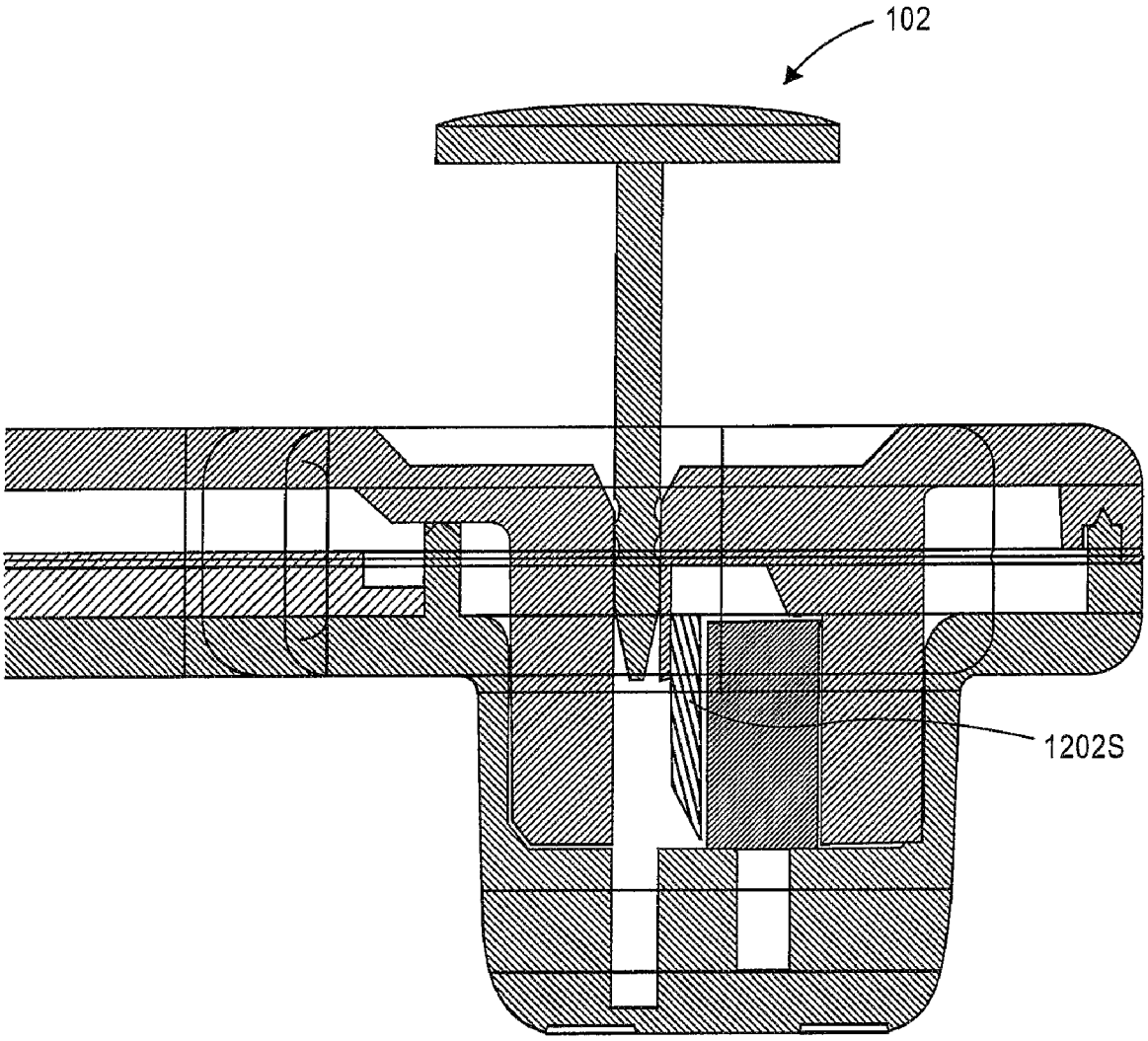
FIG. 30 illustrates a seventh view of a cross-section taken along line D-D of a single-use security tag with a tack, wedge, and rubber spring, in accordance with one embodiment.

FIG. 30 illustrates a seventh view of a cross-section taken along line D-D of a single-use security tag with a tack, wedge, and rubber spring, in accordance with one embodiment. FIG. 30 shows the same permanent unlock condition may exist when security tag 100 is removed from magnetic detaching device 602. Tack assembly 102 may be retracted before or after security tag 100 is removed from magnetic detaching device 602. In the configuration shown in FIG. 29 and FIG. 30, wedge 1202S cannot be restored to the rest condition of FIG. 20 for reuse without disassembling and rebuilding the security tag 100.

Figure 31:
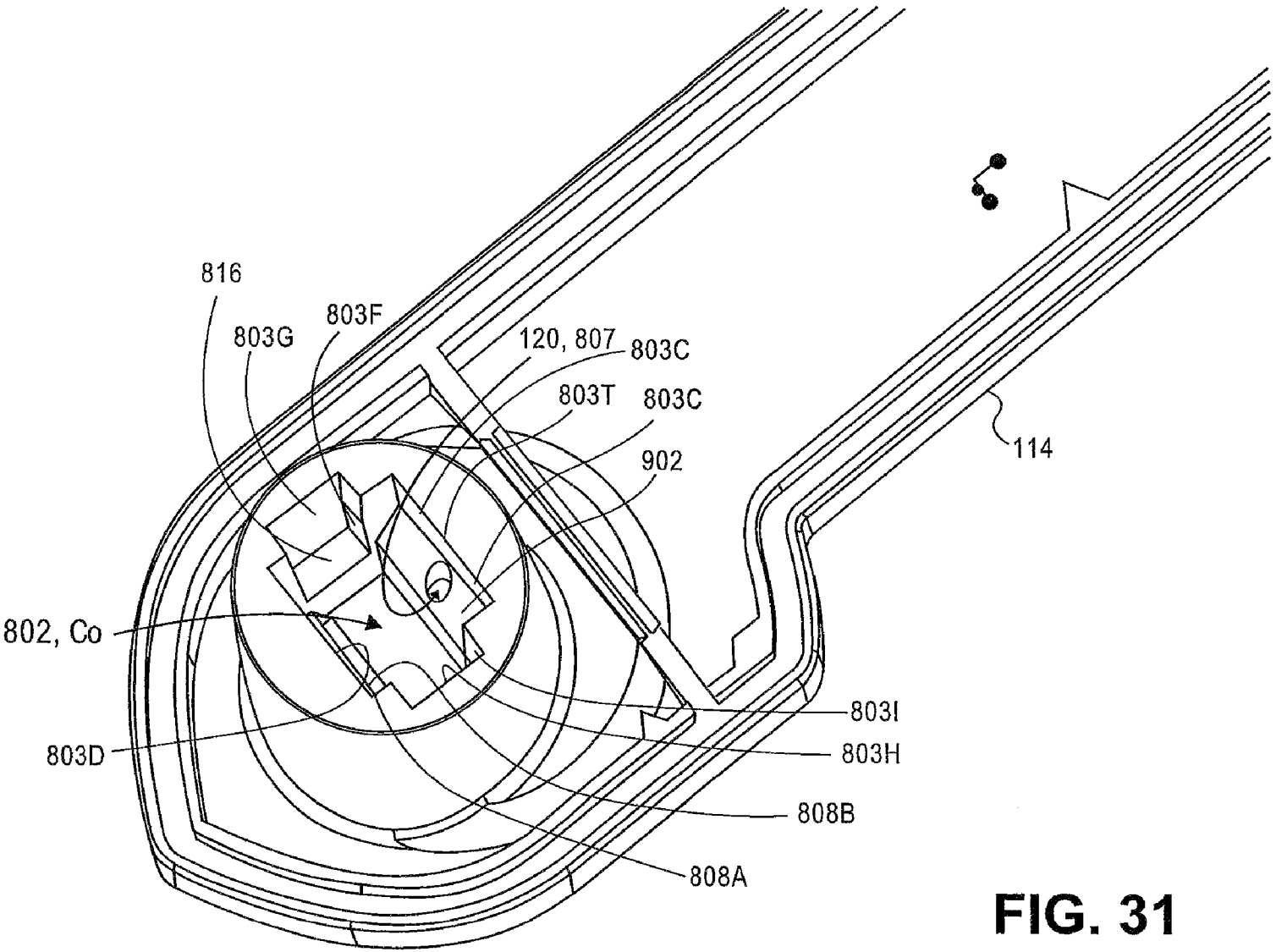
FIG. 31 illustrates an interior view of an upper housing for a single-use security tag in accordance with one embodiment.

FIG. 31 illustrates an interior view of an upper housing for a single-use security tag in accordance with one embodiment. FIG. 31 shows one possible configuration of the single-use tack retaining system compartment 802 to reduce or eliminate the effects of slamming. The identifiers of FIG. 31 are similar to those used for FIG. 9G for comparison purposes. It is worthy to note that the walls controlling the location of rubber spring 1302 have been moved so that rubber spring 1302 is essentially centered over the center of gravity of wedge 1202S. This configuration of wedge compartment 802 virtually eliminates the effects of slamming as defined earlier.

The embodiment of FIG. 8D yielded the Fp-ATC curve C in FIG. 10. The embodiment of FIG. 8D, although it has practical functionality when Fp values do not exceed about 20 pounds, values of Fp above 20 pounds create undesirable characteristics. Improvements to overcome these undesirable characteristics were made resulting in the tack retaining system embodiment of FIG. 9F. The outside appearance and basic functionality of the security tag 100 and the tack 102 did not change, but improvements have been introduced involving both the reusable version and the single-use version of the security tag 100. These improvements primarily involved means of increasing the Fpo and reducing the additional tack clearance for each value of Fp, but special attention was given to preventing defeat of the single-use version by "slamming" or "ratcheting".

Several "pull" tests were performed to verify that the changes made to the first tack retaining system embodiment of FIG. 8D resulting in the tack retaining system embodiment of FIG. 9F did indeed provide the improvements desired. All six pull tests and associated curve discussions that follow reflect on the improved tack retaining system embodiment depicted in FIGS. 9E, 9F, and 9G. Each pull was made on a Chatillon Model USTM machine at a pull rate of 3 inches per minute. Each of pull tests 1-6 involved pulls on four identical tags and tacks, with a first Fp pull to 15 pounds, a second Fp pull to 50 pounds, a third Fp pull to 100 pounds, and a fourth Fp pull to Fpo. Pull test 5 added two additional pulls; a fifth identical tag for a pull to an Fp of 25 pounds, and a sixth identical tag for a pull to an Fp of 120 pounds. Pull test 6 added two additional pulls as well; a fifth identical tag for a pull to an Fp of 25 pounds, and a sixth identical tag for a pull to an Fp of 140 pounds. The tag housings were made of ABS plastic or of polycarbonate plastic as discussed below. All resulting curves are shown in FIG. 10. All pull tests revealed that undesirable characteristics number (4), (5), and (6) were completely overcome by their respective remedies. Improvements to undesirable characteristics (1) and (2) are shown directly in the curves of FIG. 10, and an improvement to (3) is discussed for each pull test. The permanent ATC values are also discussed.

The result of pull test 1 is reflected in curve D. Curve D is typical for a single-use tack retaining system embodiment having an ABS plastic housing, a wedge hardness of RC 47, a tack hardness of RC 40. The Fp=15 lbs pull yielded a permanent ATC of 0.007 inches and a Fi of "0" pounds required to attain the free condition. The Fp=50 lbs pull yielded a permanent ATC of 0.025 inches and an Fi of 2 pounds required to attain the free condition. The Fp=100 lbs pull yielded a permanent ATC of 0.038 inches and an Fi of 5 pounds required to attain the free condition. The fourth pull yielded an Fpo of 110 pounds at an ATC of 0.097 inches.

The result of pull test 2 is reflected in curve E. Pull test 2 is essentially a repeat of pull test 1 except that a reusable wedge is used. The only significant difference is that the Fpo is 120 pounds. The extra 10 pounds can be attributed to the larger bearing surface against wall 808D that the reusable wedge has. The ATC at Fpo increased from 0.097 to 0.102 inches.

The result of pull test 3 is reflected in curve F. Pull test 3 is essentially a repeat of pull test 1 except that the housing material is the firmer polycarbonate plastic. Note the major difference is that the Fpo increased from 110 pounds to 130 pounds, and ATC increased from 0.097 to 0.104 inches. The permanent ATC improved about 20% at each Fp value, and Fi was about the same at each Fp value.

The result of pull test 4 is reflected in curve G. Pull test 4 is essentially a repeat of pull test 3 except that a reusable wedge is used. Note the major difference is that the Fpo increased from 130 pounds to 140 pounds, and ATC at Fpo increased from 0.104 to 0.107 inches.

The result of pull test 5 is reflected in curve H. Pull test 5 is essentially a repeat of pull test 1 except that the wedge hardness is approximately RC 42 and the tack hardness is approximately RC 48. An improvement in Fpo from 110 to 125 pounds was accomplished, and a reduction in ATC at Fpo from 0.097 to 0.082 inches was accomplished. The Fp=15 lbs pull yielded a permanent ATC of 0.008 inches and a Fi of "0" pounds required to attain the free condition. The Fp=25 lbs pull yielded a permanent ATC of 0.012 inches and an Fi of 0.4 pounds required to attain the free condition. The Fp=50 lbs pull yielded a permanent ATC of 0.020 inches and an Fi of 2 pounds required to attain the free condition. The Fp=100 lbs pull yielded a permanent ATC of 0.029 inches and an Fi of 5 pounds required to attain the free condition. The Fp=120 lbs pull yielded a permanent ATC of 0.034 inches and an Fi of 6 pounds required to attain the free condition. The sixth pull yielded an Fpo of 125 pounds at an ATC of 0.082 inches.

The result of pull test 6 is reflected in curve I. Pull test 6 is essentially a repeat of pull test 5 except that the housing material is the firmer polycarbonate plastic. An improvement in Fpo from 125 to 145 pounds was accomplished. The ATC at Fpo remained the same. The Fp=15 lbs pull yielded a permanent ATC of 0.004 inches and a Fi of "0" pounds required to attain the free condition. The Fp=25 lbs pull yielded a permanent ATC of 0.007 inches and a Fi of 0.5 pounds required to attain the free condition. The Fp=50 lbs pull yielded a permanent ATC of 0.012 inches and a Fi of 2 pounds required to attain the free condition. The Fp=100 lbs pull yielded a permanent ATC of 0.025 inches and a Fi of 5 pounds required to attain the free condition. The Fp=140 lbs pull yielded a permanent ATC of 0.026 inches and a Fi of 7 pounds required to attain the free condition. The sixth pull yielded an Fpo of 145 pounds at an ATC of 0.082 inches.

The pull test 6 results reflect all improvements to overcome the undesirable characteristics. Fpo is well above 125 pounds, the curve I is between curve A and curve B, and Fi requirements greatly improved. For example, for an Fp of 20 pounds the Fi reduced from 7 to less than 0.5 pounds, for an Fp of 50 pounds the Fi reduced from 15 to 2 pounds, for an Fp of 65 pounds the Fi required reduced from 35 to approximately 3 pounds. In summary, major enhancements in the curve C were made by the wedge stop, higher wedge angle when in locked condition, the firmer material, and the tack being harder than the wedge as described. Operational enhancements not seen on the curves included the following: (1) Fi improvement is primarily attributed to the wedge stop; (2) permanent ATC improved primarily due to using the firmer housing material, (3) ratcheting was reduced or eliminated by incorporating the sloped surface 808*a*, edge 808*b*, and the cored out area; (4) slamming was reduced or eliminated by relocating the rubber spring per FIG. 31; (5) after any strength of pull up to Fpo the tack will always re-catch the wedge, primarily due to the wedge stop; and (6) over-rotation reduced or eliminated by the wedge stop.

From these 6 pull tests performed, a reusable configuration suitable for a production environment may be derived. In one embodiment, for example, the following configuration and values may be used: (1) housing formed of polycarbonate plastic; (2) hardness of tack shank 106 is RC 47-50; (3) tack groove 108 and groove lip 107 should have a depth of 0.003 to 0.004 inches, groove length should be 0.040 inches minimum, and spacing should be approximately 0.040 inches; (4) wedge dimensions should be 0.235 inches to 0.240 inches wide, by 0.032 inches+/−0.001 inches thick, with axle protrusions 1221R and 1222R each being approximately 0.032 inch cubes (as illustrated in FIG. 12A), the angle of sharp edge 1220 should be 30°+/−1 degree and 0.236 inches to 0.242 inches long, and wedge 1202R should have a hardness of RC 40 to RC 43. The embodiments are not limited in this context.

Using the above configuration, the embodiment may have an Fp versus additional tack clearance curve (depicted as curve I in FIG. 10) that is almost linear for Fp from 0 to 145 pounds, additional tack clearance of approximately 0.080 inches at Fpo, and a rate of approximately 1800 pounds/inch. The limits for the rate and pullout value have, to the first order, been reached. Further tests have shown that using the above configuration, changing only to a tack hardness of RC50 to RC52 and a measured wedge hardness of RC45, the Fpo is typically 170 lbs at an ATC of typically 0.090 inches; and the same test using ABS plastic for the housing yields a typical Fpo of 150 lbs at an ATC of typically 0.090 inches.

Other improvements are also possible, but may have higher corresponding costs to consider. For example, although a firmer plastic such as polycarbonate might be used to reduce the plastic yield, the higher cost may not be justified because the slightly less Fpo (and slightly more additional tack clearance) of the softer and less expensive ABS plastic might be acceptable. An Fpo of approximately 125 pounds at an additional tack clearance of about 0.070 inches at an Fp of 100 pounds that is attainable using ABS plastic is better than most conventional reusable security tags. In another example, surface 1207R of wedge 1202R might be rounded to fit loosely into a rounded corner of intersection 803D and 808A. This may result in an increased Fpo by approximately 5 pounds, although the incremental increase may not justify the additional cost to round surface 1207R. The embodiments are not limited in this context.

Figure 32:
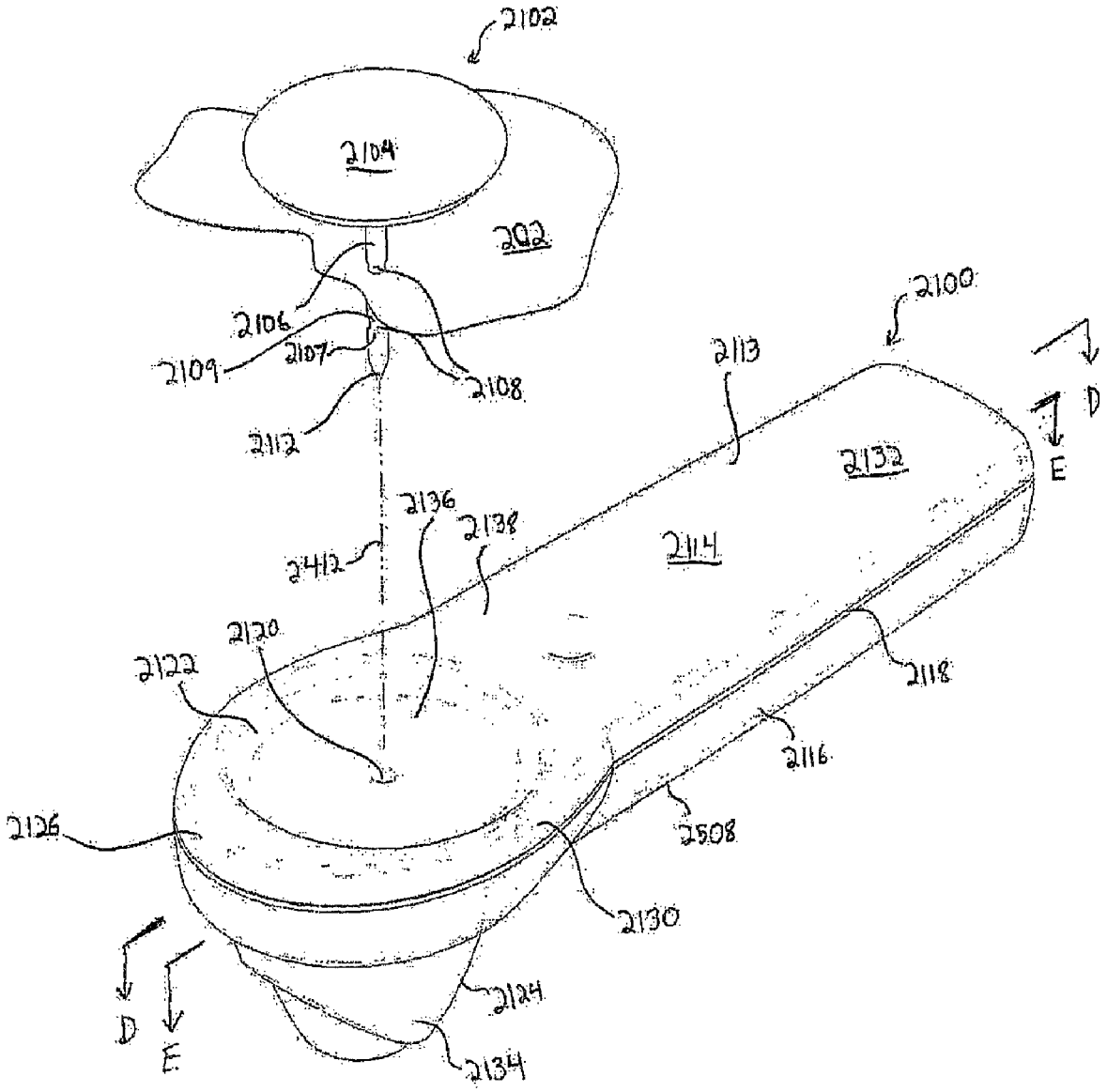
FIG. 32 illustrates a perspective view of a security tag, a tack assembly and an article in an unfastened position in accordance with one embodiment.
Figure 33:
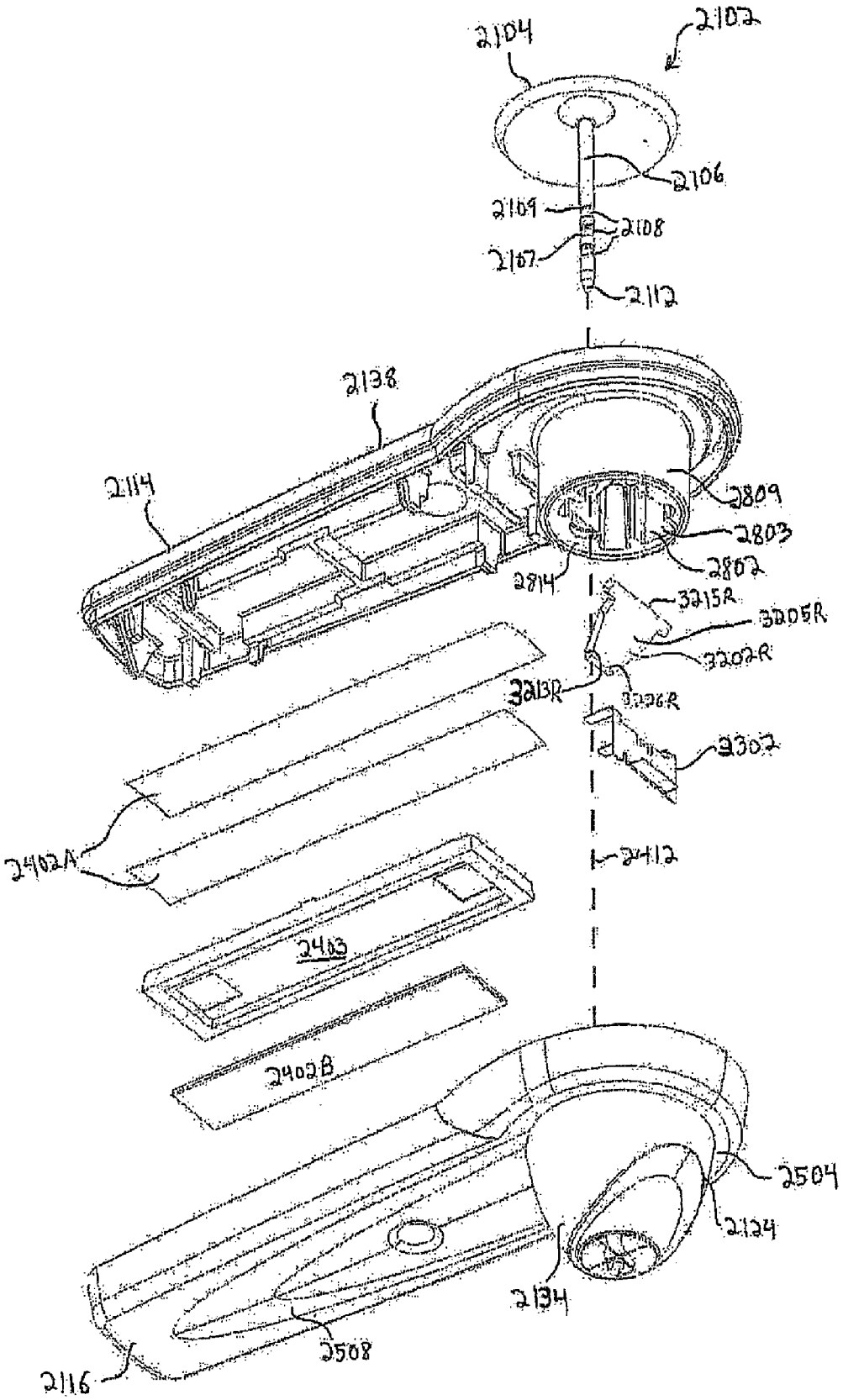
FIG. 33 illustrates a perspective view of a disassembled security tag in accordance with one embodiment.

FIG. 32 illustrates a perspective view of a security tag 2100, a tack assembly 2102, and an article 202 in an unfastened position, in accordance with one embodiment. FIG. 33 illustrates a perspective view of the tack assembly 2102 and a disassembled security tag 2100, in accordance with one embodiment.

Tack assembly 2102 in FIG. 32-33 (as well as one or more of FIGS. 42-44 and 46-55) may have portions corresponding to those of one or more of the embodiments of tack assembly 102, respectively, as described above with respect to FIGS. 1-31. For example, tack assembly 2102 may include one or more elements 2104, 2106, 2107, 2108, 2109, and 2112 that respectively correspond, in various embodiments, to 104, 106, 107, 108, 109, and 112 of tack assembly 102, though the design may be altered for one or more elements.

Security tag 2100 may include a housing 2113, tack retaining system, and sensor. We first refer to the sensor, as shown in the embodiment of FIG. 33. The sensor may include one or more linear amorphous resonators 2402A and a magnetized bias 2402B in one embodiment, may be enclosed and secured within the housing 2113. A spacer 2403 may separate the one or more linear amorphous resonators 2402A and magnetized bias 2402B. In other embodiments, the sensor may be another type of sensor, such as any of the embodiments of sensor 402 described above, an RF, RFID, electromagnetic, ferrite assembly, or any combination of two or more of the aforementioned and any other electronic article surveillance (EAS) or other sensors.

Security tag 2100 in FIGS. 32-33 (as well as portions thereof shown in FIGS. 34-48) may also include different embodiments of elements of security tag 100, described above with respect to FIGS. 1-31. For example, in various embodiments, security tag 2100 may include a housing 2113 that includes upper and lower housings 2114 and 2116, respectively, which may have one or more elements 2118, 2120, 2122, 2124, 2126, 2130, 2132, 2134, 2136, 2138, 2504, 2508, 2802, 2807, 2808*a*, 2808A, 2809, 2814, 3110, 3111B, 3113, and 3115 that respectively correspond to elements 118, 120, 122, 124, 126, 130, 132, 134, 136, 138, 504, 508, 802, 807, 808*a*, 808A, 809, 814, 1110, 1111B, 1113, and 1115 of upper and lower housings 114 and 116 of security tag 100.

Additionally, line 2412 and cross section D-D in FIGS. 32-33 may correspond to line 412 and cross section D-D shown in, e.g., FIGS. 1 and 4-5, and described above.

Housing 2113 may include a wedge compartment 2802 delineated by walls 2803. The walls 2803 may be shaped such that the wedge compartment 2802 may receive the tack retaining system or a portion thereof. For example, in one embodiment, walls 2803 include one or more elements 2803C-2803D, 2803F-2803I, and 2803K-2803L, such as shown in FIG. 34 described below, which may respectively correspond to elements 803C-803D, 803F-803I, and 803K-803L of walls 803 of wedge compartment 802 of security tag 100 described herein.

Figure 34:
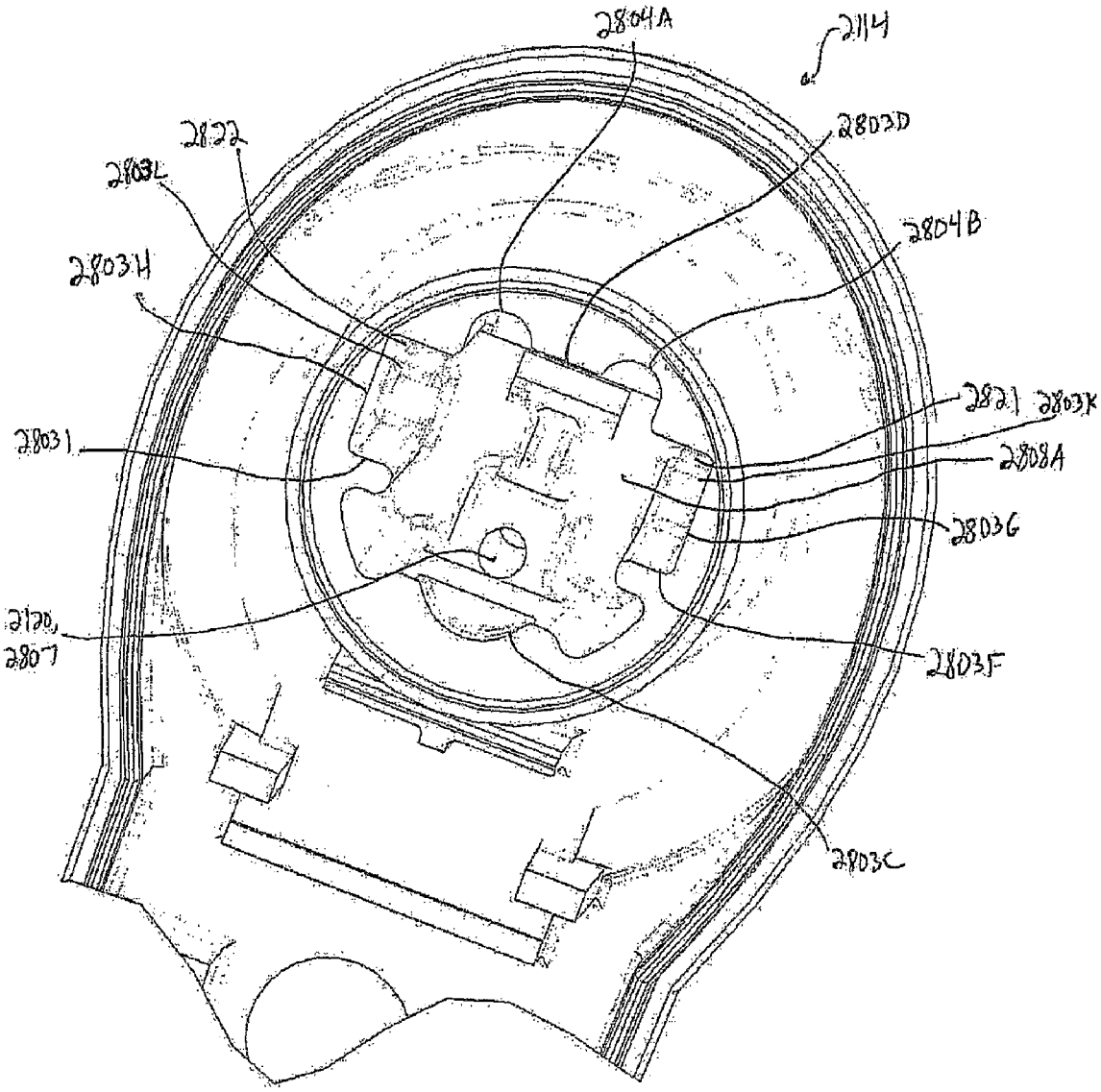
FIG. 34 illustrates an interior view of part of an upper housing of a security tag in accordance with one embodiment.

FIG. 34 illustrates an interior view of part of upper housing 2114 of a security tag 2100, in accordance with one embodiment. In this embodiment, walls 2803 may be shaped such that the wedge compartment 2802 may receive either reusable wedge 3202R or a single use wedge embodiment (which may be similar to wedge 3202R, with or without protrusions 3221R or 3222R) and may also receive either biasing member 3302 or 4302. Embodiments of wedge 3202R, the single use wedge, and biasing members 3302, 4302 are described below.

For example, in one embodiment, back wall 2803D may be contoured with back wall portions 2804A and 2804B that delineate recesses shaped similar to portions of biasing member 4302, such as described with respect to the embodiment of FIG. 38 below. In this embodiment, the back wall portions 2804A and 2804B may be concave and thus delineate convex recesses shaped similar to locating elements 4335A-4335B of biasing member 4302. Such an arrangement may facilitate positioning and/or securing of biasing member 4302 within wedge compartment 2802.

Walls 2803K and 2803L may at least partially delineate recesses 2821 and 2822, respectively. These elements 2803K, 2803L, 2821, and 2822 may respectively correspond to 803K, 803L, 821, and 822 of security tag 100 described herein. Thus, for example, in a reusable embodiment of security tag 2100, wedge 3202R (described below with respect to FIG. 36) of the tack retaining system includes protrusions 3221R and 3222R that may be at least partially disposed and may rotate, translate, move in a combination of rotation and translation, and/or otherwise move within recesses 2822 and 2821, respectively.

Figure 35:
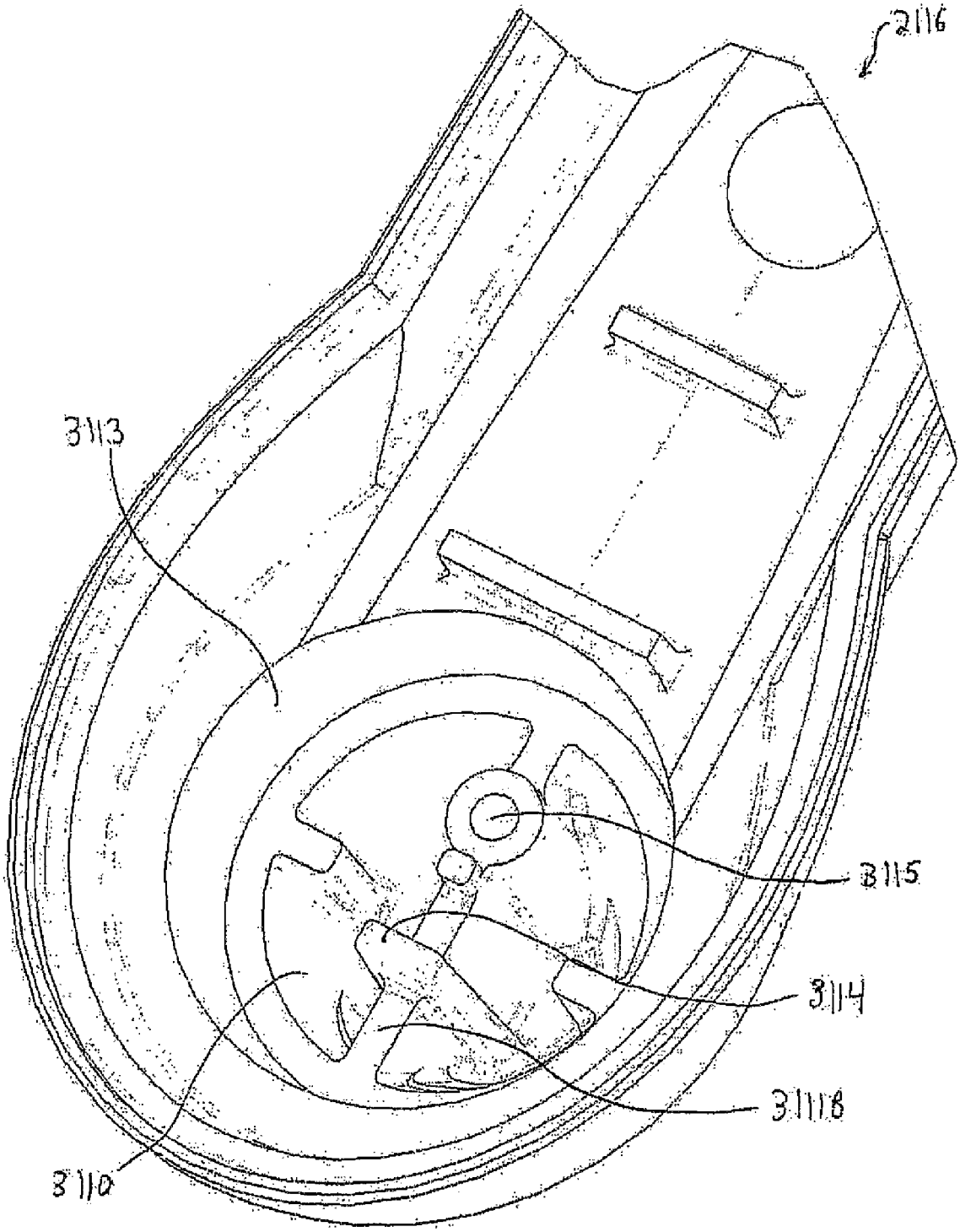
FIG. 35 illustrates an interior view of part a lower housing of a security tag in accordance with one embodiment.

FIG. 35 illustrates an interior view of part of lower housing 2116 of a security tag 2100, in accordance with one embodiment. As described with respect to the lower housing 116 of security tag 100 of FIGS. 1-31 for a biasing member that is a spring 1302, lower housing 2116 may have a corresponding pocket 3110 providing a bearing surface 3111B for a biasing member, such as biasing member 3302 or 4302 described in FIG. 37 or 38, respectively. Also, circular side wall 3113 may guide and secure circular protrusion 2809 of upper housing 2114 when upper housing 2114 and lower housing 2116 are joined together when assembling security tag 2100. Bearing surface 3111B may, in one embodiment, provide at least some of the force that restricts movement of either biasing member 3302 or 4302 out of position in a vertical direction, out of wedge compartment 2802, when a force is applied by wedge 3202R or another wedge, such as described herein. Lower housing 2116 may also include a bearing protrusion 3114 that may restrict movement of the biasing member 3302 or 4302 out of position in a lateral direction, across and within wedge compartment 2802, in response to the force applied to wedge 3202R or another wedge.

For example, bearing surface 3111B and possibly also a bearing protrusion 3114 may restrict movement of body 3304, but not leaf spring 3350, of biasing member 3302, which is shown in and described below with respect to FIG. 37. Where wedge 3202R is forced into rotation and/or other movement by force with tack shank 2106 such that security tag 2100 is in the locked condition, the resultant torque and other forces applied by wedge 3202R to leaf spring 3350 may rotate, deflect, bend, move with some combination of the three aforementioned movements, and/or otherwise move leaf spring 3350, which may apply like opposing forces onto wedge 3202R. However, the body 3304 may be restricted to little or negligible movement because the bearing surface 3111B and bearing protrusion 3114 (along with other surfaces corresponding to those described with respect to security tag 100) may offset those wedge 3202R forces with normal and friction forces, etc.

The tack retaining system of security tag 2100 may include a wedge, such as wedge 3202R or a single-use wedge (such as 3202R with or without protrusions 3221R and 3222R, as described below), and a biasing member, such as any embodiment of biasing member 1302 described above or biasing member 3302 or 4302 described below.

Figure 36:
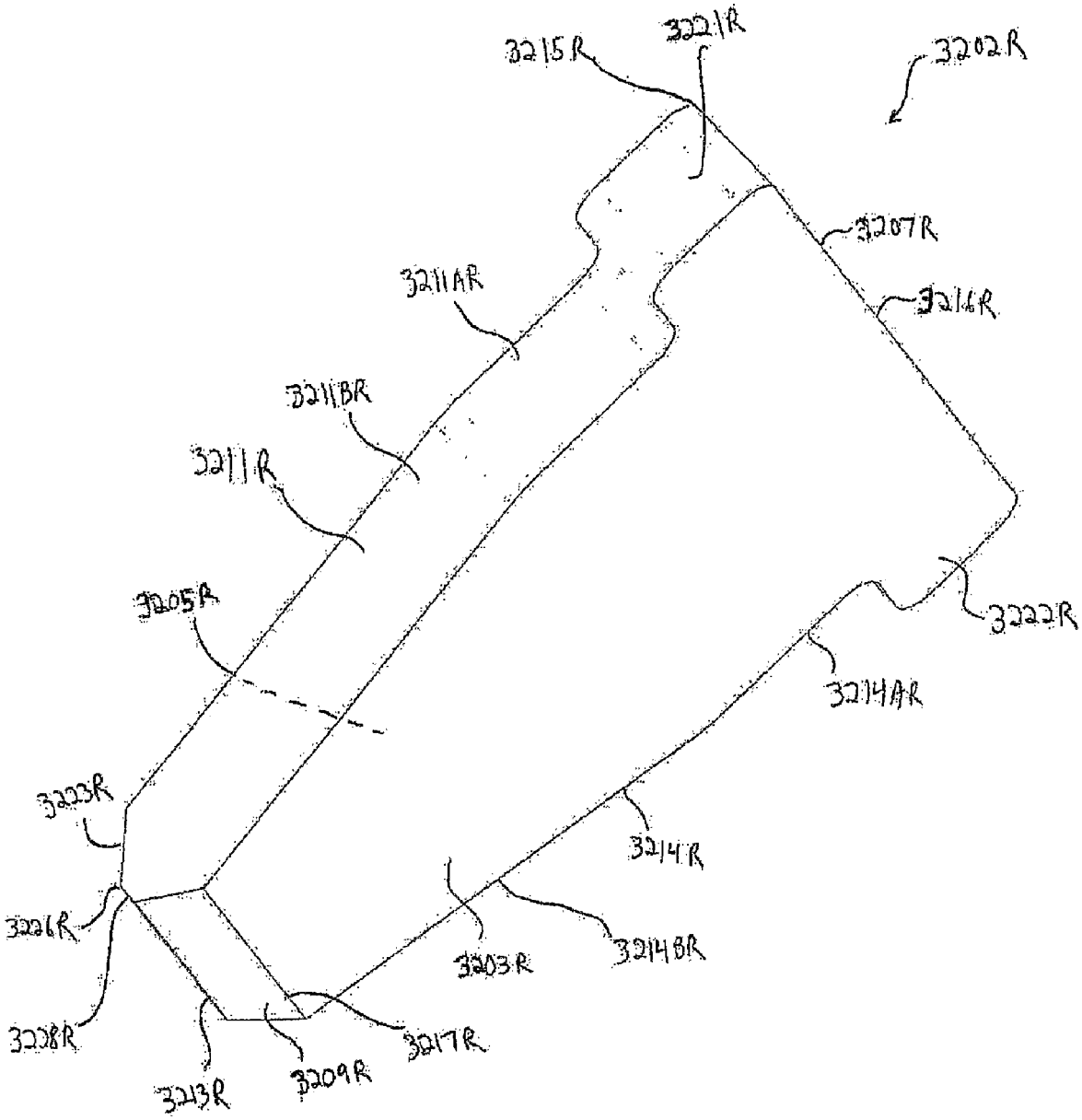
FIG. 36 illustrates a perspective view of a wedge for a security tag in accordance with one embodiment.

FIG. 36 illustrates a perspective view of a wedge 3202R of a tack retaining system for a security tag 2100, in accordance with one embodiment. Wedge 3202R may be for a reusable tack retaining system and thus a reusable security tag 2100, such as described above with respect to the tack retaining system embodiments of security tag 100 including wedge 1202R. Wedge 3202R may be magnetically attractable, such as described with respect to wedge 1202 herein and/or such that wedge 3202R comprises or is formed of a magnetic material such as iron, nickel, or cobalt, or an alloy of iron, nickel, or cobalt. For example, in one embodiment, wedge 3202R includes steel, such as hardened carbon steel. In another embodiment, wedge 3202R includes one or more magnetic materials and also one or more nonmagnetic materials.

In various embodiments, elements 3203R, 3205R, 3207R, 3209R, 3211R, 3214R, 3215R, 3216R, 3217R, 3221R, and 3222R of wedge 3202R may respectively correspond to 1203R, 1205R, 1207R, 1209R, 1211R, 1214R, 1215R, 1216R, 1217R, 1221R, and 1222R of wedge 1202R.

However, in one embodiment, wedge sides 3211R and 3214R may taper toward the tack retaining portion, which may include one or more edges (along with the surfaces forming the edges) of wedge 3202R that engage a tack lip 2107 and possibly another surface of tack groove 2108 of tack 2102 when the security tag 2100 is in the locked condition. As an example of such tapering, wedge sides 3211R and 3214R may respectively include substantially planar portions 3211AR and 3214AR, which may be parallel or close to parallel to each other, and also substantially planar portions 3211BR and 3214BR, which each may taper toward the tack retaining portion. In other embodiments, the wedge sides 3211R and 3214R may be substantially parallel, such as sides 1211R and 1214R of wedge 1202R shown in FIG. 12A above, or may be otherwise shaped.

In another embodiment, inclined surface 3209R of wedge 3202R may not form an edge with wedge surface 3205R (unlike tack retaining edge 1213R formed by the intersection of inclined surface 1209R and wedge surface 1205R in the wedge 1202R embodiment shown in FIG. 12A). Instead, wedge 3202R may include inclined surface 3223R, which may extend from wedge surface 3205R to or near the edge 3213R of inclined surface 3209R.

Figure 43:
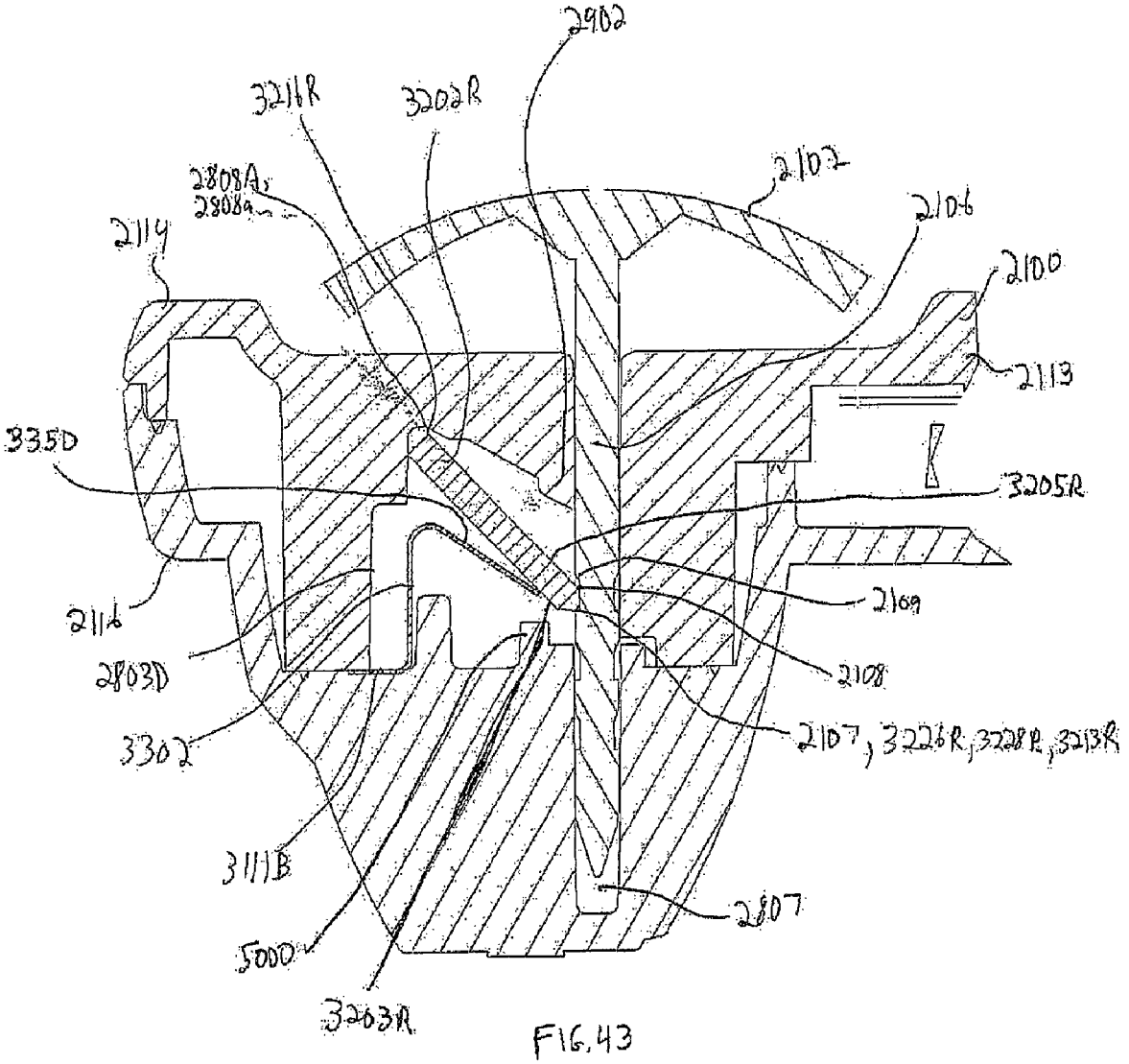
FIG. 43 illustrates a second partial view of a cross-section taken along line D-D of FIG. 32 of a reusable security tag and a tack in accordance with one embodiment.

For example, in one embodiment, inclined surface 3223R extends between wedge surface 3205R and edge 3226R. Front side 3228R may extend between edges 3213R and 3226R, and may be perpendicular or close to perpendicular to one or more of wedge surfaces 3203R, 3205R, 3211AR, and 3214AR, and/or may be parallel or close to parallel to 3207R. Surface 3209R may form a first chamfer on the tack retaining portion, surface 3223R may form a second chamfer, and the front side 3228R of the tack retaining portion may extend between these chamfers and be bounded by tack retaining edges 3213R and 3226R. This tack retaining portion with two chamfers may at least partially extend into a groove 2108 of tack shank 2106 of tack assembly 2102 when the security tag 2100 and tack assembly 2102 are in the "locked condition," such as shown in the embodiment of FIG. 43. In the locked condition, the tack retaining portion having two chamfers may be adjacent the lip 2107 of that groove 2108. For example, in one embodiment, edge 3213R of the tack retaining portion abuts that lip 2107. In that embodiment, edge 3226R may abut the groove 2108 surface extending between the lips 2107 and 2109 of the groove 2108.

In another embodiment, the two chamfers meet at an edge, and thus chamfered wedge surfaces 3209R and 3223R intersect such that edges 3213R and 3226R are coincident and the tack retaining portion is triangular in cross section. In such case, the coincidentally formed edge may be positioned adjacent a lip 2107 of a tack groove 2108 in the locked condition, such as described with respect to the tack retaining edge 1213R of FIG. 12A.

In another embodiment, edges 3213R and 3226R may be rounded off such that wedge surfaces 3209R, 3223R, and 3228R together form a curved tack retaining portion.

In one embodiment, wedge 3202R, including wedge surfaces 3209R and 3223R, are configured such that wedge 3202R is substantially symmetrical about a plane parallel to, and equidistant from, wedge surfaces 3203R and 3205R, and also about a plane parallel to, and equidistant from, wedge surface portions 3211AR and 3214AR. This wedge 3202R embodiment is referred to herein as a "symmetrical wedge." In various embodiments, this symmetry may apply to a wedge 3202R having any of the three aforementioned tack retaining portions (chamfered, triangular, curved) or any configuration of a tack retaining portion that may preserve the symmetry, such as any symmetrical tapering of surfaces 3203R/3205R and 3209R/3223R. For example, in an embodiment, 3209R and 3223R are not included, and 3203R and 3205R taper to front side 3228R or to a coincident edge.

In another embodiment, wedge 3202R includes only one chamfer, surface 3223R. In this embodiment, the front side 3228R of the tack retaining portion extends to surface 3203R such that the wedge 3202R does not have surface 3209R, and the single tack retaining edge 3213R may be formed by surfaces 3228R and 3203R.

In another embodiment, wedge 3202R has two tack retaining edges 3213R and 3226R formed in part by surfaces 3209R and 3223R, one or both surfaces of which are not chamfers, but instead are curved surfaces, such as, for example, convex, concave, a combination of convex and concave, or include any other curves forming at least part of the surfaces. Front side 3228R may be flat or any type of curve as well, in this and any of the aforementioned embodiments. In another embodiment, wedge 3202R has one tack retaining edge 3213R formed by surfaces 3228R and 3203R, one or both surfaces of which are curved surfaces.

In various embodiments, a tack retaining system for single use may include a wedge for single use, such as described above with respect to the tack retaining system embodiments including wedge 1202S, or may include 3202R. The single use wedge may include a wedge embodiment 3202R described above, with or without protrusions 3221R or 3222R. In an embodiment in which the single use wedge is wedge 3202R with protrusions 3221R and 3222R (and thus wedge 3202R), a biasing member used in the tack retaining system of security tag 2100 may not include locating elements or other elements that may restrict movement of protrusions 3221R and 3222R out of their respective recesses 2822 and 2821 in upper housing 2114 of security tag 2100.

Figure 46:
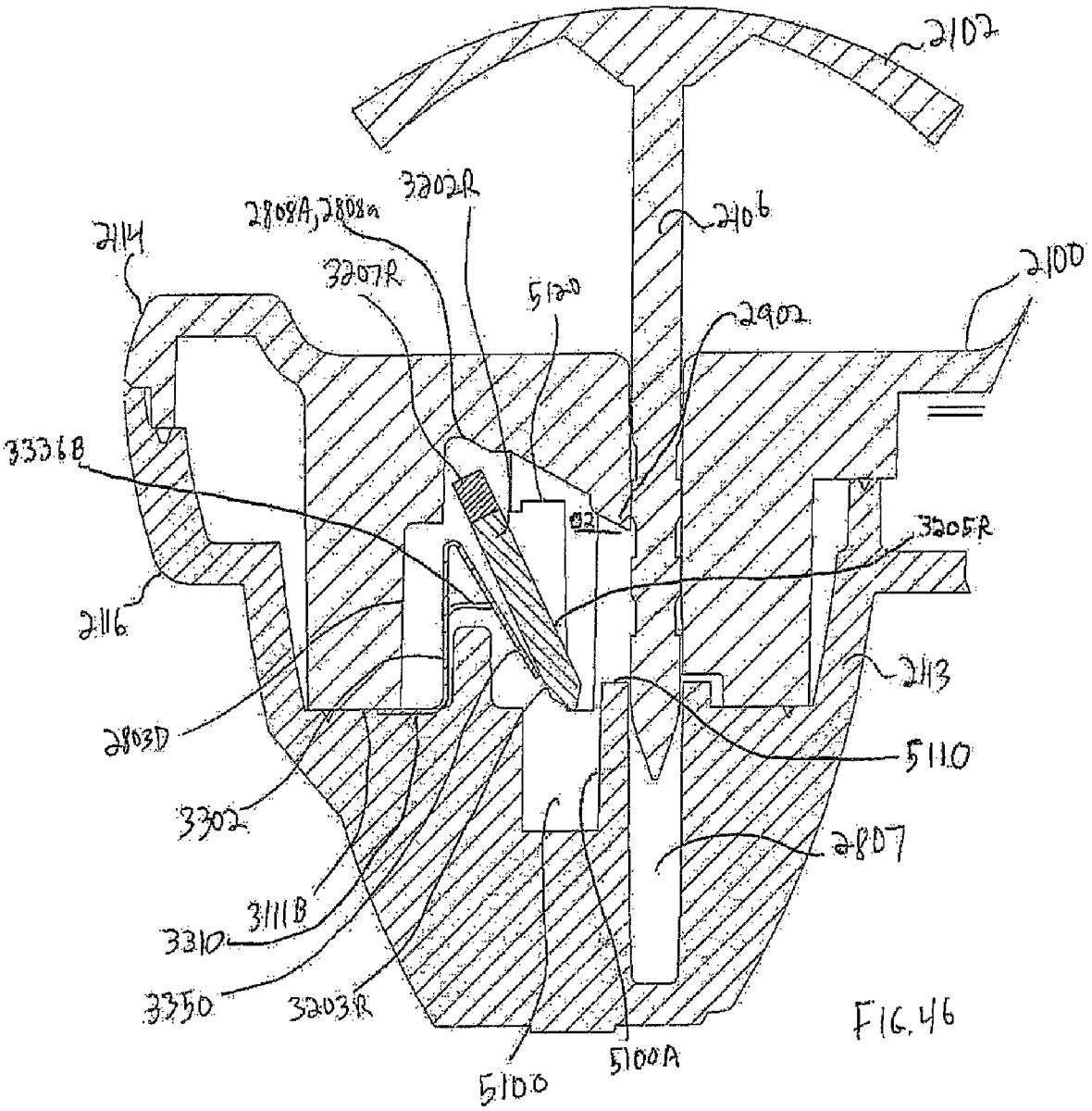
FIG. 46 illustrates a first partial view of a cross-section taken along line D-D of FIG. 32 of a single-use security tag and a tack in accordance with one embodiment.
Figure 47:
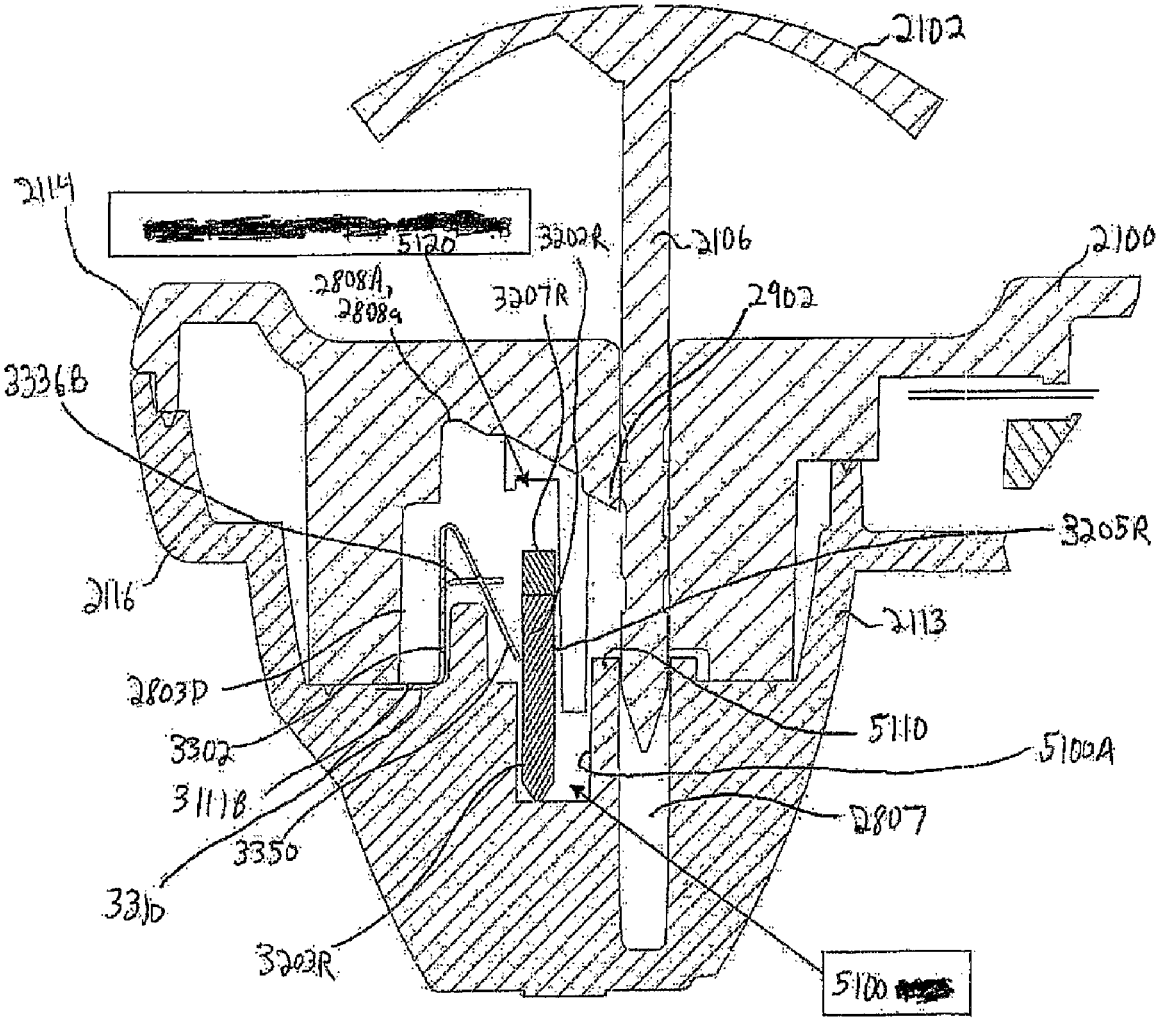
FIG. 47 illustrates a second partial view of a cross-section taken along line D-D of FIG. 32 of a single-use security tag and a tack in accordance with one embodiment.
Figure 48:
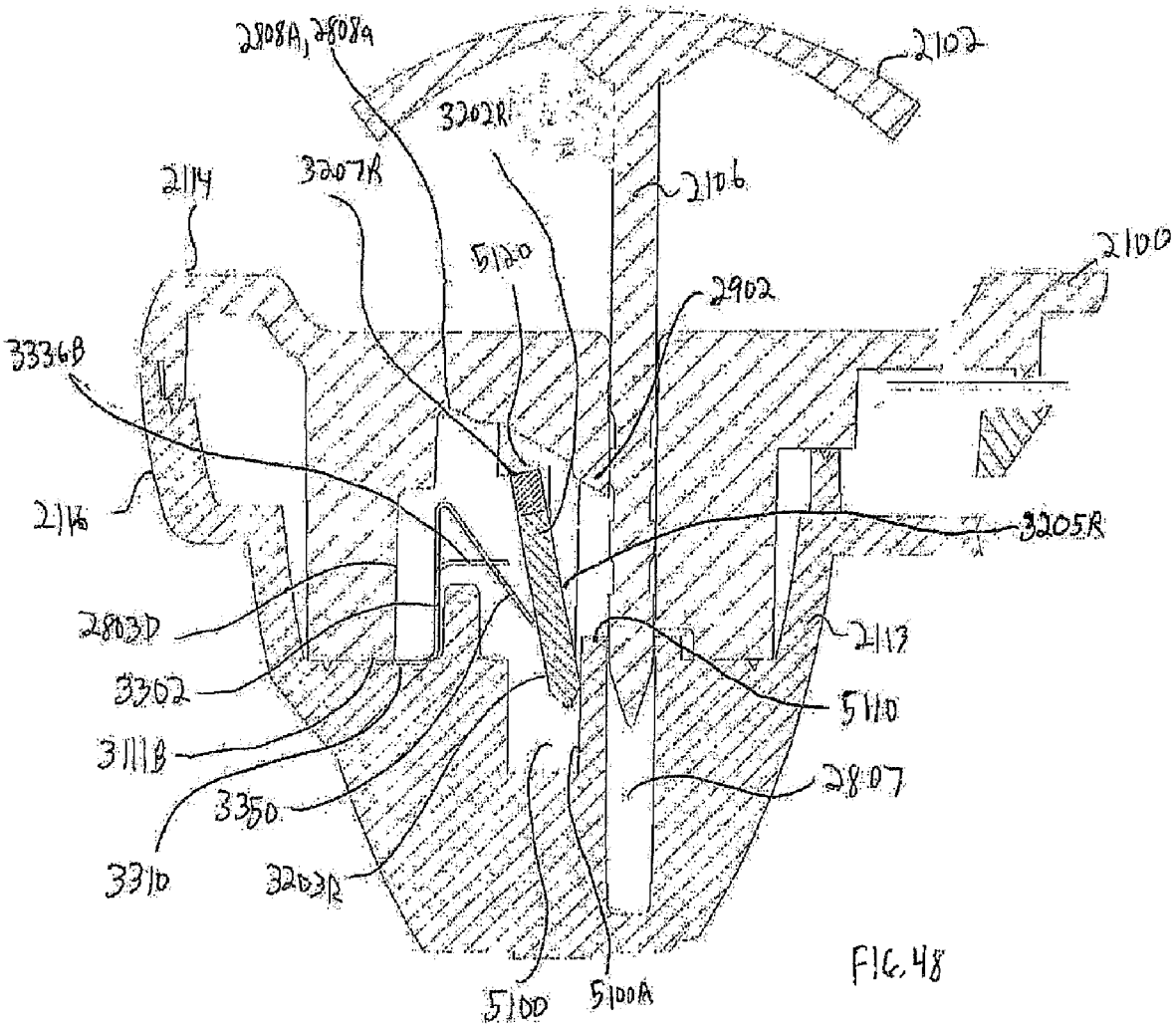
FIG. 48 illustrates a third partial view of a cross-section taken along line D-D of FIG. 32 of a single-use security tag and a tack in accordance with one embodiment.

Thus, for example, in a security tag 2100 including biasing member 3302, shown in FIG. 37 described below, biasing member 3302 may not have locating elements 3336A-3336B in one embodiment, or, as shown in the embodiments of FIGS. 46-48 described below, for example, these elements may be shaped and/or positioned to not restrict movement of protrusions 3221R and 3222R of wedge 3202R out of their respective recesses 2822 and 2821. In a security tag 2100 including biasing member 4302, shown in FIG. 38 described below, biasing member 4302 may correspondingly exclude or reconfigure its locating elements 4336A-4336B.

Figure 37:
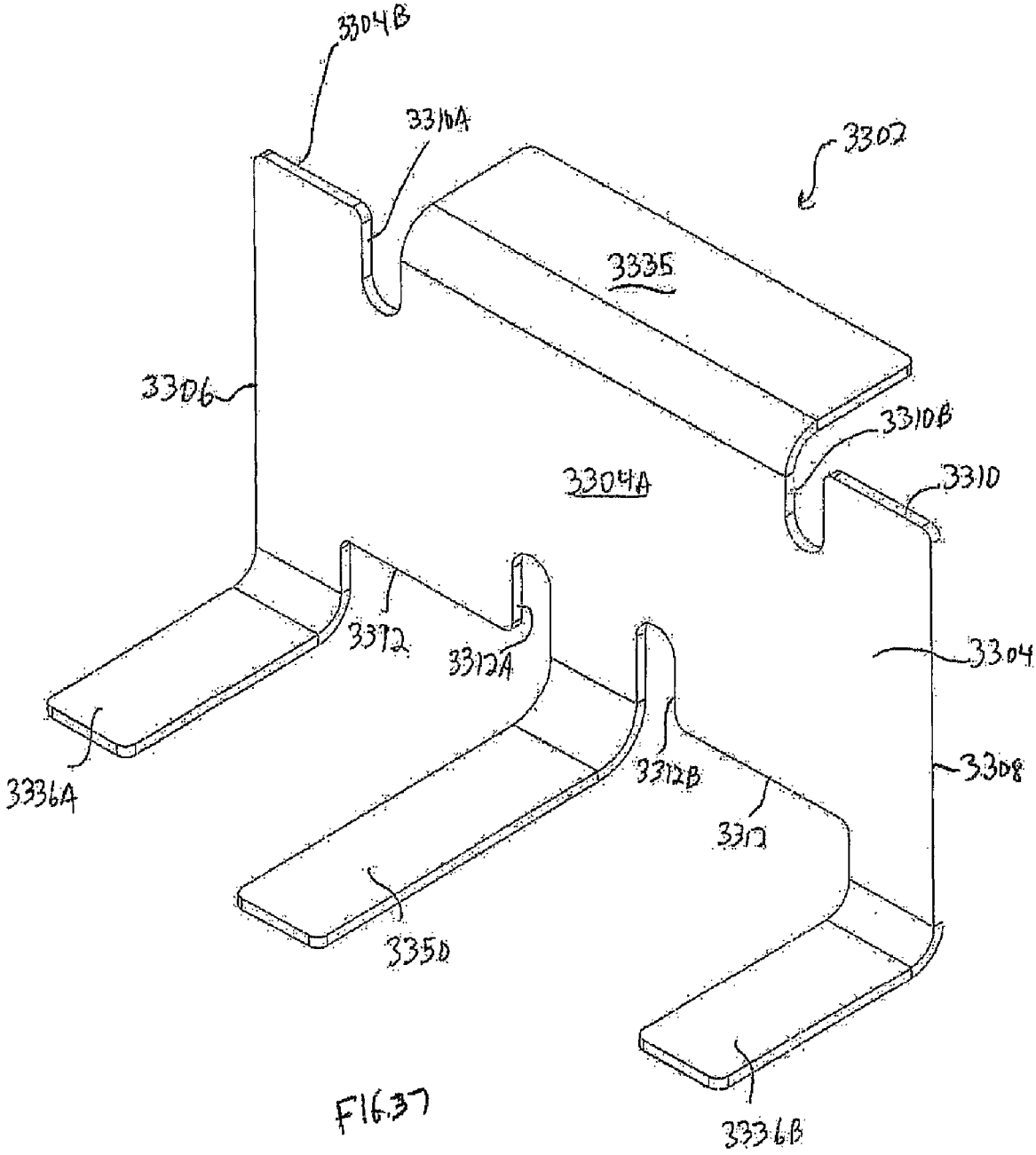
FIG. 37 illustrates a perspective view of a biasing member for a security tag in accordance with one embodiment.

FIG. 37 illustrates a perspective view of a biasing member 3302 that may be included in a tack retaining system that includes either wedge 3202R or the single use wedge (which may include 3202R but with or without protrusions 3221R or 3222R), in accordance with one embodiment. Biasing member 3302 may include a support body 3304, one or more of locating elements 3335 and 3336A-3336B, and a biasing portion that may be or include leaf spring 3350.

The biasing member 3302 may include a metal, such as steel or another metal or metals, or a nonmetal or nonmetals. In other embodiments, the biasing member 3302 may include plastic or rubber, or a combination of metals, rubbers, and/or plastics, for example. In other embodiments, biasing member 3302 may be formed with, attached to, integral with, or otherwise secured to wedge 3202R, and may or may not be formed with one or more of the materials of wedge 3202R.

The support body 3304 of the biasing member 3302 may be a thin, flat portion having at least partially rectangular front and back faces 3304A and 3304B, which may each share a first side 3306, second side 3308, top end 3310, and bottom end 3312. In an embodiment, top end 3310 includes recessed portions 3310A and 3310B, and/or bottom end 3312 includes recessed portions 3312A and 3312B.

Locating element 3335 may extend from the support body 3304 at or near the top end 3310, and may do so from between recessed portions 3310A and 3310B. Such a positioning between recessed portions 3310A and 3310B may result in certain flexibility and other characteristics of the part of locating element 3335 near recessed portions 3310A and 3310B. Recessed portions 3310A and 3310B may be altered or omitted in other embodiments as desired.

Figure 40:
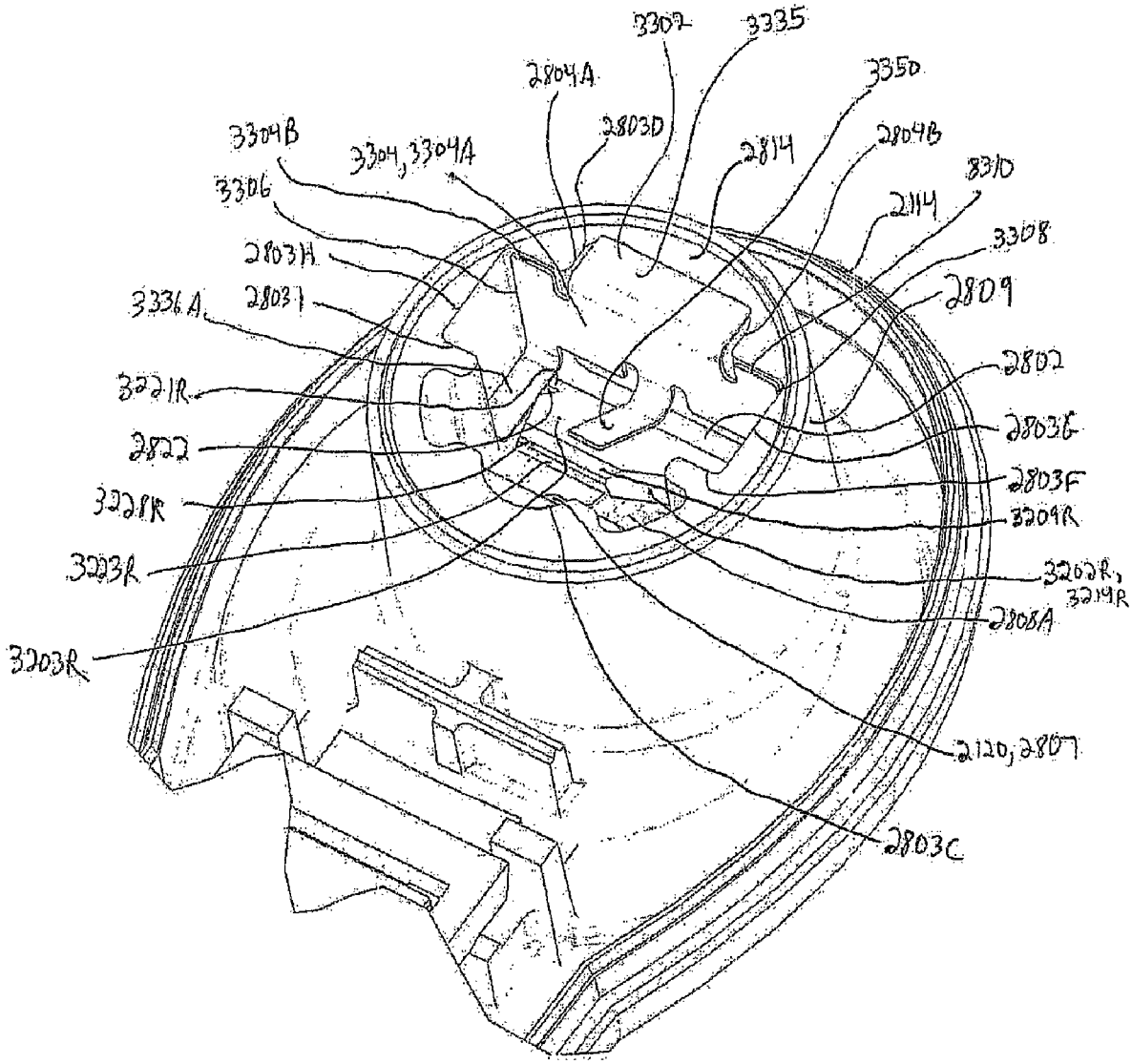
FIG. 40 illustrates an interior partial view of an upper housing with a wedge and biasing member inserted for a security tag in accordance with one embodiment.

Locating element 3335 may be shaped to conform to a portion of housing 2113 when the security tag 2100 is assembled. For example, in one embodiment, locating element 3335 may have an at least partially capital "L" shaped cross section with a rounded or otherwise curved corner, as viewed from side 3308 of biasing member 3302. When the security tag 2100 is assembled, the locating element 3335 may be positioned adjacent at least a portion of both back wall 2803D of wedge compartment 2802 and top surface 2814 of protrusion 2809, such as shown in the embodiment of FIG. 40, which is discussed below.

Locating elements 3336A and 3336B may extend from support body 3304 at or near bottom end 3312, and may respectively do so from the portions of bottom end 3312 near or at first side 3306 and second side 3308.

Locating elements 3336A-3336B may each be shaped to conform to a portion of housing 2113 when the security tag 2100 is assembled. For example, in one embodiment, locating elements 3336A-3336B may each have an at least partially "L" shaped cross section with a rounded or otherwise curved corner, as viewed from side 3308 of biasing member 3302. When the security tag 2100 is assembled, locating element 3336A may be positioned adjacent at least a portion of each of pocket side walls 28031 and 2803H of wedge compartment 2802, and locating element 3336B may be positioned adjacent at least a portion of each of pocked side walls 2803F and 2803G of wedge compartment 2802, such as shown in the embodiment of FIG. 40, which is discussed below. Locating elements 3335 and 3336A-3336B may facilitate positioning of the biasing member 3302 during assembly, and may also provide support to, and restrict movement of, biasing member 3302 during use of security tag 2100.

In one embodiment, when security tag 2100 is assembled, locating elements 3336A-3336B are positioned at least partially over recesses 2822 and 2821, respectively, of wedge compartment 2802. In an assembled security tag 2100 that includes wedge 3202R, locating elements 3336A-3336B may thus restrict movement of wedge protrusions 3221R-3222R out of their respective recesses 2822 and 2821. Such restriction may increase the difficulty of disabling the tack retaining system without using a detacher.

In other embodiments, locating elements 3335 and 3336A-3336B may be partially or fully replaced, changed, and/or supplemented with any other locating elements such as protrusions, recesses, surfaces, or other shapes that may facilitate positioning and possibly also provide support, and may restrict movement of biasing member 3302 during use of security tag 2100. The locating elements may be spring-like and/or have other characteristics. Recesses 2821-2822 may be correspondingly shaped to receive the locating element or elements of the particular embodiment.

In an embodiment, the biasing portion of biasing member 3302 is leaf spring 3350. Leaf spring 3350 may be configured to bias wedge 3202R or the single-use wedge (wedge 3202R with or without protrusions 3221R and 3222R) in an assembled security tag 2100 toward and into the locked condition in which wedge 3202R is in engagement with a groove 2108 of tack assembly 2102, such as described above with respect to embodiments of spring 1302 and wedge 1202 of security tag 102, FIGS. 1-31. Leaf spring 3350 may also be configured to resist movement of wedge 3202R out of the locked condition via a range of forces that may accompany many or most unauthorized attempts (e.g., by "slamming" such as described herein, pulling on tack, etc.) to remove security tag 2100 from an article. Leaf spring 3350 may be also be configured, however, to permit a higher range of forces, such as those from a detacher, such as magnetic detaching device 602 of FIGS. 6-7 in one embodiment, to move the wedge 3202R out of the locked condition, against the bias of leaf spring 3350, such as also described with respect to the embodiments of elements 1302, 1202 of security tag 102 of FIGS. 1-31. Also discussed with respect to that spring 1302 and other components of embodiments of security tag 102 of FIGS. 1-31, desired characteristics of leaf spring 3350 may depend upon the characteristics and relative positioning of leaf spring 3350 and also one or more of the wedge 3202R or other wedge, housing 2113, and magnetic detaching device 602 or other detacher used in a security tag system.

In one embodiment, leaf spring 3350 extends from the support body 3304 at or near the bottom end 3312, and may do so from the between recessed portions 3312A and 3312B. Leaf spring 3350 may have an at least partially "L" shaped cross section with a rounded or otherwise curved corner, as viewed from side 3308 of biasing member 3302. When the security tag 2100 is assembled, at least a portion of leaf spring 3350 may be positioned adjacent at least a portion of wedge 3202R, such as shown in the embodiment of FIG. 40, or its corresponding single-use version (with or without protrusions 3221R-3222R), for example. The positioning between recessed portions 3312A and 3312B and the shape and size of leaf spring 3350 may result in certain spring force and other characteristics to leaf spring 3350. The recesses and/or size and shape may be altered or omitted in various embodiments based upon the desired characteristics of leaf spring 3350. For example, in various embodiments, one or more of the length, width, and thickness may be altered, such as based upon the magnetic force characteristics of the associated detacher.

Figure 38:
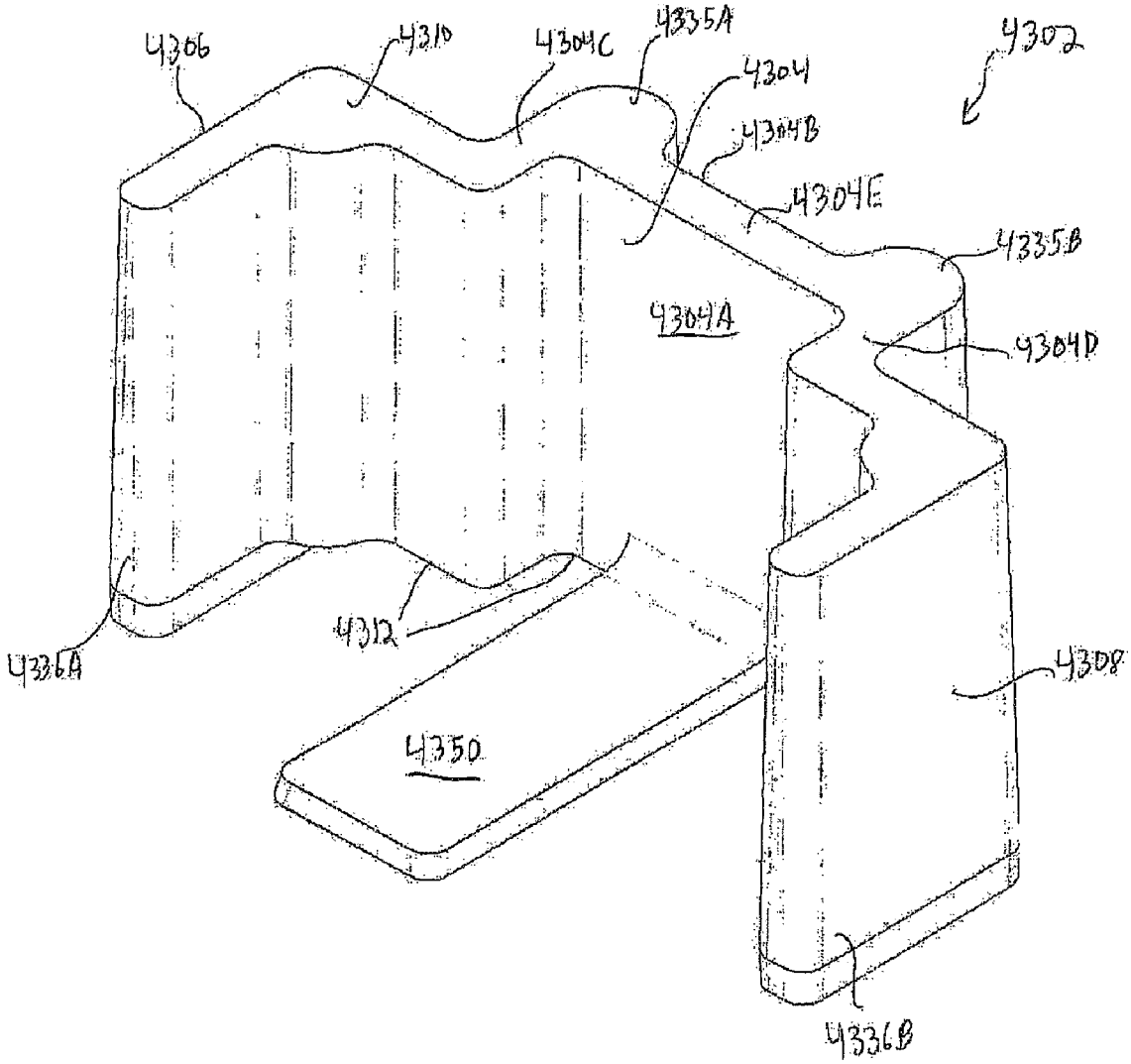
FIG. 38 illustrates a perspective view of a biasing member for a security tag in accordance with one embodiment.

FIG. 38 illustrates a perspective view of a biasing member 4302 that may be included in a tack retaining system that includes either wedge 3202R or the single use wedge (which may include 3202R but with or without protrusions 3221R or 3222R), in accordance with one embodiment. Biasing member 4302 may include a support body 4304, one or more of locating elements 4335A-4335B and 4336A-4336B, and a biasing portion that may be or include leaf spring 4350.

The biasing member 4302 may include a plastic. In other embodiments, the biasing member 4302 may include metal or rubber, or a combination of metals, rubbers, and/or plastics, for example.

The support body 4304 of the biasing member 4302 may be a portion having at least partially rectangular front and back faces 4304A and 4304B, and may have a first side 4306, second side 4308, top end 4310, and bottom end 4312. Support body 4304 may also include portions 4304C and 4304D that are angled with respect to adjacent portions of support body 4304. Those adjacent portions may be parallel or close to parallel such to form a "step" on front face 4304A on either side of the central portion 4304E of support body 4304.

Locating elements 4335A-4335B may extend from the support body 4304 back face 4304B. Locating elements 4335A-4335B may be shaped to conform to a portion of housing 2113 when the security tag 2100 is assembled. For example, in one embodiment, locating elements 4335A-4335B may be convex protrusions that conform to the recesses formed by back wall portions 2804A and 2804B of back wall 2803D of wedge compartment 2802 of housing 2113, such as shown in the embodiment of FIG. 41, which is discussed below.

Locating element 4336A and 4336B may extend from the support body 4304 along first and second sides 4306 and 4308, respectively, and may also be shaped to conform to a portion of housing 2113 when the security tag 2100 is assembled. For example, in one embodiment, locating elements 4336A-4336B may each extend approximately perpendicular to central portion 4304E of support body 4304. When the security tag 2100 is assembled, locating element 4336A may be positioned adjacent at least a portion of each of pocket side walls 28031 and 2803H of wedge compartment 2802, and locating element 4336B may be positioned adjacent at least a portion of each of pocked side walls 2803F and 2803G of wedge compartment 2802, such as shown in the embodiment of FIG. 41, which is described below. Locating elements 4335A-4335B and 4336A-4336B may facilitate positioning of the biasing member 3302 during assembly, and may also provide support to, and restrict movement of, biasing member 4302 during use of security tag 2100.

Figure 41:
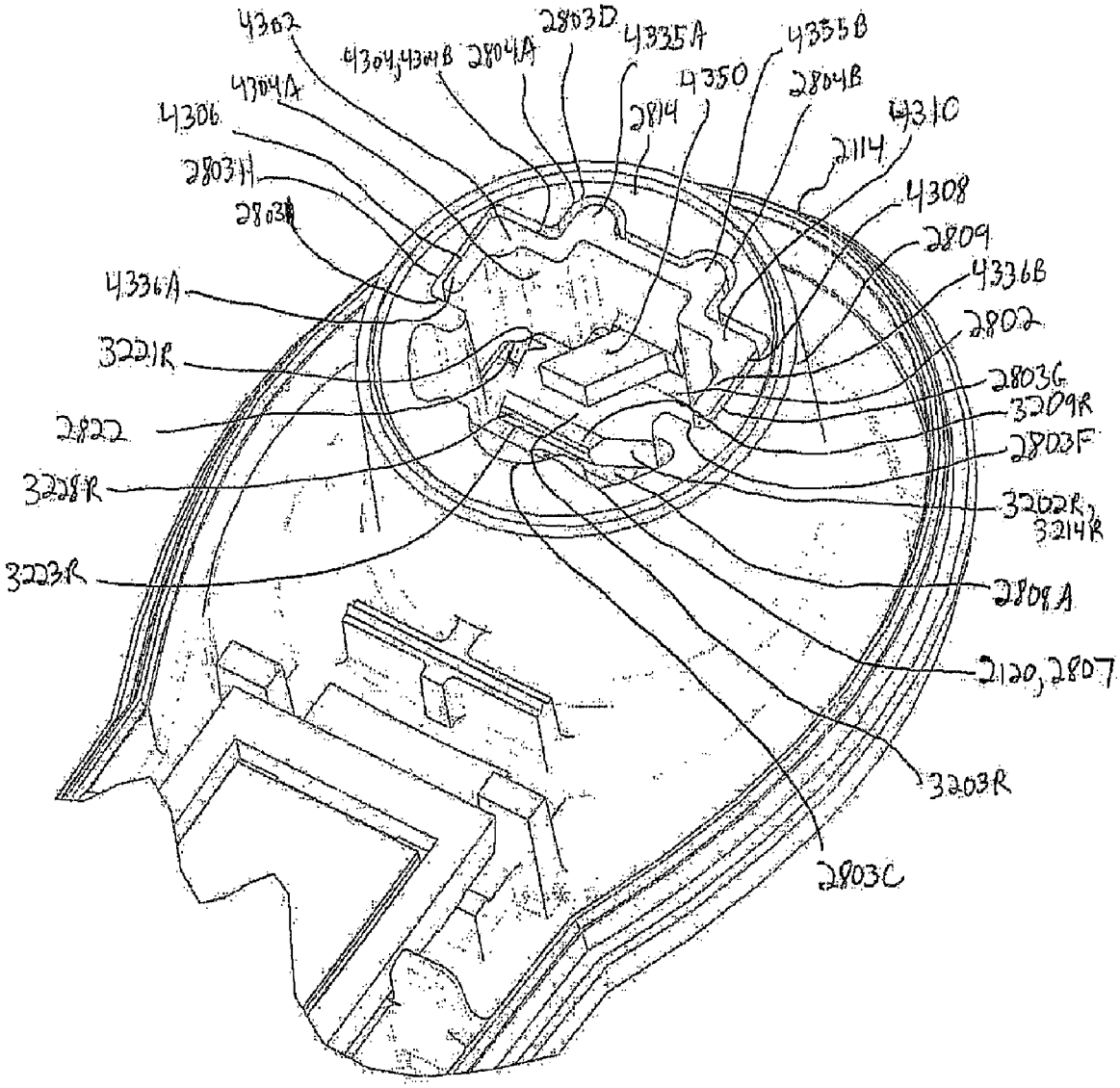
FIG. 41 illustrates an interior partial view of an upper housing with a wedge and biasing member inserted for a security tag in accordance with one embodiment.

In one embodiment, when a reusable security tag 2100 is assembled, locating elements 4336A-4336B are respectively positioned at least partially over recesses 2822 and 2821, thus restricting movement of protrusions 3221R-3222R of wedge 3202R, such as shown in the embodiment of FIG. 41 and described with respect to locating elements 3336A-3336B of biasing member 3302 of FIGS. 37 and 40.

In an embodiment, the biasing portion of biasing member 4302 is leaf spring 4350. Leaf spring 4350 may be configured and positioned to provide an appropriate bias to wedge 3202R or the single-use wedge (wedge 3202R with or without protrusions 3221R and 3222R) in an assembled security tag 2100, such as described with respect to leaf spring 3350 of biasing member 3302 of FIGS. 37 and 40. In one embodiment, leaf spring 4350 extends from the support body 4304 at or near the bottom end 4310, and has an at least partially rectangular, flat shape.

In various other embodiments, biasing member 3302 or 4302 may be otherwise configured to fit at least partially within wedge compartment 2802 of upper housing 2114, and be secured therein. For example, biasing member 3302 or 4302 may include only the biasing portion, leaf spring 3350 or 4350, respectively, without locating elements or a support body apart from housing 2113. Instead, leaf spring 3350 or 4350 may be integral with or otherwise secured at one end to a portion of housing 2113, such as to a portion of wall 2803. In other embodiments, one or more locating elements of either biasing member 3302 or 4302 may be altered or omitted, or other locating elements may be added.

For example, in one embodiment, biasing member 3302 is integral with housing 2113 of security tag 2100. The support body 3304 may thus be housing 2113 or a portion thereof, in which case locating elements 3335 and 3336A-3336B may be excluded from biasing member 3302. Leaf spring 3350 of biasing member 3302 may be a leaf spring that extends from back wall 2803D of housing 2113.

Figure 39:
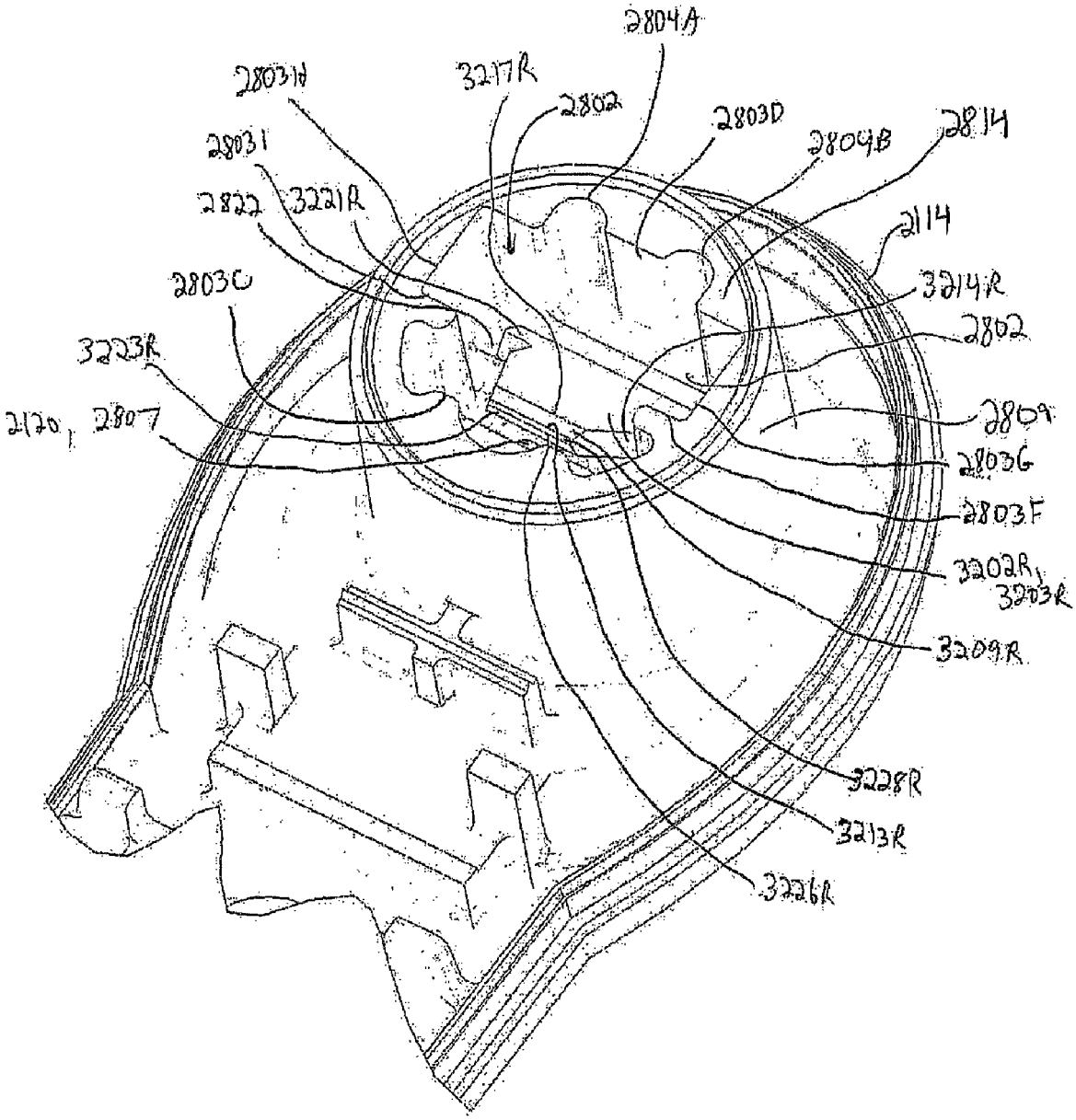
FIG. 39 illustrates an interior partial view of an upper housing with a wedge inserted for a security tag in accordance with one embodiment.

FIG. 39 illustrates an interior partial view of an upper housing 2114 with a wedge 3202R inserted for a security tag 2100, in accordance with one embodiment. In this embodiment, wedge 3202R of a tack retaining system is disposed in the wedge compartment 2802 such that protrusions 3221R and 3222R are respectively disposed at least partially within recesses 2822 and 2821. The tack retaining portion of wedge 3202R may be positioned to engage a lip 2107 of a groove 2108 of an inserted tack assembly 2102 in the locked condition, such as with either or both edges 3226R and 3213R, and/or one or more wedge surfaces 3209R, 3223R, and 3228R.

In an embodiment in which wedge 3202R is symmetrical, such as described in embodiments above, wedge 3202R may be in a "flipped" orientation such that protrusions 3221R and 3222R are respectively disposed at least partially within recesses 2821 and 2822. This may result fewer errors in assembly. Such symmetry may also simplify manufacturing of wedge 3202R.

In a single use embodiment of the wedge (wedge 3202R with or without protrusions 3221R-3222R) the wedge may be similarly positioned, except that no portion of the wedge may be disposed within either recess 2821 or 2822. The single use wedge may be substituted for wedge 3202R in either of the embodiments of FIGS. 40-41 below.

FIG. 40 illustrates an interior partial view of an upper housing 2114 with a wedge 3202R and biasing member 3302 inserted for a security tag 2100, in accordance with one embodiment. As shown in this embodiment, biasing member 3302 is positioned adjacent wedge 3202R and closely within walls 2803 of wedge compartment 2802. Such positioning may restrict movement of protrusions 3221R and 3222R of wedge 3202R out of their respective recesses 2822 and 2821. Biasing member 3302 may allow at least rotational movement of wedge 3202R about protrusions 3221R and 3222R during operation of security tag 2100, such as described above with respect to axle protrusions 1221R and 1222R of wedge 1202R and recesses 821 and 822 of security tag 100.

FIG. 41 illustrates an interior partial view of an upper housing 2114 with a wedge 3202R and biasing member 4302 inserted for a security tag 2100, in accordance with one embodiment. As shown in this embodiment, biasing member 4302 is positioned adjacent wedge 3202R and closely within walls 2803 of wedge compartment 2802. Biasing member 4302 may restrict movement of protrusions 3221R and 3222R of wedge 3202R out of their respective recesses 2822 and 2821, but may allow at least rotational movement about protrusions 3221R and 3222R during operation of security tag 2100, such as described above with respect to axle protrusions 1221R and 1222R of wedge 1202R and recesses 821 and 822 of security tag 100.

Figure 42:
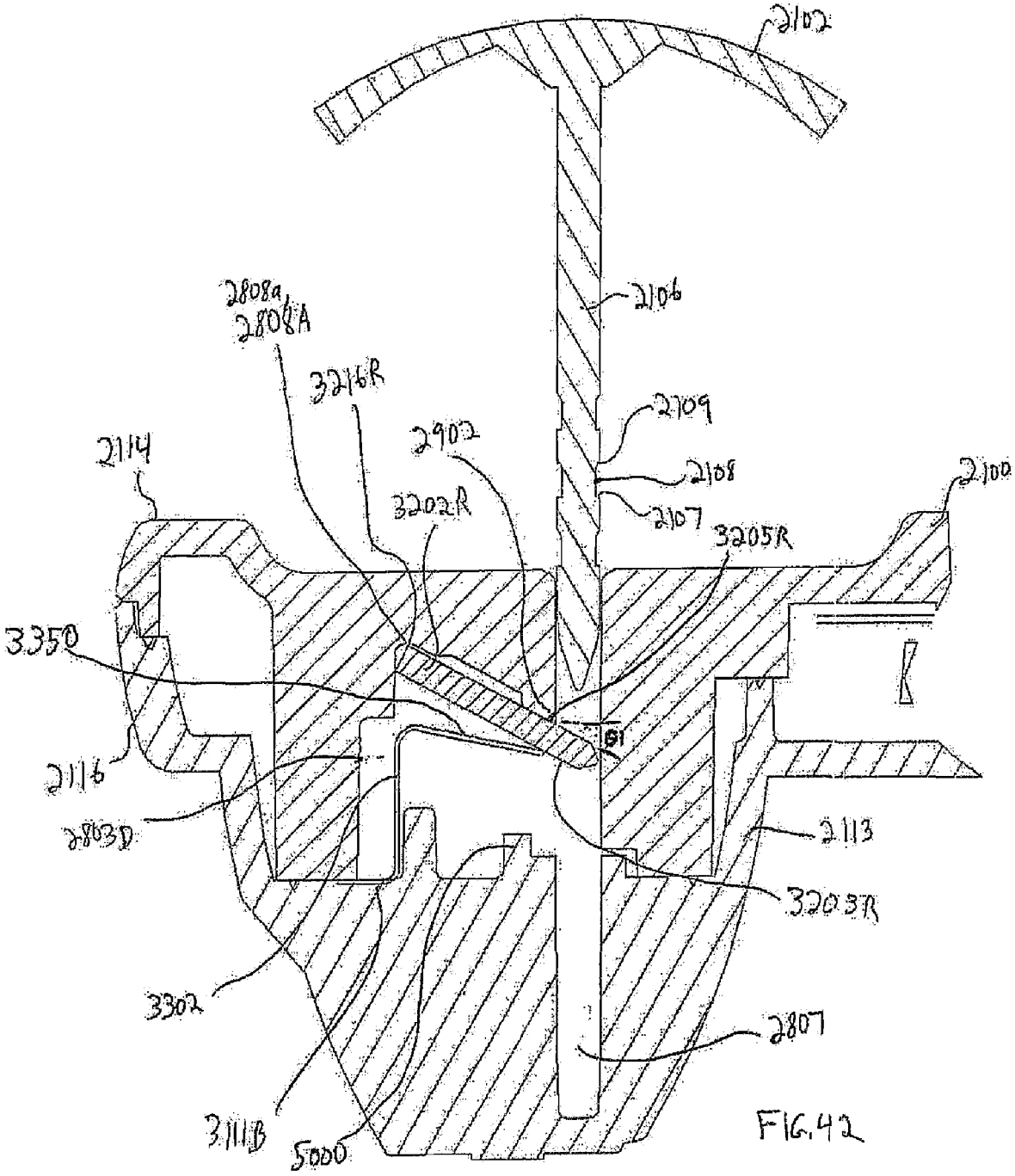
FIG. 42 illustrates a first partial view of a cross-section taken along line D-D of FIG. 32 of a reusable security tag and a tack in accordance with one embodiment.

FIG. 42 illustrates a first partial view of a cross-section (taken along line D-D of FIG. 32) of a reusable security tag 2100 with a tack 2102 and a tack retaining system including wedge 3202R and biasing member 3302, in accordance with one embodiment. FIG. 42 may correspond to FIG. 14, in that tack shank 2106 of tack assembly 2102 may be partially inserted into tack hole 2807, but not yet in contact with wedge 3202R. The tack retaining system may be in the rest condition in its original position. Wedge 3202R may be biased by leaf spring 3350 of biasing member 3202 at a wedge angle θ1, such that surface 3205R is on wedge stop 2902 and edge 3216R is on sloped surface 2808*a* of top wall 2808A. Wedge angle θ1 may be an angle such as the approximately 22° and Ø in the embodiment of FIG. 14, or may be another angle. In one embodiment, top wall 2808A does not include sloped surface 2808*a*. Wedge protrusions 3221R and 3222R (not shown) may be constrained to their respective recesses 2822 and 2821 (not shown), but may be allowed to rotate, translate, some combination of rotation and translation, or otherwise move within recesses 2822 and 2821.

FIG. 43 illustrates a second partial view of a cross-section (taken along line D-D of FIG. 32) of a reusable security tag 2100 with a tack 2102 and a tack retaining system including wedge 3202R and biasing member 3302, in accordance with one embodiment. FIG. 43 may correspond to FIG. 17, in that tack shank 2106 of tack assembly 2102 may be further inserted into tack hole 2807 such that a tack groove 2108 is adjacent tack retaining portion of wedge 3202R. The tack retaining portion may include one or more chamfers such as described above and may include surfaces 3209R, 3223R, and 3228R and their common edges 3213R and 3226R. At this point, leaf spring 3350 of biasing member 3302 may force the chamfered tack retaining portion of wedge 3202R at least partially into tack groove 2108. Attempts to retract tack assembly 2102 from security tag 2100 may now be prevented or made more difficult by the wedge 3202R, since edges 3213R and 3226R may now be biased into a position adjacent the intersection of groove lip 2107 and the surface between lips 2107 and 2109 of tack groove 2108 by leaf spring 3350 of biasing member 3302, thus restraining tack 2102 from being extracted from tag 2100. At this point, the reusable tack retaining system may be in a locked condition.

Figure 44:
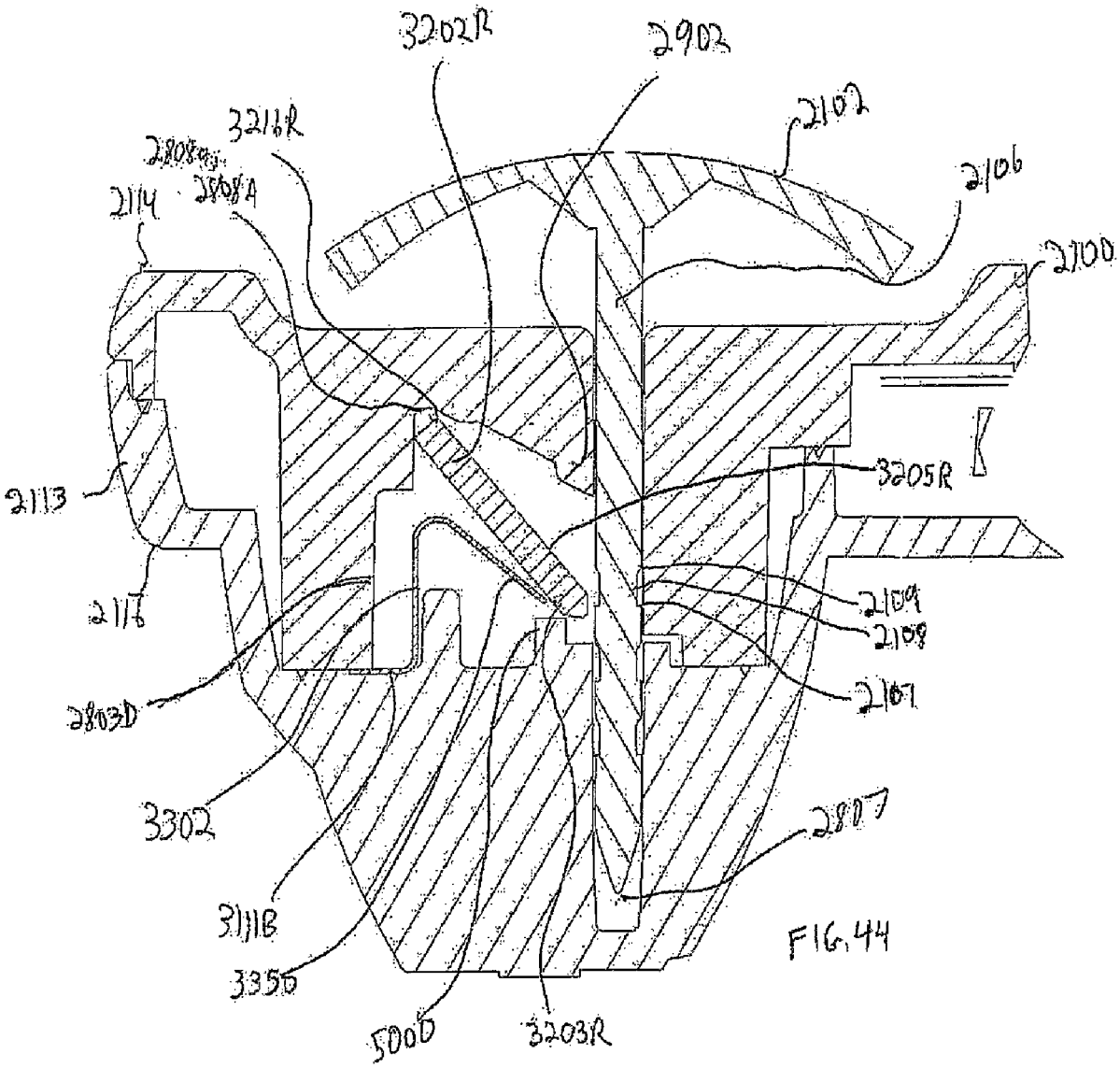
FIG. 44 illustrates a third partial view of a cross-section taken along line D-D of FIG. 32 of a reusable security tag and a tack in accordance with one embodiment.

FIG. 44 illustrates a third partial view of a cross-section (taken along line D-D of FIG. 32) of a reusable security tag 2100 with a tack 2102 and a tack retaining system including wedge 3202R and biasing member 3302, in accordance with one embodiment. In this embodiment, housing 2113 includes a stop 5000 that may restrict wedge 3202R from rotating past stop 5000. Stop 5000 may thus reduce the bending of spring 3350 caused by movement, via the magnetic force of magnetic detaching device 602 of FIGS. 6-7 or another detacher, of adjacent wedge 3202R out of the locked condition. By limiting its bending, spring 3350 may preserve or nearly preserve its characteristics to provide desired biasing forces to wedge 3202R, such as discussed above, during subsequent use.

Figure 45:
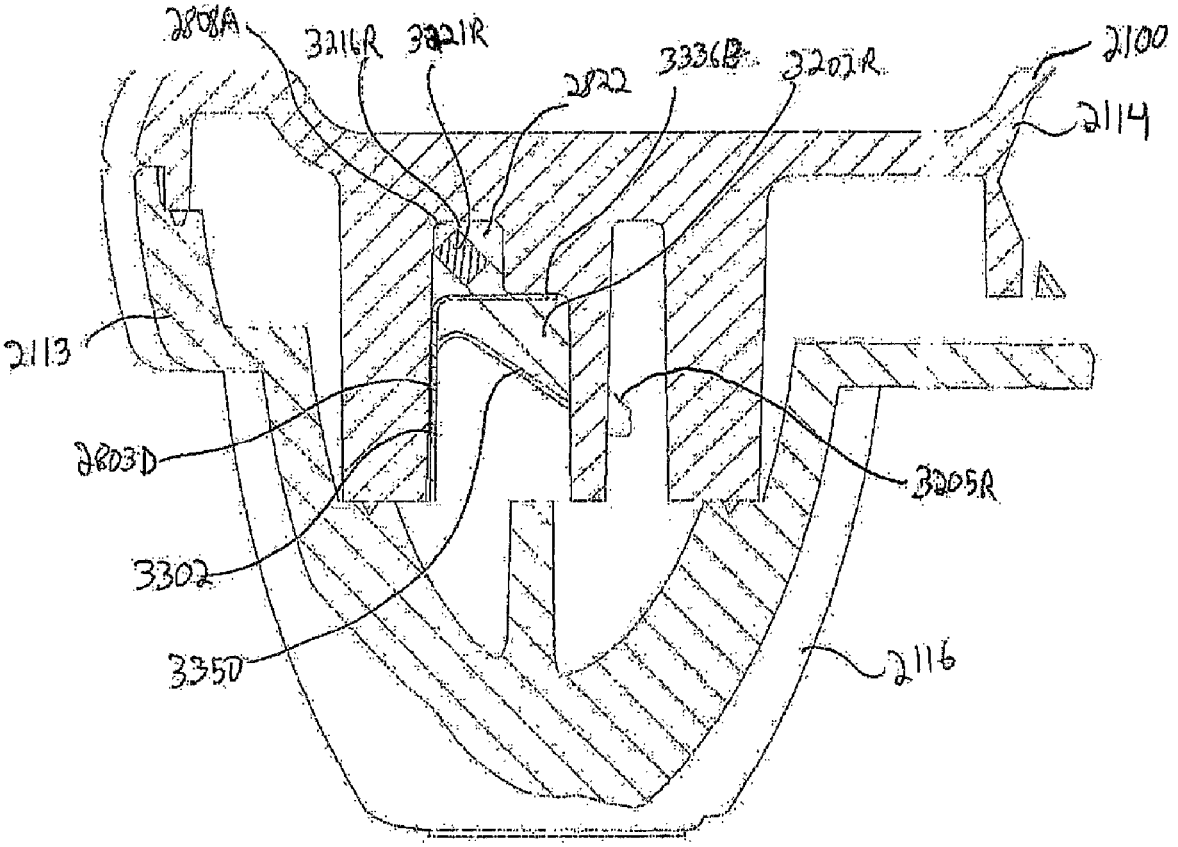
FIG. 45 illustrates a partial view of a cross-section taken along line E-E of FIG. 32 of a reusable security tag and a tack in accordance with one embodiment.

FIG. 45 illustrates a partial view of a cross-section (taken along line E-E of FIG. 32) of a reusable security tag 2100 having a tack retaining system including wedge 3202R and biasing member 3302, and a tack 2102, in accordance with one embodiment. This figure shows another view of an embodiment in which locating element 3336A is positioned at least partially over recess 2822, restricting movement of wedge protrusion 3221R out of recess 2822, such as described above.

FIG. 46 illustrates a first partial view of a cross-section (taken along line D-D of FIG. 32) of a single-use security tag 2100 with a tack 2102 and a tack retaining system. In this embodiment, the tack retaining system includes a single use wedge (wedge 3202R with or without protrusions 3221R-3222R) and a biasing member 3302. For example, in an embodiment, the tack retaining system includes wedge 3202R (i.e. with protrusions 3221R-3222R) as the single use wedge, and biasing member 3302 may not include locating elements 3336A-3336B. In the embodiment as shown in FIG. 46, biasing member 3302 includes locating elements 3336A-3336B (3336A not shown), but locating elements 3336A-3336B are positioned such that they extend from a portion of biasing member 3302 that is closer to top end 3310 as compared to the embodiment of FIG. 37. In such position, locating elements 3336A-3336B may not restrict movement of wedge protrusions 3221R-3222R out of their respective housing recesses 2822-2821. Locating elements 3336A-3336B may be otherwise positioned and/or shaped to allow wedge protrusions 3221R-3222R to move out of their respective recesses 2822-2821. In an embodiment of security tag 2100 employing biasing member 4302, such as shown in FIG. 38 described above, locating elements 4336A-4336B of biasing member 4302 may also be excluded, positioned and/or shaped to allow wedge protrusions 3221R-3222R of a single use wedge 3202R to move out of their respective recesses 2822-2821.

The single use wedge may be biased by leaf spring 3350 of biasing member 3302 to an original position at a wedge angle θ2 (which may correspond to the position of wedge 3202R at wedge angle θ1), such that surface 3205R is originally on wedge stop 2902 and edge 3216R is on sloped surface 2808*a* of top wall 2808A (position not shown, but may correspond to position of wedge 3202R in FIG. 42). Wedge angle θ2 may be an angle such as the approximately 22° and Ø in the embodiment of FIG. 14, or may be another angle. In another embodiment, top wall 2808A does not include sloped surface 2808*a*.

In one embodiment, tack assembly 2102 may be removed or detached from security tag 2100 as implemented with a single-use tack retaining system through use of a magnetic detaching device (e.g. 602), such as described above with respect to tack assembly 102 and security tag 100, for example. Thus, in order to detach tack assembly 2102 from security tag 2100, security tag 2100 may be seated or nearly seated in magnetic detaching device 602. Detaching device 602 may magnetically force the single use wedge against leaf spring 3350 of biasing member 3302, such as by rotational movement about wedge pivot side 3207R, translational movement, some combination of rotational and translational movement, and/or other movement out of the locked condition and past stop 5110. The single use wedge, now unblocked by tack shank 2106 or stop 5110, may be further magnetically forced from a position above trap cavity 5100 to a position partially within trap cavity 5100 such as shown. Trap cavity 5100 may be a cavity or other recessed portion of lower housing 2116. Trap cavity 5100 may be at least partially cuboidal in shape or otherwise shaped to receive at least a portion of the single use wedge.

FIG. 47 illustrates a second partial view of the embodiment of FIG. 46, in which the single use wedge has moved by magnetic force further into trap cavity 5100, and may remain in this position or nearly in this position (without an external force such as described below with respect to FIG. 48) once security tag 2100 has been removed from the detaching device.

FIG. 48 illustrates a third partial view of the embodiment of FIG. 46, in which the single use wedge had completed movement via magnetic force into trap cavity 5100, and security tag 2100 has been removed from detaching device 602. Since detaching device 602 may thus no longer be biasing the single use wedge against leaf spring 3350 of biasing member 3302, leaf spring 3350 may bias the wedge against trap cavity sidewall 5100A. An external force (e.g., caused by "slamming" as described herein, gravity, etc.) applied to the single use wedge may tend to move the wedge in a direction out of trap cavity 5100, such as by partially translational, partially rotational, and/or other movement. In one embodiment, housing 2113 includes a wedge catch 5120, which may be a cavity or other recess shaped to receive a portion of the single use wedge, such as a portion near wedge pivot side 3207R. The wedge catch 5120 may receive this wedge portion, such as shown, during movement of the single use wedge by external force out of the trap cavity 5100. Thus, the single use wedge, disposed at least partially within both trap cavity 5100 and wedge catch 5120, and biased by leaf spring 3350 to remain so, may no longer be able to engage a tack shank 2106 of a tack assembly 2102 in the locked condition, rendering security tag 2100 inoperable.

In any of the single use or reusable embodiments described above with respect to security tag 2100, the tack retaining system may include an alternative to biasing member 3302 or 4302. FIGS. 49-53 show various alternative embodiments. In these alternative embodiments, the wedge is identified in the figures as wedge 3202R. However, in an embodiment where the particular security tag 6100, 7100, 8100, 9100, or 10100 of one of FIGS. 49-53 is to be for single use, the wedge used may be 3202R with or without protrusions 3221R-3222R. Other portions of that security tag, such as its corresponding biasing member 6350, 7350, 8350, 9350, or 10350, may be appropriately shaped and/or positioned, such as, where applicable, to allow movement of protrusions 3221R-3222R out of their respective housing recesses 2822-2821. Such shaping and/or positioning may be as described above with respect to single use tack retaining systems using wedge 3202R (with or without protrusions 3221R-3222R) and biasing member 3302 or 4302.

Figure 49:
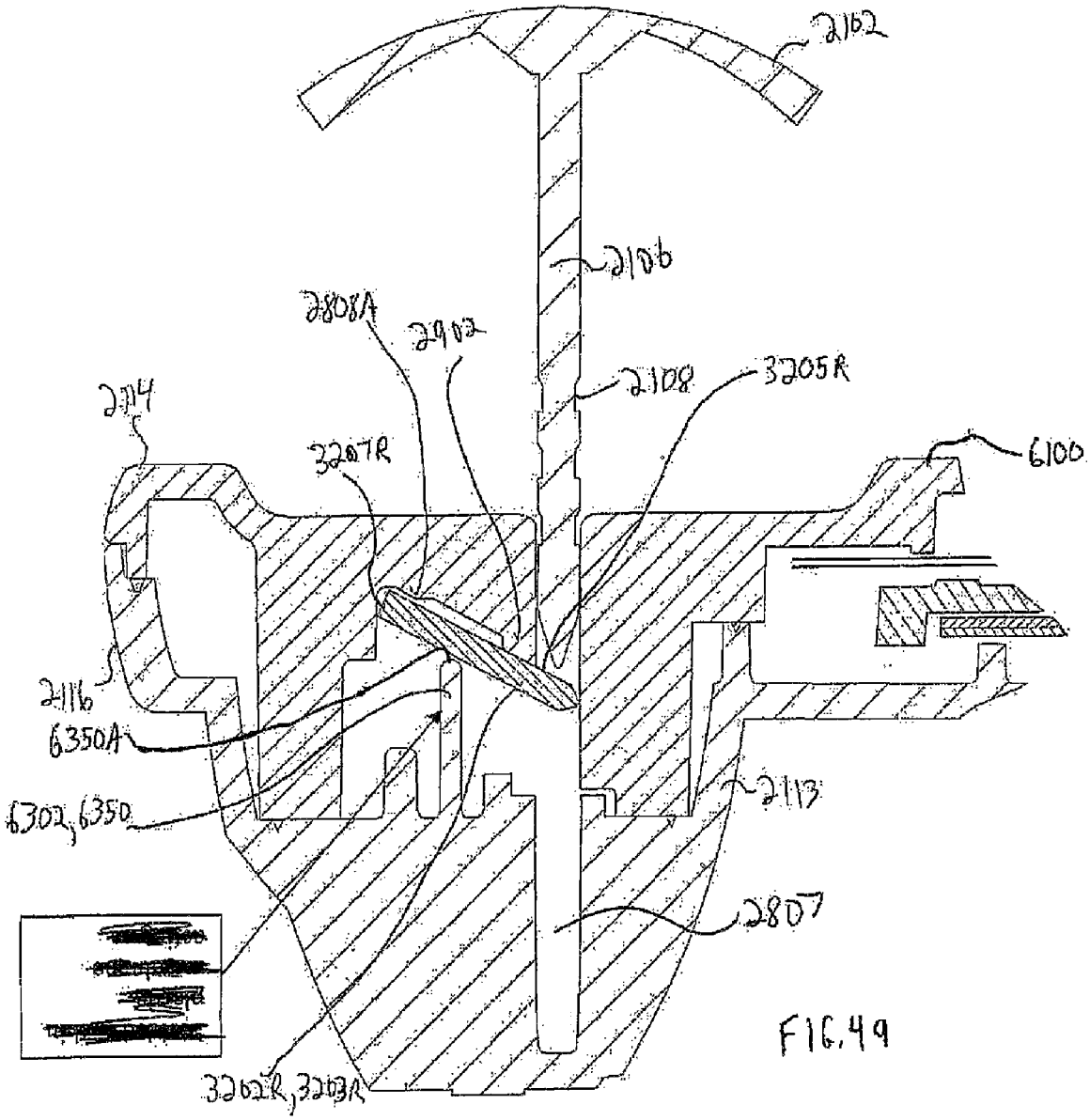
FIG. 49 illustrates a partial view of a cross-section taken along a line corresponding to D-D of FIG. 32 for a security tag having an alternative embodiment of a biasing member in accordance with one embodiment.

FIG. 49 illustrates a partial view of a cross-section (taken along a line corresponding to line D-D of FIG. 32) of a security tag 6100 having an alternative embodiment of a biasing member, and a tack 2102. Other portions of security tag 6100, as well as security tags 7100, 8100, 9100, and 10100 (described below) that are not shown may include elements that are the same or similar to those of security tag 2100.

In this embodiment, the tack retaining system includes a biasing member 6302 that includes a biasing portion that is wedge-bending element 6350, which may block free rotational movement of wedge 3202R (whether including protrusions 3221R-3222R) or its single use version about wedge pivot side 3207R. Wedge-bending element 6350 may be a thin plastic member in one embodiment. Wedge-bending element 6350 may protrude from wall 3111B or another wall and be integral with, or otherwise secured to, housing 2113 of security tag 2100. In one embodiment, wedge-bending element 6350 is integral with lower housing 2116.

Wedge-bending element 6350 may cause wedge 3202R to bend around wedge-bending element end 6350A when tack shank 2106 is inserted into security tag 2100 and contacts wedge 3202R, causing wedge 3202R to be biased toward the locked condition in engagement with a groove 2108 of tack shank 2106. During detachment, magnetic detaching device 602 or another detaching device may cause wedge 3202R to further bend out of groove 2108 such that tack assembly 2102 may be removed from security tag 6100. When security tag 6100 is removed from the detacher, if wedge 3202R is made of material and/or shaped such that it is resilient, wedge 3202R may return to its original shape, or close thereto, such that security tag 6100 may be reused. In an embodiment in which such material is not resilient, wedge 3202R may remain bent and security tag 6100 may be for single use.

In other embodiments of security tag 6100, wedge 3202R may be replaced with its corresponding single use wedge with or without protrusions 3221R-3222R, or may use another wedge configured to bend around wedge-bending element 6350 under force and to engage tack shank 2106 in the locked condition.

Figure 50:
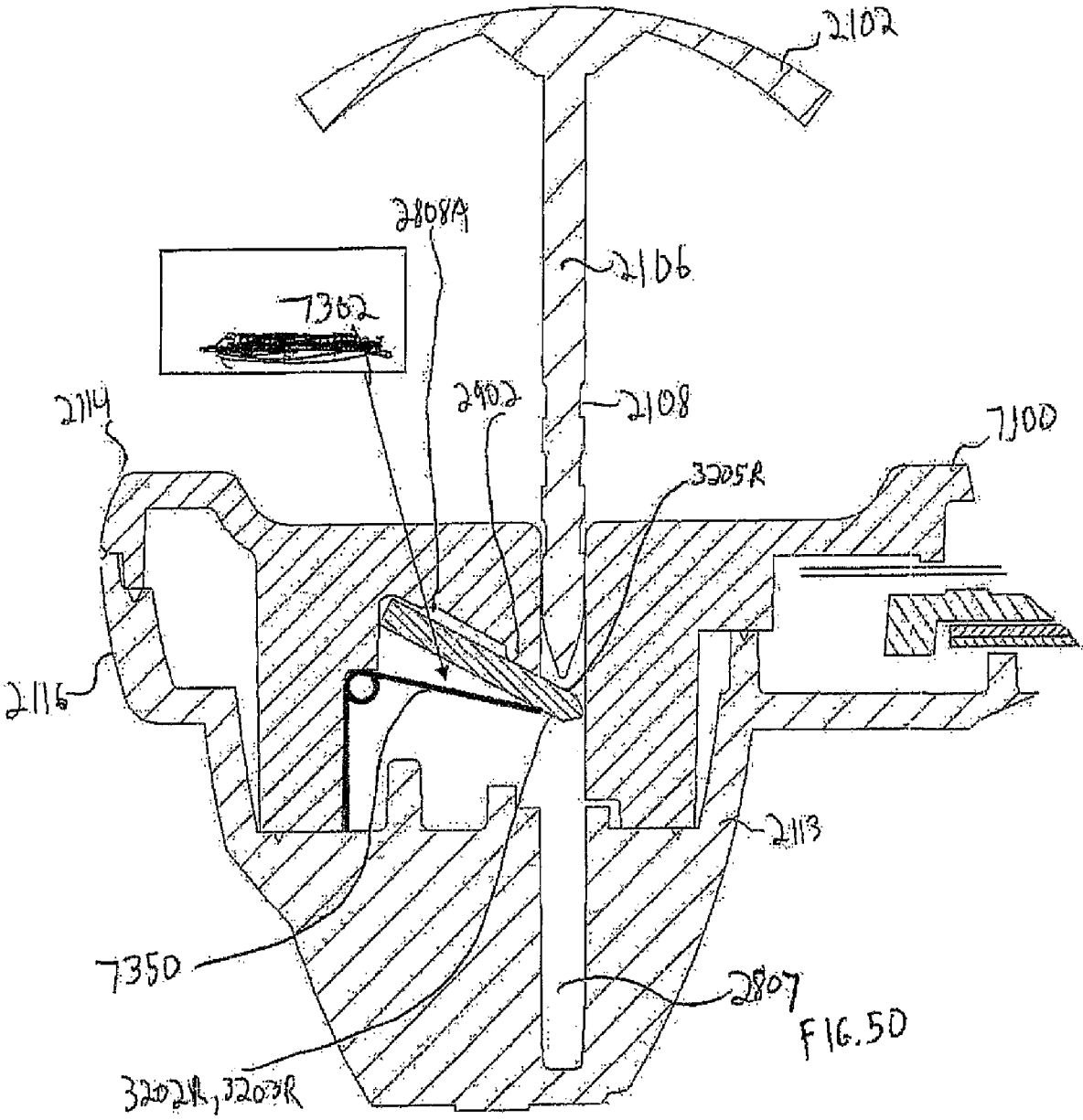
FIG. 50 illustrates a partial view of a cross-section taken along a line corresponding to D-D of FIG. 32 for a security tag having another embodiment of a biasing member in accordance with one embodiment.

FIG. 50 illustrates a partial view of a cross-section (taken along a line corresponding to line D-D of FIG. 32) of a security tag 7100 having another embodiment of a biasing member, and a tack 2102. In this embodiment, tack retaining system includes a biasing member 7302 with a biasing portion that is a torsion spring 7350. Torsion spring 7350 may bias wedge 3202R or another wedge toward the locking position, such as described with respect to leaf spring 3350 of biasing member 3202. Torsion spring 7350 may be integral with or secured to housing 2113, or may otherwise be configured and/or disposed in wedge compartment 2802 to restrain movement of the part of biasing member 7302 other than torsion spring 7350.

Figure 51:
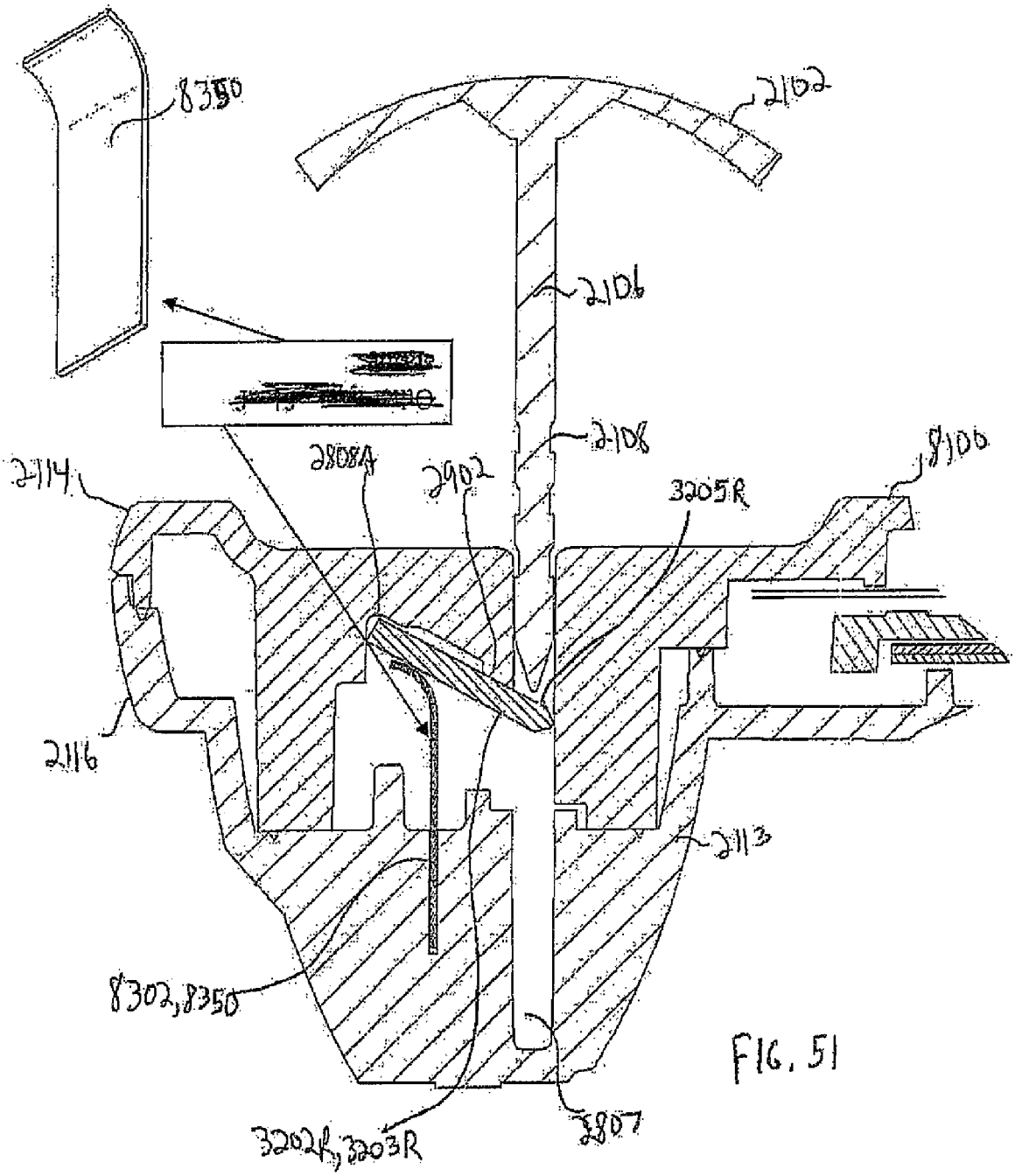
FIG. 51 illustrates a partial view of a cross-section taken along a line corresponding to D-D of FIG. 32 for a security tag having another embodiment of a biasing member in accordance with one embodiment.

FIG. 51 illustrates a partial view of a cross-section (taken along a line corresponding to line D-D of FIG. 32) of a security tag 8100, having another embodiment of a biasing member, and a tack 2102. In this embodiment, the tack retaining system includes a biasing member 8302 with a biasing portion that is a leaf spring 8350 that is secured to housing 2113 and may have a curved end that biases wedge 3202R (or another wedge) toward the locked condition. Leaf spring 8350 may be secured to housing 2113, for example, by being embedded within lower housing 2116 and/or secured by an epoxy, or otherwise secured.

Figure 52:
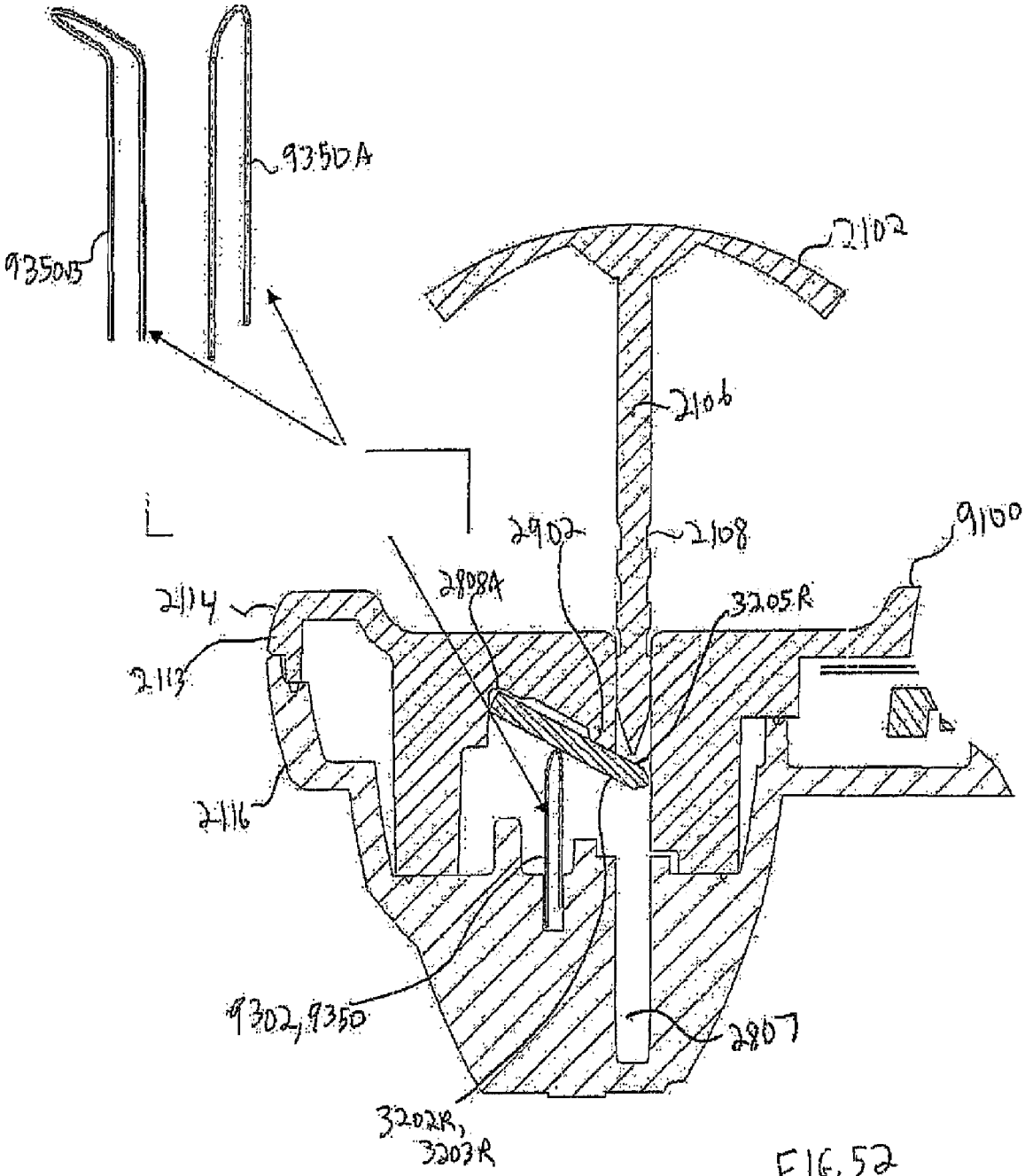
FIG. 52 illustrates a partial view of a cross-section taken along a line corresponding to D-D of FIG. 32 for a security tag having another embodiment of a biasing member in accordance with one embodiment.

FIG. 52 illustrates a partial view of a cross-section (taken along a line corresponding to line D-D of FIG. 32) of a security tag 9100 with a tack 2102 and another embodiment of a biasing member. In this embodiment, leaf spring 8350 of biasing member 8302 has been replaced by wire spring 9350A or 9350B of biasing member 9302 to provide the biasing force to wedge 3202R or another wedge. The wire spring may be formed of various shapes other than the ones shown in various embodiments.

Figure 53:
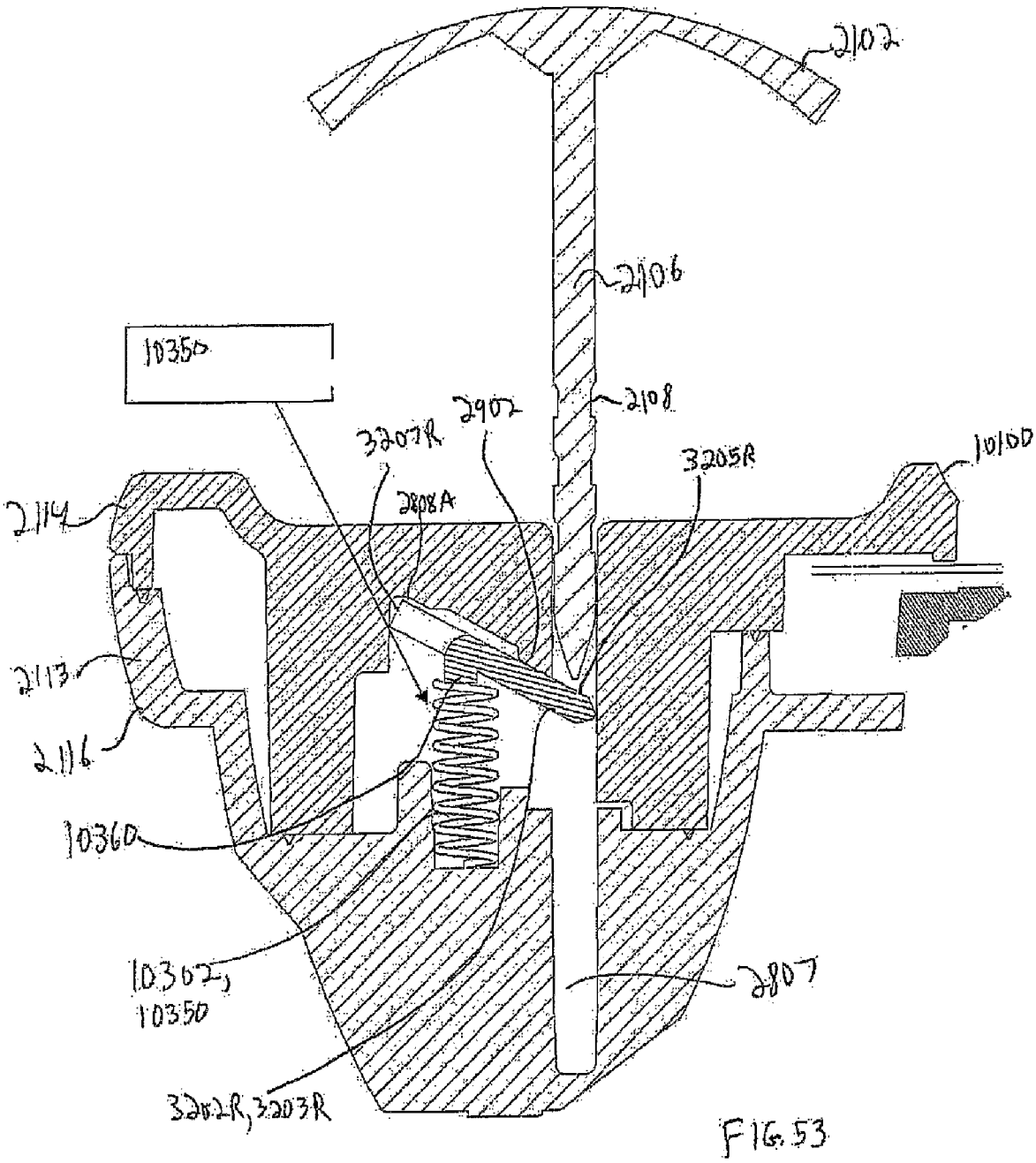
FIG. 53 illustrates a partial view of a cross-section taken along a line corresponding to D-D of FIG. 32 for a security tag having another embodiment of a wedge and biasing member in accordance with one embodiment.

FIG. 53 illustrates a partial view of a cross-section (taken along a line corresponding to line D-D of FIG. 32) of a security tag 10100 with a tack 2102 and another embodiment of a biasing member. In this embodiment, leaf spring 8350 of biasing member 8302 has been replaced by compression spring 10350 of biasing member 10302 to provide the biasing force to wedge 3202R or another wedge for security tag 10100. Compression spring 10350 may be secured to wedge 3202R at spring support 10360, such as by being integral, by being secured by epoxy and/or friction, or by another securing means, or may not be secured thereto.

Figure 54:
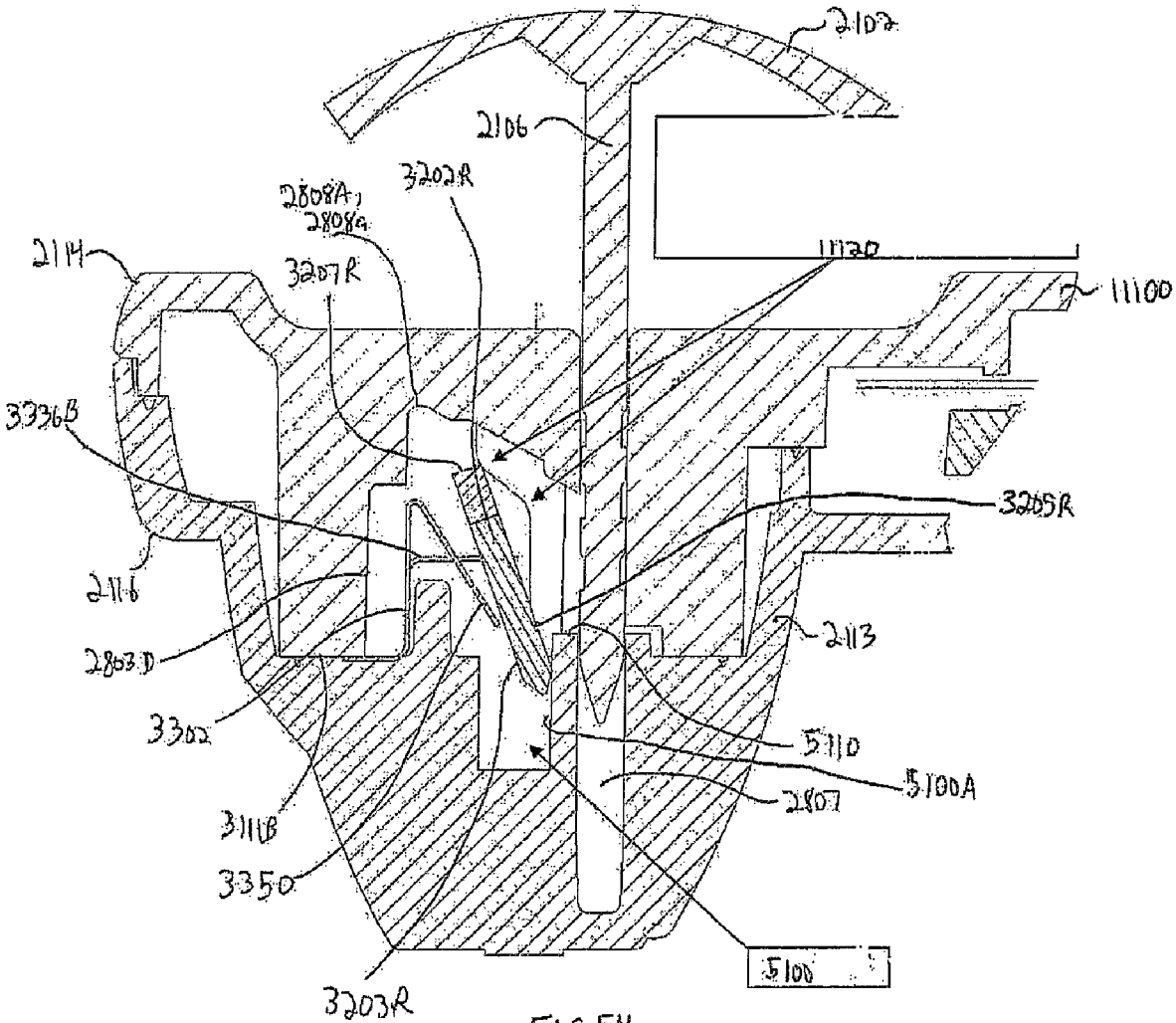
FIG. 54 illustrates a first partial view of a cross-section taken along a line corresponding to line D-D of FIG. 32 of a resettable security tag and a tack in accordance with one embodiment.
Figure 55:
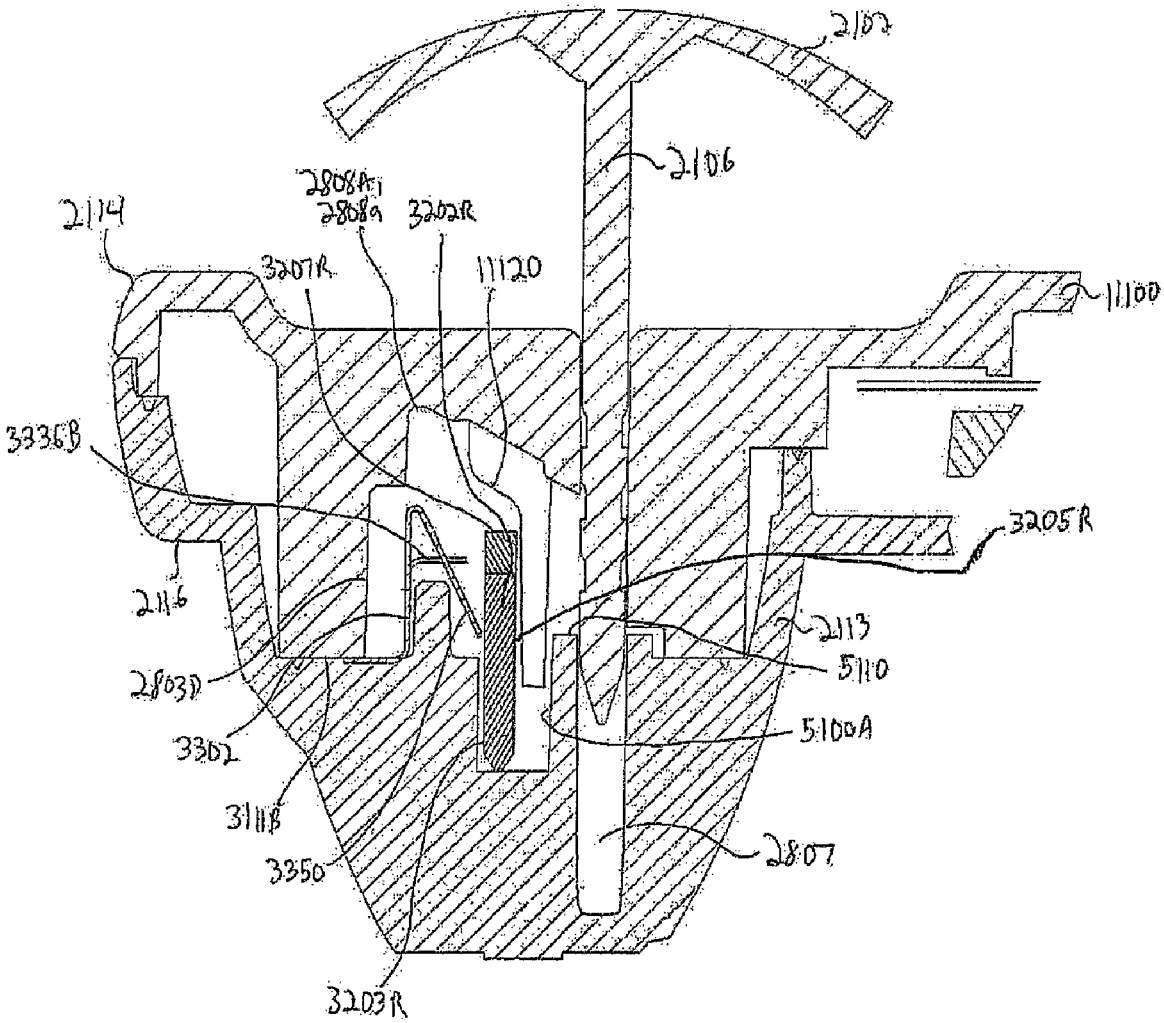
FIG. 55 illustrates a second partial view of a cross-section taken along a line corresponding to line D-D of FIG. 32 of a resettable security tag and a tack in accordance with one embodiment.
Figure 56:
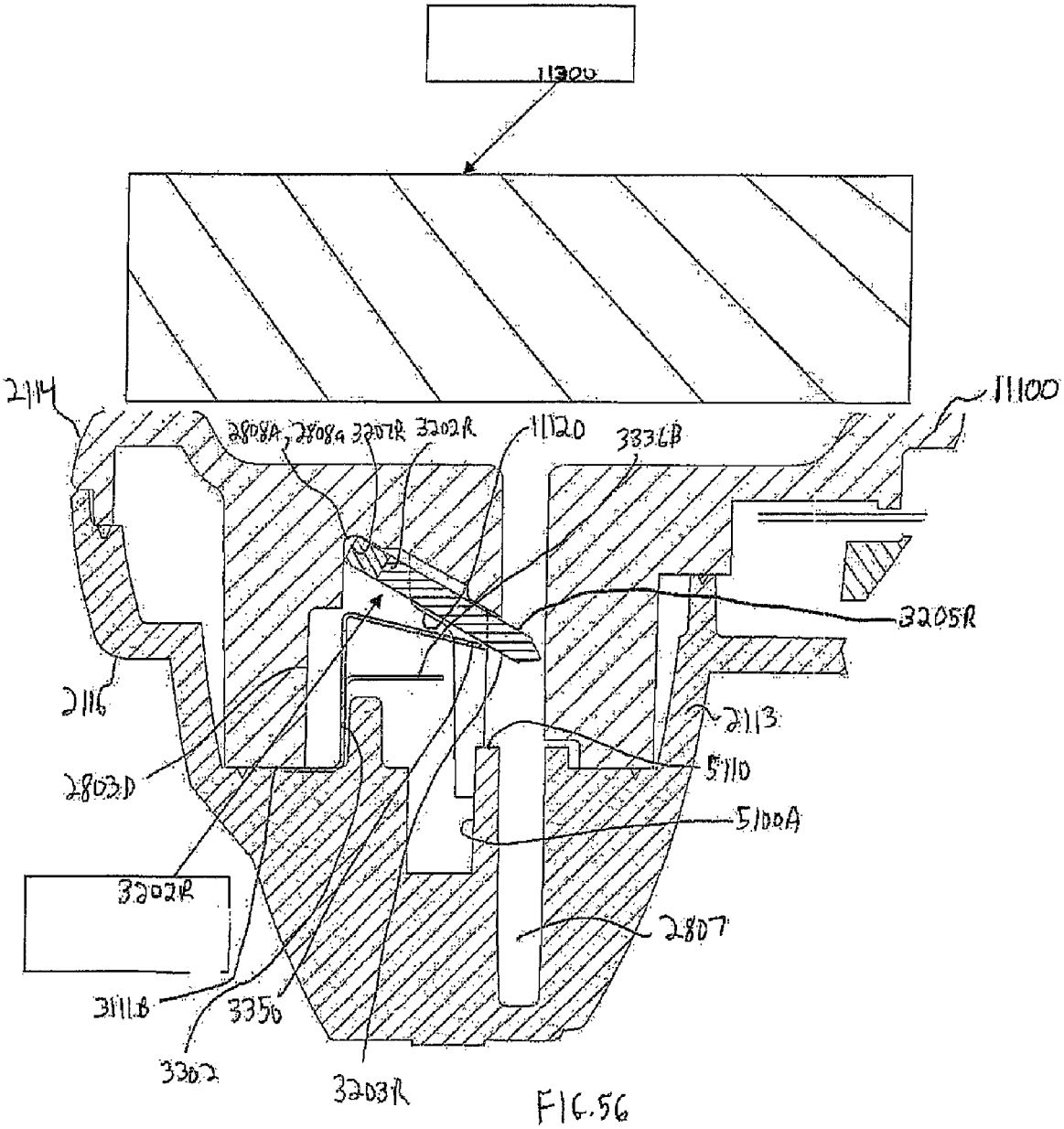
FIG. 56 illustrates a third partial view of a cross-section taken along a line corresponding to line D-D of FIG. 32 of a resettable security tag and a magnetic device for resetting the security tag in accordance with one embodiment.

In another embodiment as shown in FIGS. 54-56, security tag 11100 may be resettable. Security tag 11100 in these figures may be similar to the embodiment of security tag 2100 of FIGS. 46-48, except in this embodiment wedge catch 5120 has been replaced by guiding ramp 11120. Guiding ramp 11120 may be a curved portion of upper housing 2114 and may be, in various embodiments, one or more ramped portions in which wedge 3202R may contact and slide against to guide movement of wedge 3202R from and back to its original position, such as shown in FIG. 56 described below. For example, in one such embodiment, guiding ramp 11120 includes two ramps each aligned such that one of the wedge protrusions 3221R-3222R of wedge 3202R may slide along a ramp during movement of wedge 3202R during operation of security tag 11100, such as described below.

FIG. 54 illustrates a first partial view of a cross-section (taken along a line corresponding to line D-D of FIG. 32) of a resettable security tag 11100 and a tack 2102, in accordance with one embodiment. The security tag 11100 as shown in FIG. 54 may correspond to that of FIG. 46 such that the wedge 3202R has moved out of its original position by magnetic force from a detaching device to a position partially within trap cavity 5100.

FIG. 55 illustrates a second partial view of a cross-section (taken along a line corresponding to line D-D of FIG. 32) of a resettable security tag 11100 and a tack 2102, in accordance with one embodiment. The security tag 2100 of FIG. 55 may correspond to that of FIG. 47 such that wedge 3202R has moved further into trap cavity 5100.

FIG. 56 illustrates a third partial view of a cross-section (taken along a line corresponding to line D-D of FIG. 32) of a resettable security tag 11100 and a magnetic device 11300 for resetting the security tag, in accordance with one embodiment. In this embodiment, wedge 3202R may be reset from the position of wedge 3202R in FIG. 55, such as at a customer site or factory, by force of magnetic device 11300. Magnetic device 11300 may cause movement of wedge 3202R back to the original position of wedge 3202R as shown, such that wedge 3202R is operable again. This movement may include sliding of wedge 3202R along guiding ramp 11120 and/or other movement.

One or more of the security tag embodiments described above, such as security tag 6100, 7100, 8100, 9100, 10100, and 11100 in addition to embodiments of security tags 2100 may be detached from an article 202 using a magnetic detaching device, such as the magnetic detaching device 602 of FIG. 6, which may be shaped to receive at least a portion of the particular security tag. For example, in one embodiment, tag receiving hole 611 of magnetic security device 602 may be shaped to receive at least a portion of protrusion 2124 of security tag 2100.

In any of the aforementioned security tag embodiments of FIGS. 32-56, embodiments of spring 1302 of FIGS. 1-31 may replace the biasing element, and any embodiments of wedge 1202 of FIGS. 1-31 may replace the wedge 3202R or other wedge.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. A security tag, comprising: a housing to hold a tack retaining system, said tack retaining system to include a wedge and a biasing member arranged to retain a tack assembly by biasing a first tack retaining edge of said wedge against said tack assembly and cause said wedge to pivot, and to release said tack assembly when exposed to a magnetic field.

2. The security tag of claim 1, wherein said wedge comprises a tack retaining portion, said tack retaining portion including said first tack retaining edge.

3. The security tag of claim 2, wherein said tack retaining edge is formed by two surfaces, at least one of which is curved.

4. The security tag of claim 2, wherein said tack retaining portion further includes at least one more tack retaining edge.

5. The security tag of claim 4, wherein said tack retaining portion further includes a front side, said front side extending between said first and second tack retaining edges.

6. The security tag of claim 1, wherein said wedge comprises a tack retaining portion, said tack retaining portion including a first chamfer.

7. The security tag of claim 6, wherein said tack retaining portion further includes a second chamfer.

8. The security tag of claim 7, wherein said first and second chamfers include a coincident edge.

9. The security tag of claim 1, wherein said wedge comprises a rounded tack retaining portion.

10. The security tag of claim 1, wherein said wedge is a symmetrical wedge.

11. The security tag of claim 10, wherein said symmetrical wedge comprises a tack retaining portion, said tack retaining portion including a tack retaining edge.

12. The security tag of claim 10, wherein said symmetrical wedge comprises a tack retaining portion, said tack retaining portion including two tack or more retaining edges.

13. The security tag of claim 10, wherein said symmetrical wedge comprises a tack retaining portion, said tack retaining portion being curved.

14. The security tag of claim 1, wherein said biasing member comprises a spring.

15. The security tag of claim 14, wherein said spring comprises metal.

16. The security tag of claim 14, wherein said spring comprises plastic.

17. The security tag of claim 14, wherein said spring comprises a leaf spring.

18. The security tag of claim 14, wherein said spring comprises a torsion spring.

19. The security tag of claim 14, wherein said spring comprises a wire spring.

20. The security tag of claim 14, wherein said spring is integral with said housing.

21. The security tag of claim 14, wherein said spring comprises a compression spring.

22. The security tag of claim 1, wherein said biasing element comprises a wedge-bending element.

23. The security tag of claim 1, wherein said wedge and said biasing member are secured to each other.

24. The security tag of claim 23, wherein said wedge and said biasing member are secured to each other by being integral with each other.

25. The security tag of claim 1, wherein said biasing member comprises at least one locating element.

26. The security tag of claim 1, wherein said security tag is to be reusable.

27. The security tag of claim 1, wherein said security tag is to be for single use.

28. The security tag of claim 27, wherein said housing is to include a trap cavity to receive at least a portion of said wedge when said wedge is moved out of a locked condition.

29. The security tag of claim 28, wherein said housing is to include a wedge catch to restrict movement of said wedge out of said trap cavity and into a position in which said security tag is operable.

30. The security tag of claim 1, wherein the security tag is to be resettable.

31. The security tag of claim 30, wherein said housing is to include a trap cavity to receive at least a portion of said wedge when said wedge is moved out of a locked condition.

32. The security tag of claim 31, wherein said housing is to include a guiding ramp to guide movement of said wedge out of said trap cavity and into a position in which said security tag is operable.

33. The security tag of claim 1, wherein said housing is further to hold a sensor.

34. The security tag of claim 33, wherein said sensor comprises a magnetic sensor.

35. The security tag of claim 33, wherein said sensor comprises an acoustic magnetic sensor.

36. The security tag of claim 33, wherein said sensor comprises a radio-frequency sensor.

37. The security tag of claim 33, wherein said sensor comprises an RFID sensor.

38. The security tag of claim 33, wherein said sensor comprises a ferrite assembly.

39. The security tag of claim 33, wherein said sensor comprises two or more types of sensors.

40. The security tag of claim 1, said housing to have a wedge stop, said wedge stop to limit movement of said wedge.

41. The security tag of claim 1, said wedge including a tack retaining portion, said tack assembly to have a tack shank, and said tack shank including a groove to contact said tack retaining portion when said tack shank is inserted into said housing.

42. The security tag of claim 41, said groove having a groove lip, said biasing member to bias said tack retaining portion into said groove when said tack shank is inserted into said housing such that said groove lip is to contact said tack retaining portion to form a locked condition.

43. The security tag of claim 1, said wedge comprising a first protrusion and a second protrusion, and said housing to have a first recess and a second recess to receive said first and second protrusions, respectively.

44. The security tag of claim 1, said housing to have a detacher interface for a magnetic detaching device.

45. The security tag of claim 44, said magnetic detaching device to include a tag interface to receive at least a portion of said detacher interface.

46. The security tag of claim 45, said wedge to engage said tack assembly in a locked condition, said wedge to be moved out of said engagement when said tag interface receives said at least a portion of said detacher interface.

47. The security tag of claim 46, said movement of said wedge out of said engagement to include a rotational movement.

48. The security tag of claim 46, said movement of said wedge out of said engagement to include a translational movement.

49. The security tag of claim 46, said movement of said wedge out of said engagement to include a combination of a rotational movement and a translational movement.

50. A security tag, comprising: an attachment end having a first compartment to hold a tack retaining system, said tack retaining system to include a wedge and a biasing member arranged to retain a tack assembly by biasing a first tack retaining edge of said wedge against said tack assembly and cause said wedge to pivot, and to release said tack assembly when exposed to a magnetic field; and a detection end having a second compartment to hold an electronic article surveillance sensor.

51. The security tag of claim 50, wherein said magnetic field is to be from a magnetic detaching device.

52. The security tag of claim 50, wherein said electronic article surveillance sensor comprises a magnetic sensor.

53. The security tag of claim 50, wherein said electronic article surveillance sensor comprises an acoustic magnetic sensor.

54. The security tag of claim 50, wherein said sensor comprises a radio-frequency sensor.

55. The security tag of claim 50, wherein said electronic article surveillance sensor comprises an RFID sensor.

56. The security tag of claim 50, wherein said electronic article surveillance sensor comprises a ferrite assembly.

57. The security tag of claim 50, wherein said electronic article surveillance sensor comprises two or more types of sensors.

58. A security tag, comprising: a housing to receive a tack retaining system and an electronic article surveillance sensor therein, said tack retaining system to include a wedge and a biasing member arranged to retain a tack assembly by biasing a first tack retaining edge of said wedge against said tack assembly and cause said wedge to pivot, and to release said tack assembly when exposed to a magnetic field.

59. The security tag of claim 58, wherein said housing is to include an upper housing having a wedge compartment to receive said wedge and said biasing member.

60. The security tag of claim 59, said tack assembly to include a tack shank, and said housing is further to include an aperture to receive said tack shank, said aperture to extend into said wedge compartment.

61. The security tag of claim 59, wherein said wedge compartment is further to receive at least a portion of said tack assembly, said wedge to engage said tack assembly in a locked condition.

62. The security tag of claim 61, said tack assembly to include a tack shank having one or more grooves, said biasing member to bias said wedge toward a position in which said wedge engages one of said one or more grooves in said locked condition.

63. The security tag of claim 59, wherein said upper housing is further to include a detacher interface.

64. The security tag of claim 59, wherein said housing is further to include a lower housing, said lower housing to include a bearing surface to restrict movement of said biasing member out of said wedge compartment.

65. The security tag of claim 59, wherein said housing is further to include a lower housing, said lower housing to include a bearing protrusion to restrict movement of said biasing member within said wedge compartment.

66. A security tag, comprising: means for engaging a tack assembly within a housing in the locked condition, said means for engaging the tack assembly comprising a wedge and a biasing member arranged to bias a first tack retaining edge of said wedge against said tack assembly and cause said wedge to pivot; and means for releasing said engagement of said tack assembly from said locked condition.

* * * * *